US010785858B2

(12) United States Patent
Kaminer et al.

(10) Patent No.: US 10,785,858 B2
(45) Date of Patent: Sep. 22, 2020

(54) APPARATUS AND METHODS FOR GENERATING ELECTROMAGNETIC RADIATION

(71) Applicant: Massachusetts Institute of Technology, Cambridge, MA (US)

(72) Inventors: Ido Kaminer, Cambridge, MA (US); Liang Jie Wong, Singapore (SG); Ognjen Ilic, Pasdena, CA (US); Yichen Shen, Cambridge, MA (US); John Joannopoulos, Belmont, MA (US); Marin Soljacic, Belmont, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 1123 days.

(21) Appl. No.: 15/014,401

(22) Filed: Feb. 3, 2016

(65) Prior Publication Data

US 2016/0227639 A1 Aug. 4, 2016

Related U.S. Application Data

(60) Provisional application No. 62/111,180, filed on Feb. 3, 2015.

(51) Int. Cl.
*H05G 2/00* (2006.01)

(52) U.S. Cl.
CPC ..... *H05G 2/00* (2013.01)

(58) Field of Classification Search
CPC ..... H05G 2/00; H05G 2/008; G02B 6/1226
See application file for complete search history.

(56) References Cited

U.S. PATENT DOCUMENTS 4,119,855 A 10/1978 Bernacki
2002/0036264 A1* 3/2002 Nakasuji ..... G01N 23/225 250/306
2005/0064303 A1* 3/2005 Yamada ..... G03F 1/54 430/5

(Continued)

FOREIGN PATENT DOCUMENTS

EP 2 602 821 A1 6/2013

OTHER PUBLICATIONS

F. Javier Garcia de Abajo,"Multiple Excitation of Confined Graphene Plasmons by Single Free Electrons", Nov. 12, 2013, ACS Nano, vol. 7, pp. 11409-11419. (Year: 2013).*

(Continued)

*Primary Examiner* — Dani Fox
*Assistant Examiner* — Soorena Kefayati
(74) *Attorney, Agent, or Firm* — Smith Baluch LLP

(57) ABSTRACT

An apparatus includes at least one conductive layer, an electromagnetic (EM) wave source, and an electron source. The conductive layer has a thickness less than 5 nm. The electromagnetic (EM) wave source is in electromagnetic communication with the at least one conductive layer and transmits a first EM wave at a first wavelength in the at least one conductive layer so as to generate a surface plasmon polariton (SPP) field near a surface of the at least one conductive layer. The electron source propagates an electron beam at least partially in the SPP field so as to generate a second EM wave at a second wavelength less than the first wavelength.

42 Claims, 42 Drawing Sheets

(56) References Cited

U.S. PATENT DOCUMENTS

2005/0147199 A1* 7/2005 Dunham ..... A61B 6/032 378/5
2005/0156521 A1* 7/2005 Yaniv ..... H01J 3/08 313/542
2005/0270538 A1* 12/2005 Meehan ..... G02F 1/195 356/445
2006/0151696 A1* 7/2006 Khursheed ..... H01J 37/28 250/310
2007/0205375 A1* 9/2007 Ward ..... H01J 27/26 250/398
2008/0029700 A1* 2/2008 Fujieda ..... H01J 1/3044 250/310
2008/0083881 A1* 4/2008 Gorrell ..... B82Y 20/00 250/399
2008/0251704 A1* 10/2008 Carras ..... H01L 31/0236 250/237 G
2009/0127473 A1* 5/2009 Kimura ..... B82Y 10/00 250/396 R
2009/0230332 A1* 9/2009 Buttrill ..... H01J 25/00 250/503.1
2011/0215705 A1 9/2011 Long et al.
2011/0304283 A1* 12/2011 Sprangle ..... H01J 23/06 315/500
2012/0106577 A1* 5/2012 Balcou ..... H01S 3/0903 372/2
2012/0267552 A1* 10/2012 Lukaszew ..... G01N 21/553 250/492.1
2013/0214244 A1* 8/2013 Sanborn ..... H01J 1/304 257/10
2014/0056551 A1* 2/2014 Liu ..... G02F 1/025 385/2
2014/0183441 A1 7/2014 Park et al.
2014/0299782 A1* 10/2014 Seryi ..... H01J 35/02 250/393
2014/0319385 A1* 10/2014 Mikhailov ..... H01L 29/4238 250/493.1
2014/0358128 A1* 12/2014 Montazeri ..... A61M 31/002 604/890.1
2015/0168747 A1* 6/2015 Kadono ..... G02F 1/13439 348/360
2015/0228839 A1* 8/2015 Park ..... H01L 24/06 257/82
2015/0228859 A1* 8/2015 Morreale ..... H01L 29/1606 257/29
2016/0141835 A1* 5/2016 Liang ..... H01S 5/18386 372/4

OTHER PUBLICATIONS

Abbas, A. N., et al. "Patterning, characterization, and chemical sensing applications of graphene nanoribbon arrays down to 5 nm using helium ion beam lithography," *ACS Nano* 8, pp. 1538-1546 (2014).
Adamo, G. et al., "Light Well: A Tunable Free Electron Light Source on a Chip," *Physical Review Letters* 103, pp. 113901-1-113901-4 (2009).
Alonso-González, P., et al. "Controlling graphene plasmons with resonant metal antennas and spatial conductivity patterns," *Science* 344, pp. 1369-1373 (2014).
Apalkov, V. et al., "Proposed graphene nanospaser," *Light: Science & Applications* 3, e191, 6 pp. (2014).
Artru. X. et al., "Practical theory of the multilayered transition radiation detector," *Physical Review D*, vol. 12, No. 5, pp. 1289-1306 (1975).
Atwater, H., "The promise of plasmonics," *Scientific American* 296, pp. 56-62 (2007).
Barnes, W. L. et al., "Surface plasmon subwavelength optics," *Nature* vol. 424, pp. 824-830 (2003).
Batrakov, K. G. et al., "Carbon nanotube as a Cherenkov-type light emitter and free electron laser," *Physical Review B* 79, pp. 125408-1-125408-12 (2009).
Batrakov, K. G. et al., Toward the nano-FEI: Undulator and Cherenkov Mechanisms of Light Emission in Carbon Nanotubes, *Physica E* 40, pp. 1065-1068 (2008).
Beams, R. et al., "Electroluminescence from graphene excited by electron tunneling," *Nanotechnology* 25, 5 pp. (2014).
Berciaud, S. et al., "Electron and optical phonon temperatures in electrically biased graphene," *Physical Review Letters* 104, pp. 227401-1-227401-4 (2010).
Bharadwaj, P. et al., "Electrical excitation of surface plasmons," *Physical Review Letters* 106, pp. 226802-1-226802-4 (2011).
Brar, V. W. et al., "Highly confined tunable mid-infrared plasmonics in graphene nanoresonators," *Nano Letters* 13, pp. 2541-2547 (2013).
Brar, V. W. et al., "Observation of Carrier-Density-Dependent Many-Body Effects in Graphene via Tunneling Spectroscopy," *Physical Review Letters* 104, pp. 036805-1-036805-4 (2010).
Breuer, J., "Laser-Based Acceleration of Nonrelativistic Electrons at a Dielectric Structure," *Physical Review Letters* 111, pp. 134803-1-134803-5 (2013).
Brinkmann, R. et al., "A low emittance, flat-beam electron source for linear colliders," *Physical Review Special Topics—accelerators and Beams*, vol. 4, pp. 053501-1-053401-4 (2001).
Britnell, et al., "Field-effect Tunneling Transistor Based on Vertical Graphene Heterostructures," *Science* 335, pp. 947-950 (2012).
Brongersma, M. L. et al., "Plasmon-induced hot carrier science and technology," *Nature Nanotechnology* 10, pp. 25-34 (Jan. 6, 2015).
Carr, G. L. et al., "High Power Terahertz: radiation from relativistic electrons," *Nature* 420, pp. 153-156 (2002).
Castro, E. V. et al., "Biased bilayer graphene: semiconductor with a gap tunable by the electric field effect," *Physical Review Letters* 99, pp. 216802-1-216802-4 (2007).
Chaplilk, A. V., "Energy spectrum and electron scattering processes in inversion layers," *Sov. Phys.—JETP* 33, pp. 997-1000 (1971).
Chen, J. et al., "Optical nano-imaging of gate-tunable graphene plasmons," *Nature* 487, pp. 77-81 (2012).
Cheng, S. et al., "A compact X-ray generator using a nanostructured field emission cathode and a Microstructured Transmission Anode," *Journal of Physics: Conference Series* 476, 5 pp. (2013).
Cherry, M. L. et al., "Measurements of the frequency spectrum of transition radiation," *Physical Review Letters*, vol. 38, No. 1, pp. 5-8 (1977).
Constant, et al., "All-Optical Generation of Surface Plasmons in Graphene," arXiv:1505.00127v2 [physics.optics], pp. 1-15 and Supplementary Information, pp. 1-12 (Jul. 7, 2015; version 1 posted May 1, 2015).
Ebert, P. J. et al., "Transition X rays from Medium-Energy Electrons," *Physical Review Letters*, vol. 54, No. 9, pp. 893-896 (1985).
England, Joel R. et al., "Dielectric Laser Accelerators," *Reviews of Modern Physics*, vol. 86, No. 4, pp. 1337-1389 (2014).
Fang, Y. et al., "Nanoplasmonic waveguides: towards applications in integrated nanophotonic circuits," *Light: Science & Applications* 4, 11 pp. (Jun. 5, 2015).
Fei, Z., et al., "Gate-tuning of graphene plasmons revealed by infrared nano-imaging," *Nature* 487, pp. 82-85 (2012).
Ferguson, B. et al., "Materials for terahertz science and technology," *Nature Materials*, vol. 1, pp. 26-33 (2002).
Gabor, N. M. et al., "Hot carrier—assisted intrinsic photoresponse in graphene," *Science* 334, pp. 648-652 (2011).
García De Abajo, F. J., "Graphene Plasmonics: Challenges and Opportunities," *ACS Photonics* 1, pp. 135-152 (2014).
García De Abajo, F. J., "Multiple excitation of confined graphene plasmons by single free electrons," *ACS Nano* 7, pp. 11409-11419. (2013).
Geim, A. K. et al., "The rise of graphene," *Nature Materials* 6, pp. 183-191 (2007).
Gevorkian, Zh. S. et al., "New Mechanism of X-ray radiation from a relativistic charged particle in a dielectric random medium," *Physical Review Letters*, vol. 86, No. 15, pp. 3324-3327 (2001).
Ginzburg, V. L., "Quantum Theory of Radiation of Electron Uniformly Moving in Medium," *Journal of Physics*, vol. 11, No. 6, pp. 441-452 (1940).
Grigorenko, A. N. et al., "Graphene plasmonics," *Nature Photonics* 6, pp. 749-758 (2012).

(56) References Cited

OTHER PUBLICATIONS

Gu, T., et al., "Photonic and plasmonic guiding modes in graphene-silicon photonic crystals," *ACS Photonics* 2, pp. 1552-1558 (Apr. 20, 2015).
Gumbs, G. et al., "Tunable surface plasmon instability leading to emission of radiation," *Journal of Applied Physics* 118, pp. 054303-1-054303-10 (Aug. 4, 2015).
Huang, K. C. Y. et al., "Electrically driven subwavelength optical nanocircuits," *Nature Photonics* 8, pp. 244-249 (2014).
Huang, Z.R. et al., "A Review of X-ray Free-Electron Laser Theory," *Physical Review Special Topics —Accelerators and Beams* 10, pp. 034801-1-034801-26 (2007).
Hwang, E. H. et al., "Dielectric function, screening, and plasmons in two-dimensional graphene," *Physical Review* 5 75, pp. 205418-1-205418-6 (2007).
Jablan, M, et al., "Plasmons in Graphene: Fundamental Properties and Potential Applications," *Proceedings of the IEEE*, vol. 101, No. 7, pp. 1689-1704 (2013).
Jablan, M. et al., "Plasmonics in graphene at infrared frequencies," *Physical Review B* 80, pp. 245435-1-245435-7 (2009).
Ju, L., et al., "Graphene plasmonics for tunable terahertz metamateriais," *Nature Nanotechnology* 6, pp. 630-634 (2011).
Kaminer, I. et al., "Quantum Theory of Čerenkov Radiation, Spectral Cutoffs and the Role of Spin and Orbital Angular Momentum," *arXiv*:1411.0083, 27 pp. (2014).
Kim, Y. D., et al., "Bright visible light emission from graphene," *Nature Nanotechnology* 10, pp. 676-681 (Jun. 15, 2015).
Koji, Y. et al., "Observation of soft x rays of single-mode resonant transition radiation from a multiplayer target with a submicrometer period," *Physical Review A*, vol. 59, No. 5, pp. 3673-3678 (1999).
Koller, D. M. et al., "Organic plasmon-emitting diode," *Nature Photonics* 2, pp. 684-687 (2008).
Koppens, F. H. et al., "Graphene piasmonics: a platform for strong light—matter interactions," *Nano Letters* 11, pp. 3370-3377 (2011).
Liu, G. et al., "Epitaxial graphene nanoribbon array fabrication using BCP-assisted nanolithography," *ACS Nano*, vol. 6, No. 8, pp. 6786-6792 (2012).
Liu, P. et al., "Tunable terahertz optical antennas based on graphene ring structures," *Appl. Phys. Lett*. 100, pp. 153111-1-153111-5 (2012).
Liu, S. et al., "Coherent and tunable terahertz radiation from graphene surface plasmon polaritons excited by an electron beam," *Applied Physics Letters* 104, pp. 201104-1-201104-5 (2014).
Lui, C. H. et al., "Ultrafast photoluminescence from graphene," *Physical Review Letters* 105, pp. 127404-1-127404-4 (2010).
Luo, C. et al., "Cerenkov radiation in photonic crystals," *Science* 299, pp. 368-371 (2003).
Luo, X. et al., "Plasmons in graphene: Recent progress and applications," *Materials Science and Engineering R Reports* 74, pp. 351-376 (2013).
MacDonald, K. F. et al., "Ultrafast active plasmonics," *Nature Photonics* 3, pp. 55-58 (2009).
Meric, I. et al., "Current saturation in zero-bandgap, top-gated graphene field-effect transistors," *Nature Nanotechnology* 3, pp. 654-659 (2008).
Mikhailov, S. A., "Graphene-based voltage-tunable coherent terahertz emitter," *Physical Review B* 87, pp. 115405-1-115405-6 (2013).
Moskalenko, A. S. et al., "Radiative damping and synchronization in a graphene-based Terahertz emitter," *J. Appl. Phys*. 115, pp. 203110-1-203110-8 (2014).
Müller, F. et al., "Electron-electron interaction in ballistic electron beams," *Physical Review B*, vol. 51, No. 8, 7 pp. (1995).
Nagao, T., "Low-dimensional plasmons in atom-scale metallic objects," *Proc. SPIE 7600, Ultrafast Phenomena in Semiconductors and Nanostructure Materials XIV*, 76001Q, 8 pp. (2010).
Neto, A. C. et al., "The electronic properties of graphene," *Reviews of Modern Physics* 81, pp. 109-162 (2009).
Novoselov, K. S. et al., "Electric field effect in atomically thin carbon films," *Science* 306, pp. 666-669 (2004).
Ooi, K. J. et al., "Highly Efficient Midinfrared On-Chip Electrical Generation of Graphene Plasmons by Inelastic Electron Tunneling Excitation," *Physical Review Applied* 3, pp. 054001-1-054001-7 (May 8, 2015).
Page, A. F. et al., "Nonequilibrium plasmons with gain in graphene," *Phys. Rev. B* 91, pp. 075404-1-075404-15 (2015).
Peralta, E. A. et al., "Demonstration of electron acceleration in a laser-driven dielectric microstructure," *Nature* 503, 11 pp. (2013).
Pines, D. et al., "Approach to equilibrium of electrons, plasmons, and phonons in quantum and classical plasmas," *Physical Review* 125, pp. 804-812 (1962).
Popmintchev, T. et al., "Bright coherent ultrahigh harmonics in the KeV X-ray regime from mid-infrared femtosecond lasers," *Science* 336, pp. 1287-1291 (2012).
Rana, F., "Graphene terahertz plasmon oscillators," *IEEE Transactions on Nanotechnology*, vol. 7, No. 1, pp. 91-99 (2008).
Rana, F. et al., "Ultrafast carrier recombination and generation rates for plasmon emission and absorption in graphene," *Physical Review B* 84, pp. 045437-1-045437-7 (2011).
Rodrigo, D. et al., "Mid-infrared plasmonic biosensing with graphene," *Science* 349, pp. 165-168 (Jul. 10, 2015).
Rugeramigabo, E. P. et al., "Experimental investigation of two-dimensional plasmons in a DySi2 monolayer on Si(111)," *Physical Review B* 78, pp. 155402-1-155402-6 (2008).
Schwoerer, H. et al., "Thomsom-backscattered X rays from laser-accelerated electrons," *Physical Review Letters* 96, pp. 014802-1-014802-4 (2006).
Shen, Y. D. et al., "Optical Broadband Angular Selectivity," *Science* 343, pp. 1499-1501 (2014).
Shen, Y. et al., "Metamaterial broadband angular selectivity," *Physical Review B* 90, pp. 125422-1-125422-5 (2014).
Shi, X. et al., "Caustic graphene plasmons with Kelvin angle," *Physical Review B* 92, pp. 081404-1-081404-5 (2015).
Song, J. C. et al., "Energy flows in graphene: hot carrier dynamics and cooling," *Journal of Physics: Condensed Matter* 27, 15 pp. (May 12, 2015).
Song, J. C. W., "Hot Carriers in Graphene," PhD Thesis, Harvard University, 189 pp. (2014).
Stern, F., "Polarizability of a two-dimensional electron gas," *Physical Review Letters* 18, pp. 546-548 (1967).
Sun, D. et al., "Ultrafast hot-carrier-dominated photocurrent in graphene," *Nature Nanotechnology* 7, pp. 114-118 (2012).
Sundararaman, R. et al., "Theoretical predictions for hot-carrier generation from surface plasmon decay," *Nature Communications* 5, pp. 1-8 (2014).
Tielrooij, K. J. et al., "Electrical control of optical emitter relaxation pathways enabled by graphene," *Nature Physics* 11, pp. 281-287 (Jan. 19, 2015).
Tielrooij, K. J. et al., "Generation of photovoltage in graphene on a femtosecond timescale through efficient carrier heating," *Nature Nanotechnology* 10, pp. 437-443 (Apr. 13, 2015).
Tse, W. K. et al., "Ballistic hot electron transport in graphene," *Applied Physics Letters* 93, pp. 023128-1-023128-3 (2008).
Vakil, A. et al., "Transformation optics using graphene," *Science* 332, pp. 1291-1294 (2011).
Van Der Slot, P. J. M. et al., "Photonics Free-electron Lasers," *IEEE Photonics Journal* 4, pp. 570-573 (2012).
Wang, L., et al., "One-dimensional electrical contact to a two-dimensional material," *Science* 342, pp. 614-617 (2013).
Wartski, L. S. et al., "Interference phenomenon in optical transition radiation and its application to particle beam diagnostic and multiple-scattering measurements," *Journal of Applied Physics* 46, pp. 3644-3653 (1975).
Withers, F. et al., "Light-emitting diodes by band-structure engineering in van der Waals heterostructures," *Nature Materials* 14, pp. 301-306 (Feb. 2, 2015).
Wong, L. J. et al., "Towards graphene plasmon-based free-electron infrared to X-ray sources," *Nature Photonics*, Nature Photonics DOI: 10.1038/NPHOTON.223; pp. 1-7 (Nov. 23, 2015).
Wunsch, B. et al., "Dynamical polarization of graphene at finite doping," *New Journal of Physics* 8, 15 pp. (2006).

(56) References Cited

OTHER PUBLICATIONS

Xi, S. et al., "Experimental verification of reversed Cherenkov radiation in left-handed metamaterial," *Physical Review Letters* 103, 194801-1-194801-4 (2009).
Zhang, Q. et al., "Graphene surface plasmons at the near-infrared optical regime," *Scientific Reports* 4, pp. 1-6 (2014).
Zhou, S. Y. et al., "First direct observation of Dirac fermions in graphite," *Nature Physics* 2, pp. 595-599 (2006).
Zhu, J. P. et al., "Formation of compressed flat electron beams with high transverse emittance ratios," *Physical Review Special Topics—Accelerators and Beams* 17, pp. 084401-1-084401-16 (2014).
International Search Report and Written Opinion from International Application No. PCT/US16/16305, dated Jun. 3, 2016.
Ekgasit et al., "Influence of the Metal Film Thickness on the Sensitivity of Surface Plasmon Resonance Biosensors." Applied Spectroscopy. 59. 661-7. (2005) 10.1366/0003702053945994.

* cited by examiner

FIG. 15A 3.7 MeV, 3 GV/m

APPARATUS AND METHODS FOR GENERATING ELECTROMAGNETIC RADIATION

CROSS-REFERENCES TO RELATED APPLICATIONS

This application claims priority to U.S. provisional application Ser. No. 62/111,180, filed Feb. 3, 2015, entitled "NOVEL RADIATION SOURCES FROM THE INTERACTION OF ELECTRON BEAMS WITH SURFACE PLASMON SYSTEMS," which is hereby incorporated herein by reference in its entirety.

GOVERNMENT SUPPORT

This invention was made with Government support under Grant No. W911NF-13-D-0001 awarded by the U.S. Army Research Office. The Government has certain rights in the invention.

BACKGROUND

X-rays (photon energy between about 100 eV and about 100 keV) have applications in a wide range of areas. For example, in medicine and dentistry, X-rays are used for diagnosis of broken bones and torn ligaments, detection of breast cancer, and discovery of cavities and impacted wisdom teeth. Computerized axial tomography (CAT) also uses X-rays produce cross-sectional pictures of a part of the body by sending a narrow beam of X-rays through the region of interest from many different angles and reconstructing the cross-sectional picture using computers. X-rays can also be used in elemental analysis, in which measurement of X-rays that pass through a sample allow a determination of the elements present in the sample. In business and industry, X-ray pictures of machines can be used to detect defects in a nondestructive manner. Similarly, pipelines for oil or natural gas can be examined for cracks or defective welds using X-ray photography. In the electronics industry, X-ray lithography is used to manufacture high density (micro- or even nano-scale) integrated circuits due to their short wavelengths (e.g., 0.01 nm to about 10 nm).

To this date, X-ray tubes are a popular X-ray source in applications such as dental radiography and X-ray computed tomography. In these tubes, electrons from a cathode collide with an anode after traversing a potential difference usually on the order of 100 kV. Radiation created by the collision generally comprises a continuous spectral background of Bremsstrahlung radiation and sharp peaks at the K-lines of the anode material. The X-rays are also emitted in all directions and the source is typically not tunable since the frequencies of the K-lines are material-specific. These limitations of X-ray tube technology translate to limitations in the resolution, contrast, and penetration depth in imaging applications. The limitations also result in longer exposure time and accordingly increased radiation dose. Moreover, the temporal resolution used for live imaging of extremely fast processes is usually beyond the reach of X-ray tubes.

As an alternative to X-ray tubes in some applications (e.g., elemental analysis), synchrotrons and free-electron lasers, which are usually based on large-scale accelerator facilities such as the Stanford Linear Accelerator Center (SLAC), can provide coherent X-ray beams with tunable wavelengths. However, these facilities are very expensive (e.g., on the order of billions of dollars) and are generally not accessible to everyday use.

A more compact approach to generate X-rays is through high harmonic generation (HHG). In this approach, an intense laser beam, usually in the infrared region (e.g., 1064 nm or 800 nm), interacts with a target (e.g., noble gas, plasma, or solid) to emit high order harmonics of the incident beam. The order of the harmonics can be greater than 200, therefore allowing generation of soft X-rays from infrared beams. However, HHG produces not only the high order harmonics in the soft X-ray region but also radiation in lower order harmonics. As a result, the energy in the particular order of harmonic of interest is generally very low and is not sufficient for most applications.

SUMMARY

Embodiments of the present invention include apparatus, systems, and methods of generating electromagnetic radiation. In one example, an apparatus includes at least one conductive layer, an electromagnetic (EM) wave source, and an electron source. The conductive layer has a thickness less than 5 nm. The electromagnetic (EM) wave source is in electromagnetic communication with the at least one conductive layer and transmits a first EM wave at a first wavelength in the at least one conductive layer so as to generate a surface plasmon polariton (SPP) field near a surface of the at least one conductive layer. The electron source propagates an electron beam at least partially in the SPP field so as to generate a second EM wave at a second wavelength less than the first wavelength.

In another example, a method of generating electromagnetic (EM) radiation includes illuminating a conductive layer, having a thickness less than 5 nm, with a first EM wave at a first wavelength so as to generate a surface plasmon polariton (SPP) field near a surface of the conductive layer. The method also includes propagating an electron beam at least partially in the SPP field so as to generate a second EM wave at a second wavelength less than the first wavelength.

In yet another example, an apparatus to generate X-ray radiation includes a dielectric layer and a graphene layer doped with a surface carrier density substantially equal to or greater than $1.5\times10^{13}$ $cm^{-2}$ and disposed on the dielectric layer. The apparatus also includes a laser, in optical communication with the graphene layer, to transmit a laser beam, at a first wavelength substantially equal to or greater than 800 nm, in the graphene layer so as to generate a surface plasmon polariton (SPP) field near a surface of the graphene layer. An electron source propagates an electron beam, having an electron energy greater than 100 keV, at least partially in the SPP field so as to generate the X-ray radiation at a second wavelength less than 2.5 nm.

In yet another example, an apparatus includes at least one conductive layer having a thickness less than 5 nm. An electromagnetic (EM) wave source is in electromagnetic communication with the at least one conductive layer to transmit a first EM wave at a first wavelength in the at least one conductive layer so as to generate a surface plasmon polariton (SPP) field in the at least one conductive layer. An electron source is operably coupled to the at least one conductive layer to propagate an electron beam in the at least one conductive layer so as to generate a second EM wave at a second wavelength less than the first wavelength.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIGS. 15A-15F show the analytical and numerical results of output radiation spectra from graphene-plasmon-based radiation sources.

DETAILED DESCRIPTION

Overview

Figure 1A:
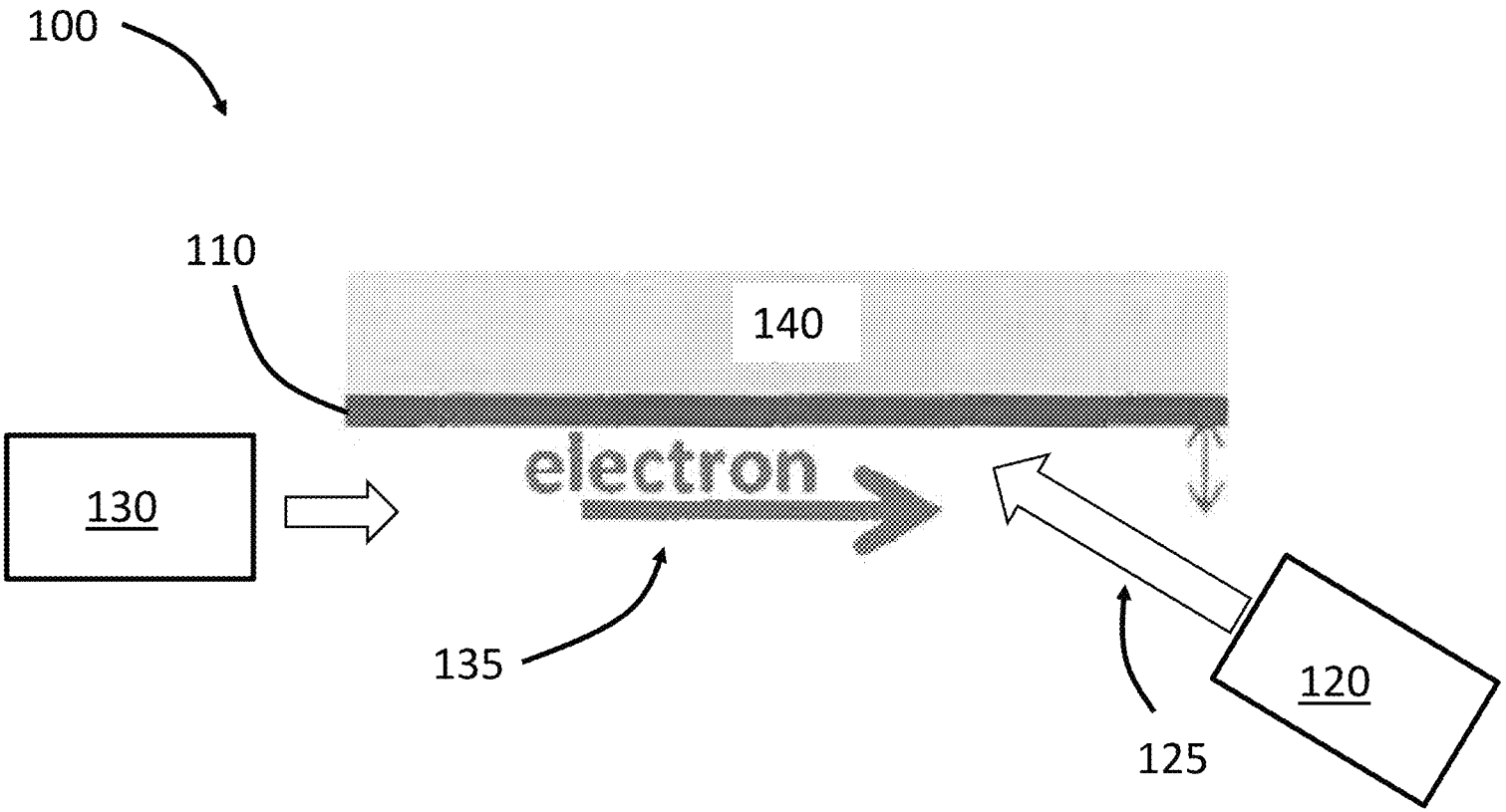
FIGS. 1A-1C illustrate a system to generate X-rays using surface plasmon polariton (SPP) fields.

So far, X-ray sources that can produce tunable and directional X-rays normally sacrifice compactness by requiring additional acceleration stages to bring the electron beam to extremely high energies and relativistic speeds ($\gamma >> 1$, where $\gamma \sim (1-(v/c)^2)^{-1/2}$, with v being the electron speed and c being the speed of light). These relativistic electrons then interact with an electromagnetic field that induces transverse oscillations in their trajectory, causing the electrons to emit radiation. Typically, the electromagnetic field is supplied by a counter-propagating electromagnetic wave (e.g., in non-linear Thomson scattering or inverse Compton scattering) or by an undulator, which is a periodic structure of dipole magnets (undulator radiation).

In Thompson scattering or inverse Compton scattering, the energies of the emitted photons $E_{out}$ and the energies of incident photons $E_{in}$ are related by $E_{out} \approx 4\gamma^2 E_{in}$. In undulators, such as SLAC, the energy of the emitted photons $E_{out}$ is about $2\gamma^2 E_{in}$, instead of $4\gamma^2 E_{in}$, due to the non-propagating nature of the magnetic field. Therefore, translating laser photons (e.g., about 1 eV) into X-ray (e.g., about 40 KeV) via laser-electron interaction normally needs electron beam having an energy on the order of about 50 MeV. As another example, in free electron lasers (FELs) that use an undulator with a period of about 3 cm (functionally similar to the wavelength in Thompson scattering or inverse Compton scattering and can be translated into incident photon energy of about $4.1 \times 10^{-6}$ eV), it takes electron beams having electron energy of about 10 GeV ($\gamma \sim 20{,}000$) to produce X-rays of the same frequency as above. High energy electron acceleration is generally costly and bulky, thereby severely limiting the widespread use.

To address the limitations of existing X-ray sources such as X-ray tubes, synchrotrons, FELs, and high harmonic generation (HHG), this application describes approaches that use electron beams of modest energy and can therefore bypass the high energy electron acceleration stage altogether. X-rays are generated when electrons interact with the surface plasmon polaritons (SPPs) of two-dimensional (2D) conductive materials (e.g., graphene). SPPs in 2D conductive materials can be well confined and have high momentum. This localization of SPP fields allows more efficient energy transfer from incident photos to output photons through:

$$E_{out} \approx 2n \times 4\gamma^2 E_{in} \quad (1)$$

The factor n is the "squeezing factor" (also referred to as the confinement factor) of the electromagnetic field when it is bounded to the surface between a metal and a dielectric. For 2D conductive materials, the squeezing factor n can be more than 100 or even higher. Therefore, approaches described here make it possible for a much lower electron acceleration (e.g., about 1-5 MeV) to create the same hard-X-ray frequency (e.g., about 40 KeV).

By simplifying or even eliminating the high energy electron acceleration in conventional X-ray sources, apparatus and methods described herein allow the development of table-top X-ray sources that are compact, tunable, coherent, and highly directional. These X-ray sources can revolutionize many fields of science, by making high-quality X-ray beams affordable to laboratories in academia and industry. Moreover, bringing these X-ray sources into regular use in hospitals would allow for incredibly sensitive imaging techniques with unprecedented resolution deep inside a human body.

In addition, the approaches of electron-SPP interaction can also be employed to create radiation in other spectral regimes, such as deep ultraviolet (UV), infrared, and Terahertz (THz), with only slight modifications. These radiation sources can have similar benefits of compactness, tunability, coherence, and directionality.

Figure 1B:
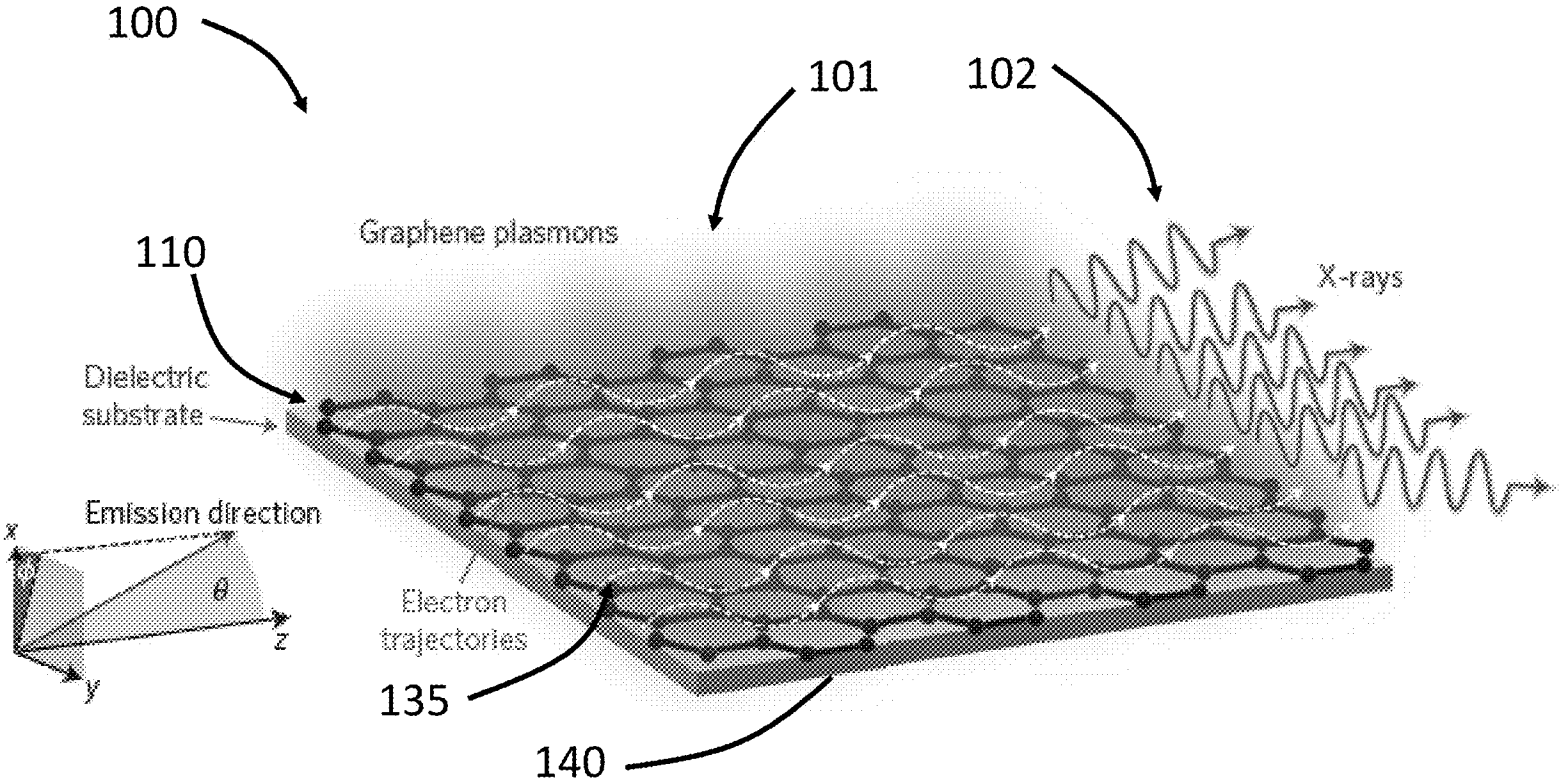
Figure 1C:
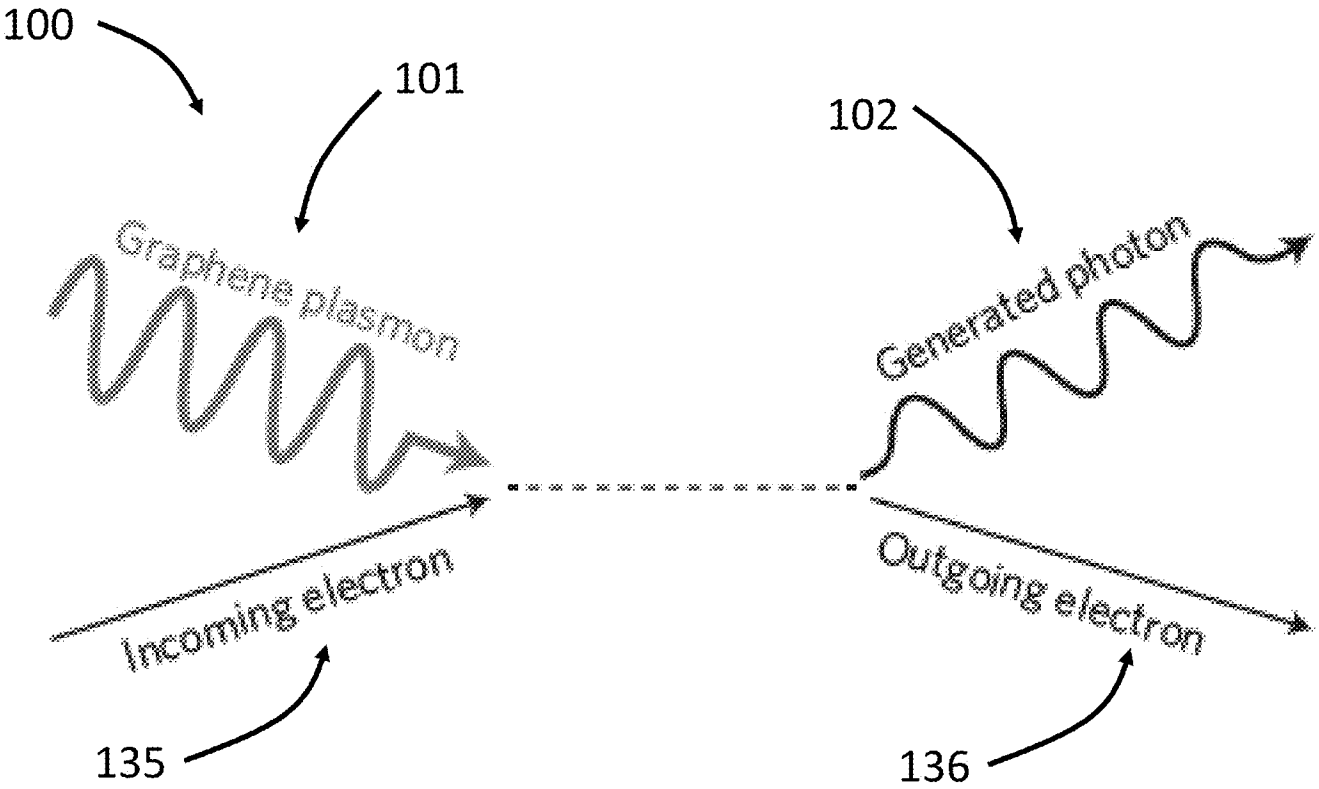

FIGS. 1A-1C illustrate radiation generation based on the interaction between electrons and SPP fields of 2D conductive materials. More specifically, FIG. 1A shows a schematic of an apparatus to generate short-wavelength radiation. FIG. 1B illustrates the X-ray emission from the interaction between electrons and SPP fields created from graphene. FIG. 1C illustrates the X-ray radiation process shown in FIG. 1B via a quasi-particle model.

The system 100 shown in FIG. 1A includes a two dimensional (2D) conductive layer 110 having a thickness less than 5 nm disposed on a dielectric substrate 140. An electromagnetic (EM) wave source 120 is in electromagnetic communication with the 2D conductive layer 110 to transmit an incident EM wave 125 toward the 2D conductive layer 110. The interaction between the 2D conductive layer and the EM wave 120 generates a surface plasmon polariton (SPP) field near the surface (e.g., within 100 nm, with 50 nm, or within 20 nm) of the 2D conductive layer 110. The system 100 also includes an electron source 130 to propagate an electron beam 135 at least partially in the SPP field. The interaction between the electron beam 135 and the SPP field then generates an output EM wave that has a wavelength shorter than the wavelength of the incident EM wave 125.

For illustrative and non-limiting purposes only, the 2D conductive layer 110 can include graphene. Surface plasmon polaritons (SPP) in graphene (also referred to as graphene plasmons, or simply GPs) can exhibit extreme confinement of light with dynamic tunability, making them promising candidates for electrical manipulation of light on the nanoscale. Highly directional, tunable, and monochromatic radiation at high frequencies can be produced from relatively low energy electrons interacting with GPs, because strongly confined plasmons have high momentum that allows for the generation of high-energy output photons when electrons scatter off these plasmons.

Without being bound by any particular theory, FIG. 1B illustrates the mechanism behind the GP-based free-electron electromagnetic radiation source. A sheet of graphene 110 on a dielectric substrate 140 sustains a GP 101, which can be excited by coupling a focused laser beam (not shown in FIG. 1B) into the graphene 110.

When electrons 135 are launched parallel to the graphene 110, subsequent interaction between electrons 135 and the GP field 101 induces transverse electron oscillations, as shown by the dotted white lines. The oscillations lead to the generation of short-wavelength, directional radiation 102, such as X-rays.

Without being bound by any particular theory, FIG. 1C illustrates the radiation process by regarding plasmons as quasi-particles interacting with electrons. In FIG. 1C, incoming electrons 135 "collide" with GPs 101, scattering away the incoming electrons 134 as outgoing electrons 136 and generating output photons 102 according to fundamental rules such as the preservation of momentum and energy. This scattering process can be governed by similar fundamental rules that describe electron-photon interactions. However, the result is substantially different, because the plasmon's dispersion relation allows the plasmon to have a much higher momentum, compared to photons at the same energy. In addition, plasmons can have longitudinal field components, which are generally absent from photons. As a result, electron-plasmon scattering is distinct from the electron-photon scattering in standard Thomson/Compton effect and can open up many possibilities not achievable with regular photons.

Two-Dimensional Conductive Layers and SPP Fields

In the approach illustrated in FIGS. 1A-1C, SPP fields 101 near the 2D conductive layer 110 function as a medium that can acquire energy from incident laser photons 125 and can then transfer the acquired energy to electrons 135 for generating short-wavelength radiations. Therefore, the properties of the SPP fields can affect the overall performance of the apparatus 100. This section describes 2D conductive materials that can be used as the 2D conductive layer 110 to create the SPP fields 101.

In general, at the interface between a metal and a dielectric (including air), there exists special electromagnetic modes called surface plasmon-polaritons (SPPs). These hybrid electron-photon states can have numerous promising applications, such as to bridge the gap between electronics and photonics, allowing high frequency communication and squeezing the photonics from micron-scale to the on-chip nano-scale. This squeezing of light can also lead to high confinement of the field to the surface, expressed in high field densities, which can be useful for enhancing many types of light-matter and light-light interactions.

Without being bound by any particular theory or mode of operation, the field squeezing originates from the fact that the SPP effective wavelength is reduced by a large factor (referred to as the "squeezing factor" n) relative to the wavelength in free-space (e.g., wavelength of the incident EM wave 125 that excites the SPP). This squeezing factor can be the basis for various promising features of the SPP, such as enhanced sensing and sub-wavelength microscopy. The squeezing factor n typically can be about 10-20 in regular metals. However, SPP modes in graphene can be much larger, reaching several hundreds and even more than a thousand.

Graphene is a two dimensional array of carbon atoms connected in a hexagonal grid. This seemingly simple material can have astonishing mechanical, electronic, and optical properties, such as high mechanical strength, high mobility, and very large absorption. One property of graphene that can be useful in the apparatus 100 shown in FIG. 1A is its ability to support low loss SPP modes. Graphene SPPs are supported by a single layer of atoms and can have a field confinement that is more than an order of magnitude higher than that in conventional metal-dielectric SPPs. In addition, the non-metallic structures of graphene can also sustain a higher field (electric field and/or electromagnetic field) without being ionized, therefore increasing the efficiency of this X-ray generation.

In the approach shown in FIGS. 1A-1C, the SPP can function as a slowly-propagating electromagnetic undulator structure with nanometer-scale periodicity because of the large squeezing factor n. Substituting the squeezing factor n of graphene SPP (e.g., n~500) into Equation (1) shows that the squeezing effect of graphene SPP can reduce the needed $\gamma$ by more than a factor of 20, compared to conventional undulator or free electron lasers, to produce the same short-wavelength radiation. This reduction of $\gamma$ is equivalent to lowering the needed acceleration voltage from about 50MV to about 2MV. This order-of-magnitude reduction of the acceleration voltage makes an X-ray source feasible on the small-lab scale, since creating electron-beams of a few MeV does not require an additional acceleration stage. Accelerator facilities around the world normally use RF electron guns producing electrons of a few MeV that are then accelerated to tens, hundreds, or even thousands and tens-of-thousands MeV. Eliminating the need for the acceleration stage can significantly simplify the design of the X-ray sources.

Optical excitation of SPP fields 101 through EM waves 125 from air can be enhanced by patterning the graphene. For example, a grating structure can be fabricated into the substrate 140, deposited on top of the graphene layer 110, or implemented as an array of graphene nano-ribbons on the substrate 140. A graphene layer can also be implemented according to one or more of the designs shown in FIGS. 2-4.

Figure 2:
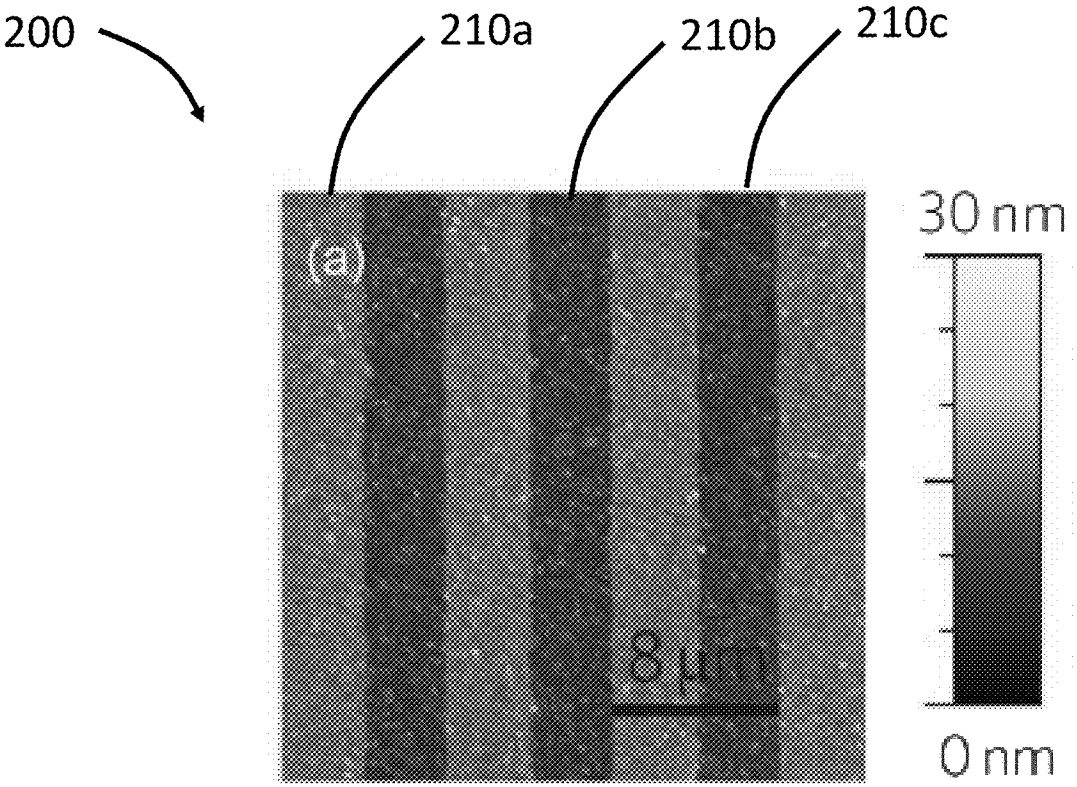
FIG. 2 shows a graphene system having a nano-ribbon structure that can be used in the system shown in FIGS. 1A-1C.

FIG. 2 shows a graphene layer 200 having a nano-ribbon structure. The graphene layer 200 includes a plurality of graphene ribbons 210*a*, 210*b*, and 210*c* cut out of a graphene plane. Each ribbon has a width w. In this configuration, plasmons can form a standing wave across the ribbon with a resonance condition given by the approximate relation $w \sim m\lambda_p/2$, where m is an integer and $\lambda_p = 2\pi/q$ is the wavelength of plasmon from infinite graphene sheet. This means that a strong absorption of light can occur at the resonance frequency that scales as $\omega_p \sim n_s^{-1/4}$, where $n_s$ is the effective electron surface density. The width w of each ribbon 210*a* to 210*c* can be from micrometers (e.g., about 10 μm, about 5 μm, about 1 μm or less) to nanometers (e.g., about 10 nm, about 50 nm, about 100 nm or more).

Figure 3:
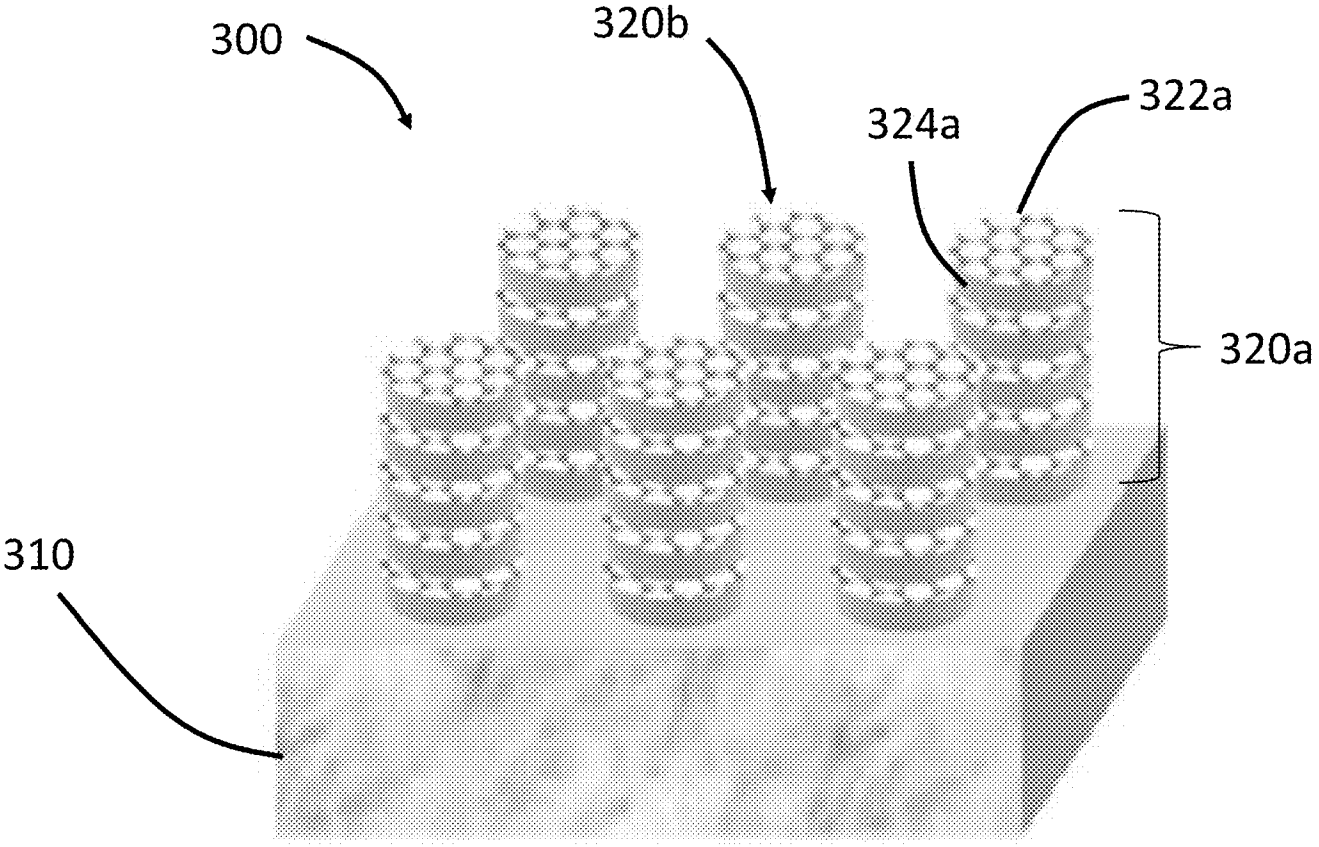
FIG. 3 shows a graphene system having a disk array structure that can be used in the system shown in FIGS. 1A-1C.

FIG. 3 shows a graphene system 300 in a disk array structure. The graphene 300 includes a plurality of disk stacks 320*a* and 320*b* (collectively referred to as disk stacks 320) disposed on a substrate 310. Each disk stack 320 includes alternating graphene layers 322*a* and insulator layers 322*b*. The absorption of the graphene system 300 can be tuned by tailoring the size of the disks d, their separation a, and the chemical doping in each graphene layer 322*a*.

Figure 4B:
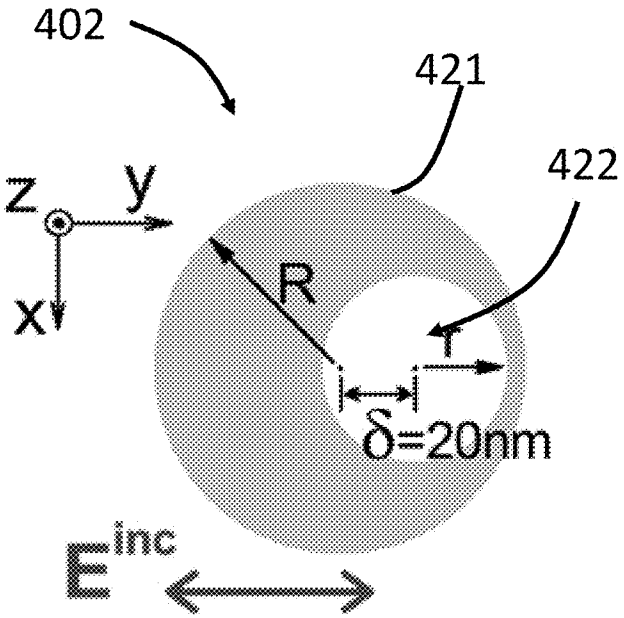
FIGS. 4A-4B show graphene systems having ring structures that can be used in the system shown in FIGS. 1A-1C.
Figure 4A:
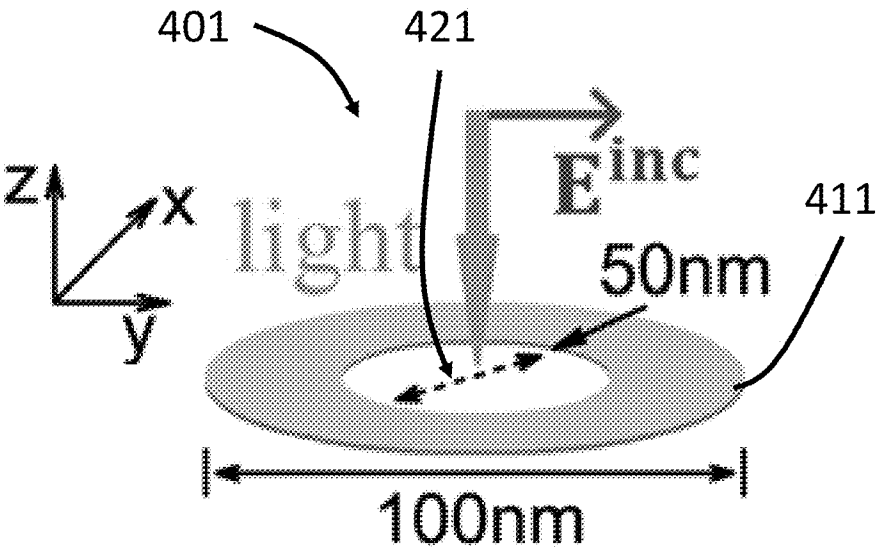

FIGS. 4A-4B show schematics of graphene systems in ring structures. FIG. 4A shows a graphene system 401 having a concentric ring structure. The graphene system 401 includes a graphene ring 411 defining a cavity 421 that is concentric to the graphene ring 411. FIG. 4B shows a graphene system 402 having a non-concentric ring structure, in which a graphene ring 421 is not concentric to a cavity 422 defined by the graphene ring 421. This non-concentric ring structure can be easier to fabricate in practice. Plasmonic resonances of the concentric graphene system 401 and the non-concentric graphene system 402 can be tuned by changing the size of the rings.

Patterning graphene can also help reduce losses of SPP. Generally, plasmonics can suffer from limited propagation distances (also referred to as localization) due to short plasmon lifetimes. As an initial matter, the approach illustrated in FIGS. 1A-1C is different from that in other applications. In most other applications, the graphene SPPs are generated in a point with the intention that they propagate along the graphene sheet. This kind of highly localized excitation of the SPPs can be very challenging. In the approach illustrated in FIGS. 1A-1C, a simple grating can be used for the excitation of the graphene SPPs across the entire graphene. Therefore, there is no single localized point where the SPPs are generated. Instead, the graphene SPPs are coupled to the entire graphene sheet (or at least a large area of the graphene sheet) at once. As a result, the losses of the SPPs can be significantly reduced. Alternatively, the described approaches can even work in a regime that otherwise has high losses. The issue of losses can be a bottleneck in measurements of graphene SPPs propagation, because the graphene SPP modes are themselves the carriers of information. In approaches described here, the SPPs modulate the electron. Reduction of plasmon losses also allows the use of plasmons having large squeezing factors (e.g., greater than 500).

Patterning the graphene can generate and couple GPs simultaneously along the entire graphene surface (e.g., through the standing wave in nano-ribbon configurations shown in FIG. 2), thereby overcoming the localization of plasmons. In addition, the limitations of plasmon losses do not pose a problem in the approach illustrated in FIGS. 1A-1C for an additional reason. The extremely confined nature of graphene plasmons allows for efficient electron-plasmon interaction over very small distances. For example, several GP periods can be squeezed over a distance of 100 nanometers, which can be sufficient to create a plasmon wiggler.

The properties of GPs can be dynamically changed by electrostatic tuning of the graphene Fermi energy. The tuning of GP properties can in turn change the frequency of the output photons, therefore allowing a dynamically tunable radiation source. In addition, graphene can also be chemically doped as known in the art to further increase the dynamic range of doping. Approaches described here can use electrostatic doping, chemical doping, or both.

Figure 5:
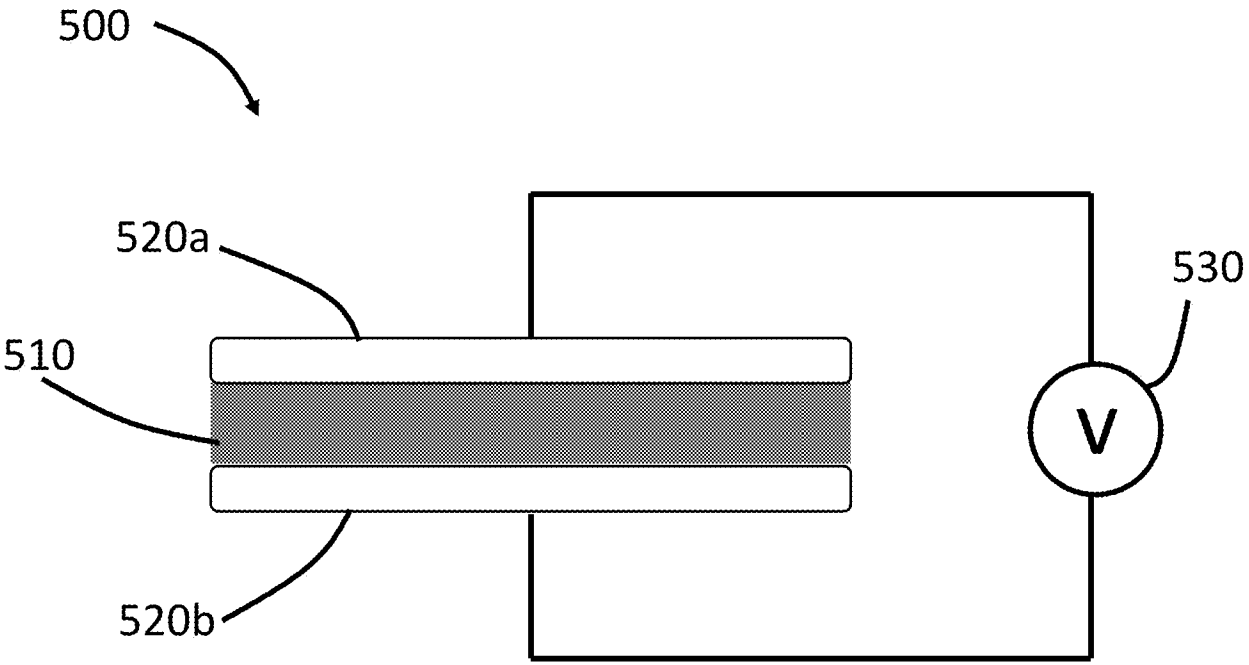
FIG. 5 shows a schematic of a system for electrostatic tuning of the Fermi energy of graphene.

FIG. 5 shows a schematic of system for electrostatic tuning of graphene. The system 500 includes a graphene layer 510 sandwiched between two electrodes 520*a* and 520*b*, which are further connected to a voltage source 530. In addition a dielectric layer (not shown in FIG. 5) can be disposed between each electrode (520*a* or 520*b*) and the graphene layer 510 to, for example, protect the graphene from direct contact with the electrodes 520*a/b*. The doping of the graphene 510 can be dynamically adjusted by changing the output voltage of the voltage source 530 and therefore the electric field across the graphene layer 510. Electrostatic doping can change the carrier density (electrons or holes) of graphene without implanting any external particles (also referred to as dopants) into the graphene. In contrast, chemical doping usually changes the carrier density of graphene by implanting dopants (e.g., boron or nitrogen) into the graphene.

Figure 6A:
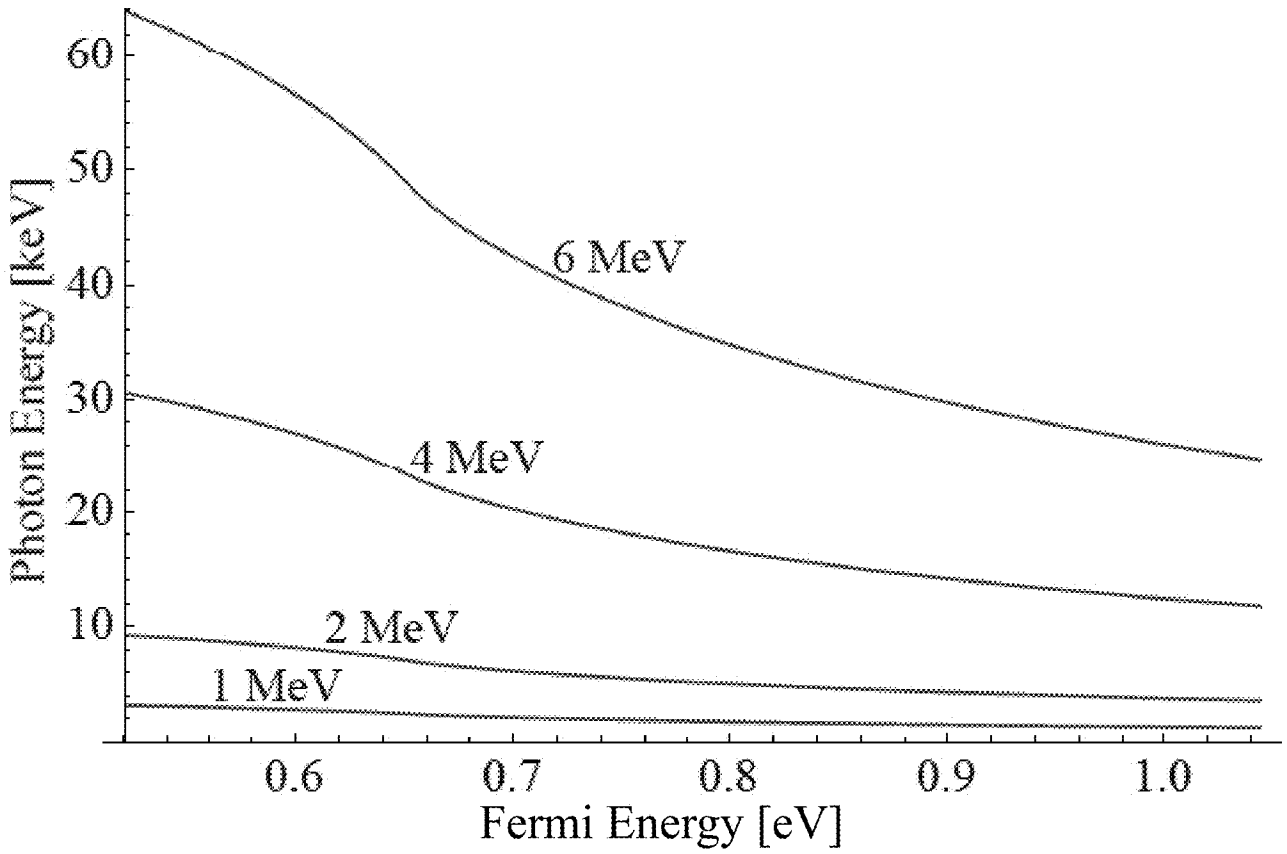
FIGS. 6A-6C show photon energies that can be achieved by tuning the graphene Fermi energy and the electron kinetic energy when the graphene plasmon is at a free space wavelength of 1.5 μm.
Figure 6B:
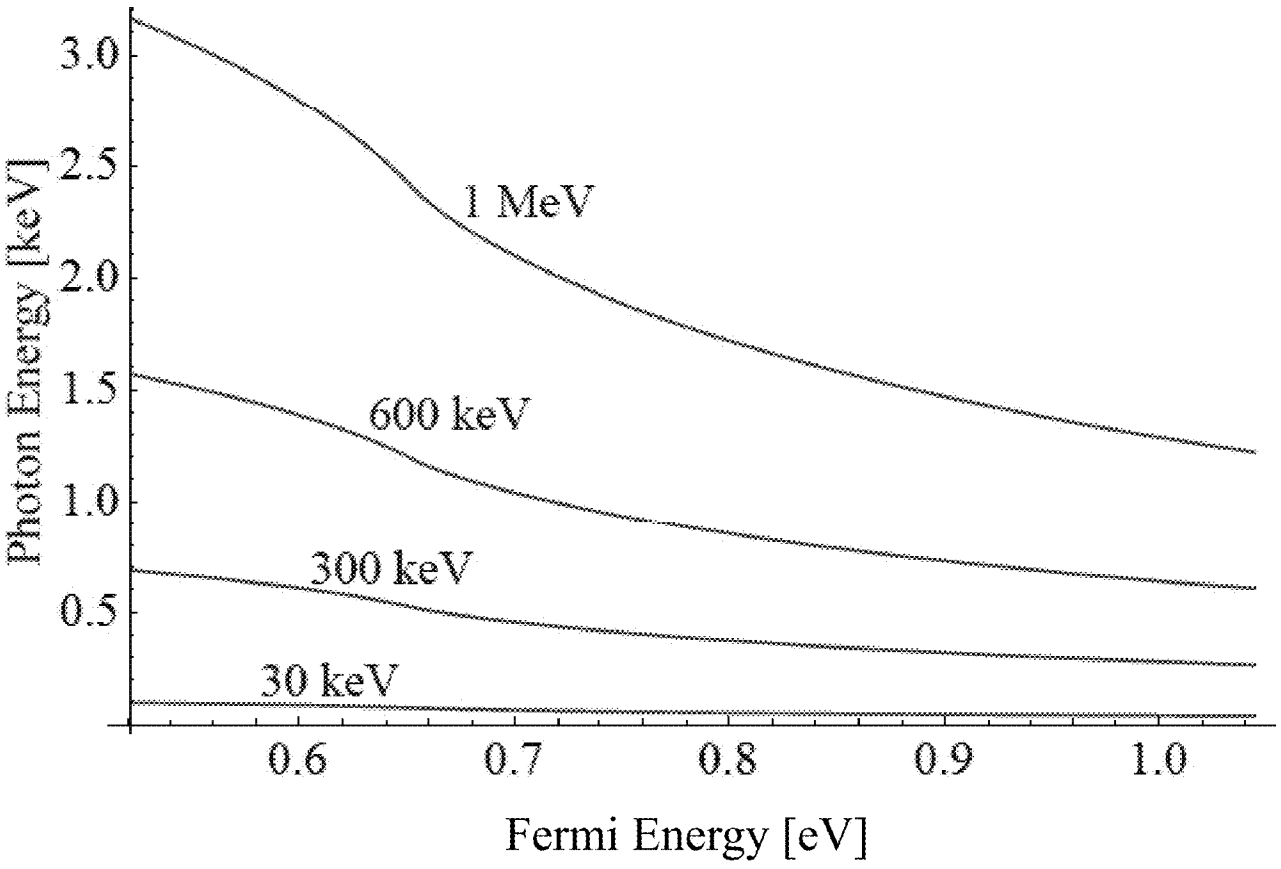
Figure 6C:
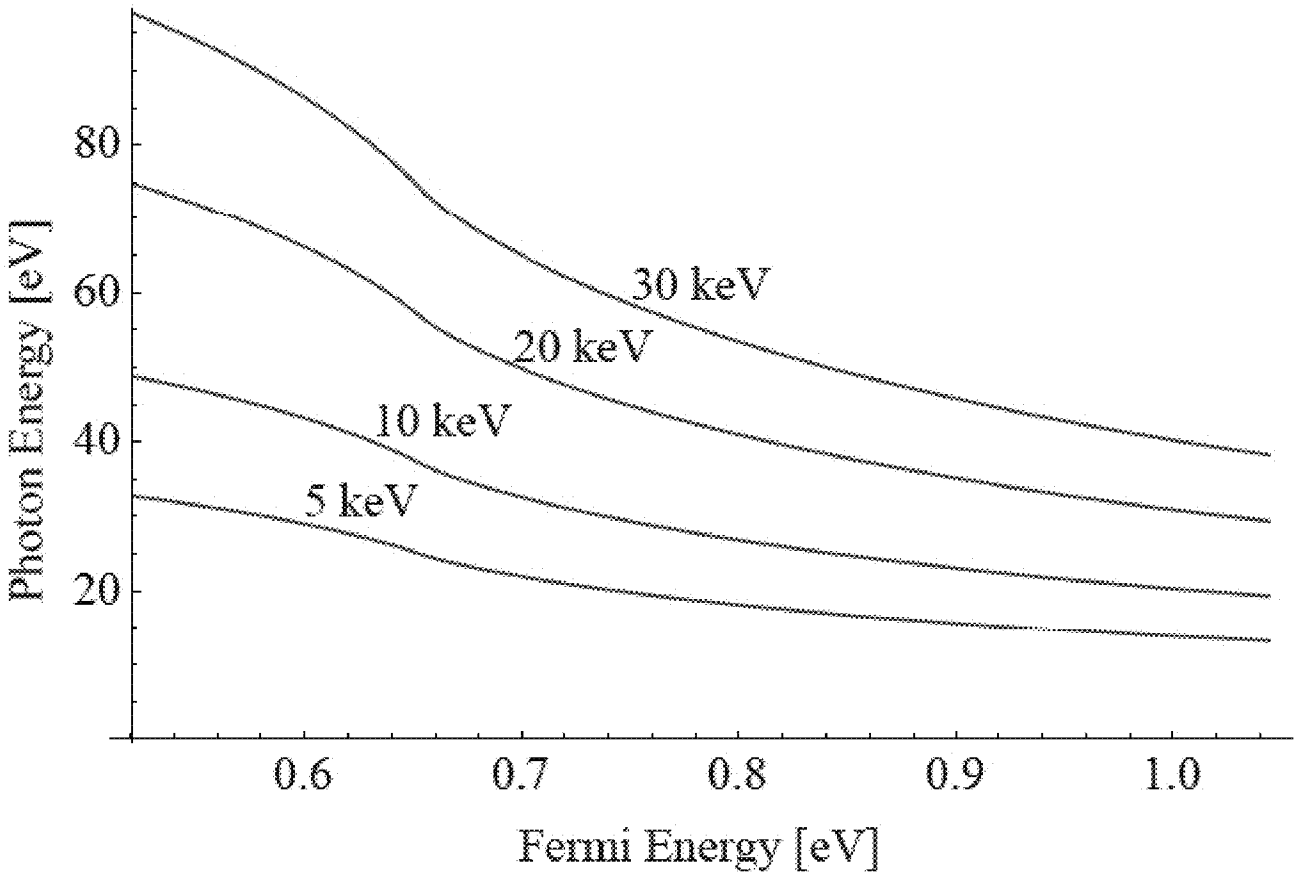

FIGS. 6A-6C show the range of photon energies that can be achieved by tuning the graphene Fermi energy and the electron kinetic energy, when a free space wavelength of 1.5 μm is used for the graphene plasmon. More specifically, FIG. 6A shows output photon energies when the incident electron energy is about 1 MeV to about 6 MeV. FIG. 6B shows output photon energies when the incident electron energy is about 30 KeV to about 1 MeV. FIG. 6C shows output photon energies when the incident electron energy is about 5 KeV to about 30 KeV.

FIGS. 6A-6C show that for a given electron energy, the range of Fermi energies permits the tuning of the output radiation frequency by as much as 100%. For example, the output photon energy can be varies from 30 keV to over 60 keV by tuning the Fermi energy from 0.5 eV to 0.9 eV (when 6 MeV electrons are used). This wide tunability range is also seen at much lower electron energies, for example, at 30 keV that is available in transmission electron microscopy (TEM) devices. These electrons can produce UV photons from about 50 eV to about 100 eV in the same Fermi energy range of 0.5-0.9 eV.

The above description uses graphene as the 2D conductive layer 110 shown in FIGS. 1A-1C for illustrating and non-limiting purposes only. In practice, other 2D systems or even 3D systems can also be used to generate the SPP field for radiation generation. In one example, metal plasmonic systems also allow the same applications show in FIGS. 1A-1C. The squeezing factor of metal plasmonic systems may be smaller compared to graphene plasmonics, but is still sufficient in several applications. For example, electron beams from scanning electron microscopes can have electron energy on the order to about 20 KeV and can already cause significant frequency up-conversion of infrared beams to soft x-ray regimes.

In another example, the 2D conductive layer 110 can include 2D metal layers (e.g., single-atom layers of metal materials such as silver), which can also support SPPs of very high squeezing factor due to the electrons behaving like a 2D electron gas. For example, a single-atom-thick silver can have higher conductivity than graphene while still having very low losses in the optical regime. 2D silver therefore can support visible SPPs that can provide higher frequencies (shorter wavelengths) to start with.

In yet another example, double-layer graphene sheets can be used as the 2D conductive layer 110. Double layer graphene sheets, which include two single-atom carbon layers coupled together via van der Waals force, can have enhanced conductivity and high squeezing factors. Similar properties can also be found in other multi-layer materials such as gold, silver, and other materials with properties similar to graphene. These multi-layered structures can have their bounded electrons interacting between layers, creating properties that are generalizations of the 2D electron gas behavior of single-atom layers, such as high squeezing factor.

In yet another example, the 2D conductive layer 110 can include general 2D electron gas (2DEG) systems, which can exist without single-atom layers or few-atom layers. Instead, the physics of 2DEG systems can appear at the interface between bulk materials, such as in MOFSET structures. These interfaces therefore can also be used in the approaches described herein.

The length of the 2D conductive layer 110 in the direction of the electron motion can be just a few microns and still produce high quality radiation. This means that the structure does not have to include any space for the electron beam to move through—the penetration depth of the electrons is longer than the structure size anyway—so the structure can be solid and the electrons can just be sent directly through it.

The last point can be useful since it constitutes an advantage of the current approaches over conventional methods. Most electron beam-based radiation sources require electrons to travel a long distance inside a structure, e.g., to have many undulator periods. Since the electrons can pass through solid matter only to a limited distance, conventional methods typically use a vacuum channel for the electrons to pass through. This makes the sources more complicated since it requires a control over the beam spread (itself a very challenging problem). In contrast, approaches described herein only involve electron beam propagation within a small length of the sample (several microns is already enough). This can make the control over the e-beam spread much easier, and even not necessary at all in some cases. Furthermore, the distance of several microns can be even shorter than the mean-free-path of relativistic electrons in solids. The implication is that the current approach can work without any special control of the electron beam.

Several advantages can be derived from above discussion, including: (a) one does not need to worry that the electron-beam will destroy the sample (the energies are relatively small); (b) the exact alignment of the beam and the sample are less crucial; and (c) one can build a sandwich structure or multilayer structure by stacking many layers (dielectric-graphene-dielectric-graphene- . . . ). The structures can also be cascaded to extend the interaction length (only limited by the mean-free-path, which causes a gradual decrease in the beam velocity due to collisions).

Other alternative geometries are also possible, such as a sandwich structure with or without a substrate between two graphene sheets, or a stack of multiple graphene sheets with a dielectric substrate in between.

Electron Sources and Electron Beams

The electron source 130 in FIGS. 1A-1C is configured to provide the electron beam 135 that can emit the output radiation 102 via interaction with the SPP field 101. Therefore, the properties of the electrons beam 135, including electron energy, beam cross sections, and beam modes (continuous or pulsed), can directly affect the output radiation 102.

Figure 7A:
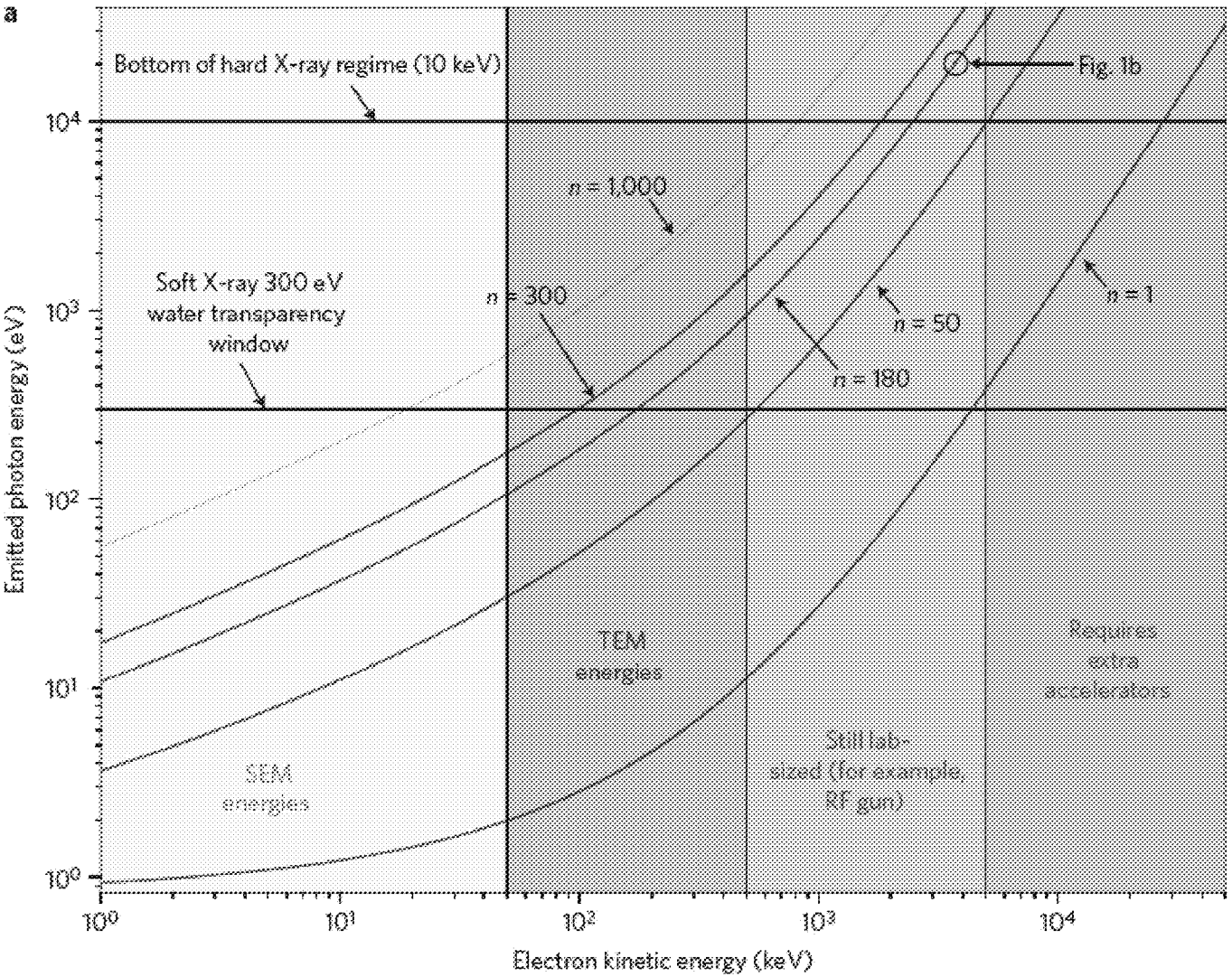
FIGS. 7A-7B show frequency conversion regimes that can be achieved using the approach shown in FIGS. 1A-1C.
Figure 7B:
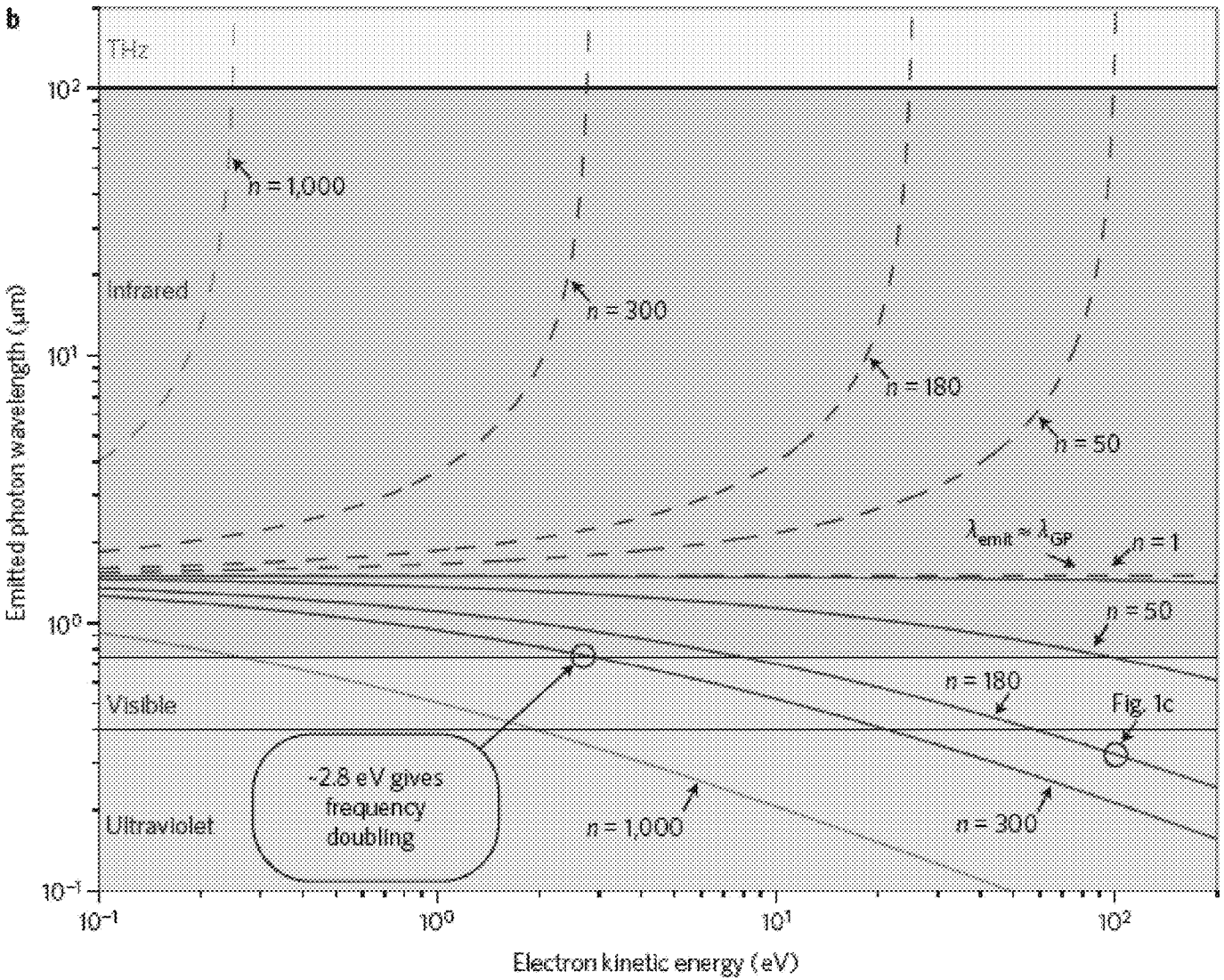

The electron energy of the electron beam 135 can affect the output frequency through Equation (1). FIGS. 7A-7B show different frequency conversion regimes that can be achieved by the GP-based free-electron radiation sources shown in FIGS. 1A-1C. Lines corresponding to confinement factors n=50, 180, 300 and 1,000 are shown in each diagram (n=1 is also shown for reference).

FIG. 7A shows that non-relativistic electrons available from a common scanning electron microscope (SEM)—the leftmost regime—are already sufficient for hard ultraviolet and soft X-ray generation. Semi-relativistic electrons, such as those used in transmission electron microscopes (TEMs), allow the generation of soft X-rays from infrared GPs (for example, 340 eV photons from 200 keV electrons). The next regime of electron energies—modestly relativistic electrons achievable in radio frequency (RF) guns—is sufficient to generate hard X-rays, circumventing the need for additional sophisticated acceleration stages, which are necessary to produce the highly relativistic electrons (rightmost regime) usually required in most free-electron-based X-ray generation schemes. For example, 4 keV X-ray photons are attainable with 5 MeV electron beams using far-infrared ($\lambda_{air}$=10 μm) GPs with a confinement factor of n=150.

FIG. 7B shows the frequency conversion regime using non-relativistic electron energies. Frequency-doubling can be attainable with few-electron-volt electrons (for example, 2.8 eV when n=300). Several tens of volts can allow a much higher up-conversion, which can convert infrared plasmons to visible or ultraviolet wavelengths. FIG. 7B also presents the possibility of frequency down-conversion.

As described above, using SPP near 2D conductive layers can significantly reduce the electron acceleration to generate short wavelength radiation, compared to conventional free electron laser or undulators. The reduced electron energy can be readily accessible via various technologies. Examples of electron sources 130 that can provide the electron beam 135 for short-wavelength generation are described below.

The frequency conversion regimes shown in FIGS. 7A-7B can be further extended. Generation of X-ray from graphene SPPs in the UV range just tens of KeV electrons can be based on similar framework described herein. Unique graphene SPPs can exist in the UV frequency range even without doping of the graphene (i.e. using intrinsic graphene, also referred to as undoped graphene). The same theoretical framework developed herein also shows that gamma-ray photons can be emitted by graphene SPPs when placed in accelerators producing electron with energies of hundreds of MeV to tens of Ge V. As before, one can reach radiation of much higher energy with the same electron beam energy, or get the same emitted photon frequency by using less energetic electron beams.

Figure 8:
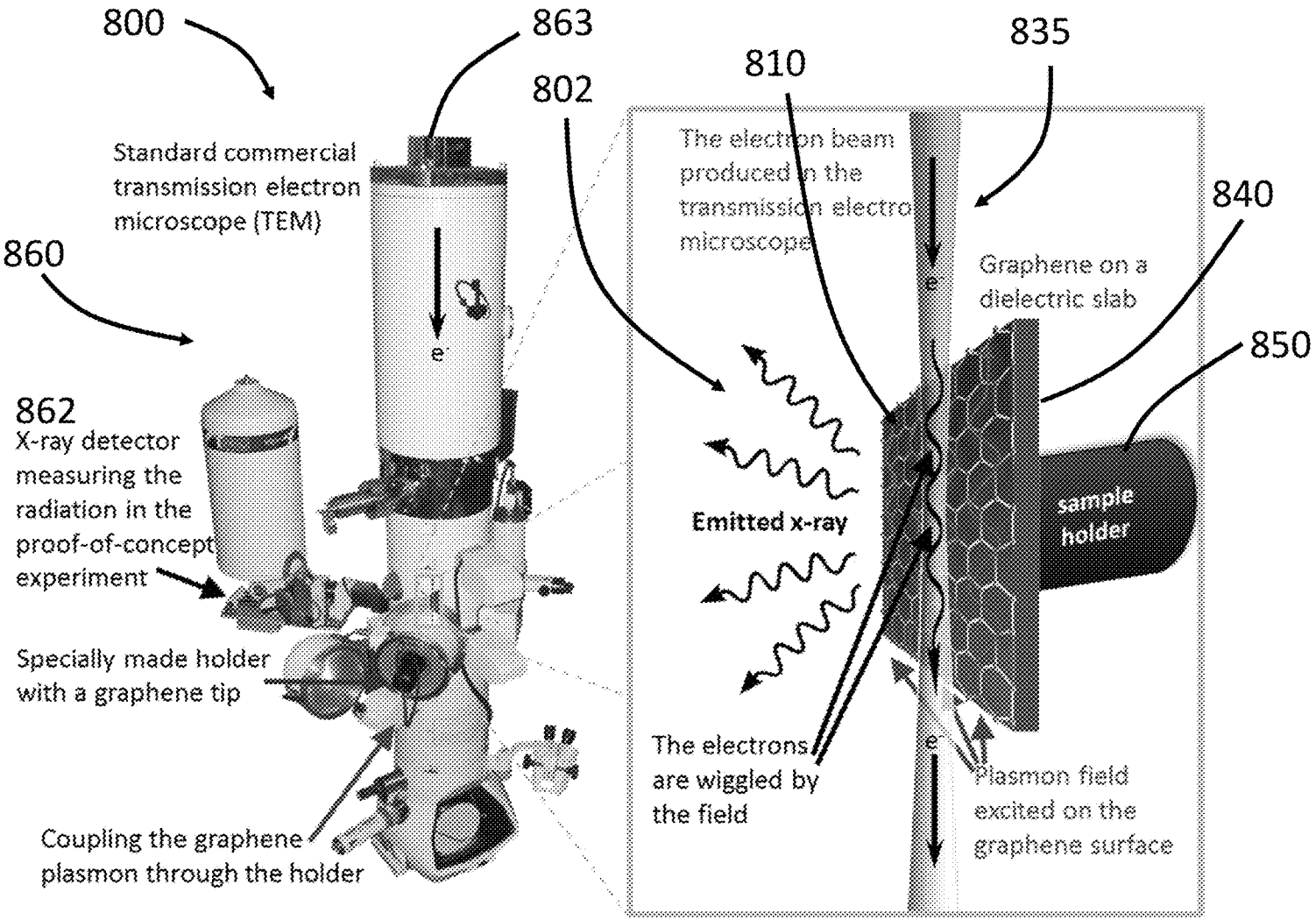
FIG. 8 shows a schematic of a graphene-plasmon-based radiation source using a transmission electron microscope (TEM) as the electron source.

FIG. 8 shows a schematic of a graphene-plasmon-based radiation source using a transmission electron microscope (TEM) as the electron source. The system 800 includes a TEM device 860 with a built-in electron source 863 and X-ray detector 862. An arrow in FIG. 8 indicates the place where a sample-holder 850 is inserted to support a dielectric slab 840 on which a graphene layer 810 is disposed. The built-in electron source 863 provides an electron beam 835 that propagates near the surface of the graphene 810 so as to interact with SPP fields created by, for example, a laser beam (not shown in FIG. 8). The electron-SPP interaction can generate X-rays (or radiation at other wavelengths depending on, among other things, the electron energy) that are emitted within a wide angle.

In regular use of a TEM, the sample to be imaged is suspended by the sample-holder 850 in the path of an electron-beam 835 that moves downward along the microscope cylindrical column. Therefore, a graphene sample-holder can be constructed to mount the graphene layer 810 on the dielectric slab 840 such that the graphene layer 810 is positioned precisely near the path of the electron beam 810.

In one example, the graphene sample holder can have fibers and electrical feed-throughs directed through the sample holder to give external control of the properties of the graphene layer 810 (e.g., the Fermi level), and to couple the electromagnetic field through it into the SPP mode on the surface of the graphene layer 810. In another example, other methods such as chemical doping for doping graphene without an external applied voltage can be used, therefore simplifying the holder by removing the electric feed-through. In either case, the graphene sample holder device, when put into the path of the electron beam 835, can create the interaction illustrated in the right panel of FIG. 8, where the electrons are wiggled by the SPP field, causing them to emit X-ray radiation.

TEMs can provide electron beams of high quality (e.g., small divergence and high velocity) so as to achieve better-than angstrom scale ($10^{-10}$ m) resolution. This high quality electron beam 835, when used in in the system 800, can also benefit the generation of X-rays. In general, electron beams delivered by TEMs can have electron velocity of about 0.5 to about 0.8 of the speed of light (i.e., about 0.5 c to about 0.8 c), corresponding to electron energy of about 100 KeV to about 1 MeV. According to previous discussion, these electron energies are sufficient to generate X-rays using the system 800. In one example, the TEM 860 can provide electrons beams of about 200 to about 300 KeV. The SPP field created near the graphene layer 810 can be about 1000. Laser beams at a photon energy of about 2 eV (i.e., about 620 nm) can be used to excite the SPP field near the graphene layer 810. With these parameters, X-ray radiation of 10 KeV, already in the hard-x-ray regime, can be readily obtained, even without any additional modifications of the TEM 860.

Using TEMs as the electron source for X-ray generation based on electron-SPP interaction can have several benefits. First, TEMs are state-of-the-art instruments including a built-in electron-gun, a vacuum system, and a built-in X-ray detector that can be used to monitor the properties of the generated X-ray 802 and provide feedback control if desired. TEMs generally also have a high-quality beam control and a simple usage scheme. Second, TEMs are normally of lab size and reasonably priced (about $1M). Making small modifications (about $200K) that transform a part of this system into a coherent X-ray source would be a true revolution in X-ray sources. In particular, a TEM—unlike the very large, billion-dollar accelerator facilities—can be operated in hospitals, and in many places it already is.

The system 800 shown in FIG. 8 can be modified in several ways to improve the generation of X-rays or other radiations. In one example, the graphene layer 810 can include more than one layer of graphene. Due to high level of confinement of graphene SPPs, stacking several layers of graphene-covered dielectric substrates can essentially multiply the system size to increase the output intensity. Accordingly, the electrons beam 835 can also include multiple electron beams, each of which propagates through the space defined by a pair of graphene-covered dielectric substrates.

In another example, the graphene layer 810 can have a length that is sufficiently long for the electrons to rearrange themselves into coherent bunches via self-amplified spontaneous emission. The length of the graphene can dependent on, for example, the current of the electron pulse and the intensity of the optical pulse that excites the SPP field. In one example, the length of the graphene can be greater than 1 μm. In another example, the length of the graphene can be greater than 5 μm. In yet another example, the length of the graphene can be greater than 10 μm. As described above, since the SPP fields are generated and coupled simultaneously over the entire graphene, potential losses due to propagation of SPP can be neglected.

In yet another example, the electron beam 835 can include pre-bunched electrons, i.e., a sequence of electron bunches, similar to laser beams in pulsed mode. In this case, the laser beams that are used to excite the SPP field 810 can also operate in pulsed mode and can be synchronized with the electron bunches. In other words, each pulse in the sequence of laser pulses can be synchronized with one electron bunch in the sequence of electron bunches. Since pulsed laser beam can have a higher intensity compared to continuous wave (CW) beams, the resulting SPP can also be stronger, therefore allowing more efficient generation of X-rays.

In addition, each bunch of electrons in the sequence of electron bunches can be micro-bunched (i.e. periodic or modulated within an electron bunch). In one example, each electron bunch in the sequence can have a micro-bunch period on the order of attoseconds, i.e. micro-bunches are separated by attoseconds within each electron bunch. This micro-bunch can help generate coherent emission from the electron-SPP interaction. In another example, the micro-bunch period can be substantially equal to one oscillation cycle of the emitted radiation. For example, the emitted radiation can be about 5 nm, which has oscillation cycles of about 1.5 attoseconds. In this case, the time interval between micro-bunches with one electron bunch can also be about 1.5 attoseconds.

In yet another example, the electron beam 835 can have a flat sheet configuration. In other words, the cross section of the electron beam 835 can have an elliptical shape, or even a nearly rectangular shape. The flat sheet of electrons can be substantially parallel to the graphene layer 810 when propagating through the SPP field. This flattened shape of the electron beam 835 can better match the planar shape of the SPP field above the graphene layer 810, thereby increasing the number of electrons that can interact with the SPP field and accordingly the output energy of the output radiation 820.

In yet another example, the graphene layer 810 can be doped to prevent or reduce potential damage to the graphene layer 810. Doping the graphene layer 810 can create static charges on the graphene layer 810 and therefore repel the approaching electrons from the electron beam 835. In fact, potential damage to the graphene layer 810 should not be an issue in the approaches described here, because the electron energy is relatively low, compared to those in conventional FELs and undulators, and further because graphene have characteristically strong structures. In addition, the high conductivity of graphene can allow for quick dissipation of accumulated charge.

In yet another example, dielectric materials having a large refractive index can be used to make the dielectric slab 840 that supports the graphene layer 810. In general, a larger refractive index can result in a more confined SPP field (i.e., shorter wavelength or larger squeezing factor) near the graphene surface. In practice, example materials that can be used include, but are not limited to, silicon, silicon oxide, tantalum oxide, niobium oxide, diamond, hafnium oxide, titanium oxide, aluminum oxide, and boron nitride.

Other than TEM, scanning electron microscopes (SEM) can also be used as the electron source for GP-based radiation source. SEMs are normally less expensive than the TEMs and are easier to modify and control. In general, SEMs can generally provide electron beams having electron energy on the order of about 20 KeV. Due to the strong field confinement in graphene SPP (i.e. higher n), radiation in the soft-X-ray regime can be achieved. Soft-X-rays, such as those in the water window between 2.3 nm and 4.4 nm, can have useful applications in imaging live biological samples.

In addition, electron guns in old CRT television sets can also provide electrons having energy in the KeV range, therefore allowing the development of very cost-effective soft-X-ray source. For example, a 4 KeV acceleration, which is accessible in standard small office desk items (e.g. plasma globes) can be sufficient to create 300 eV radiation, which is a soft-X-ray that falls in the water window.

Figure 9:
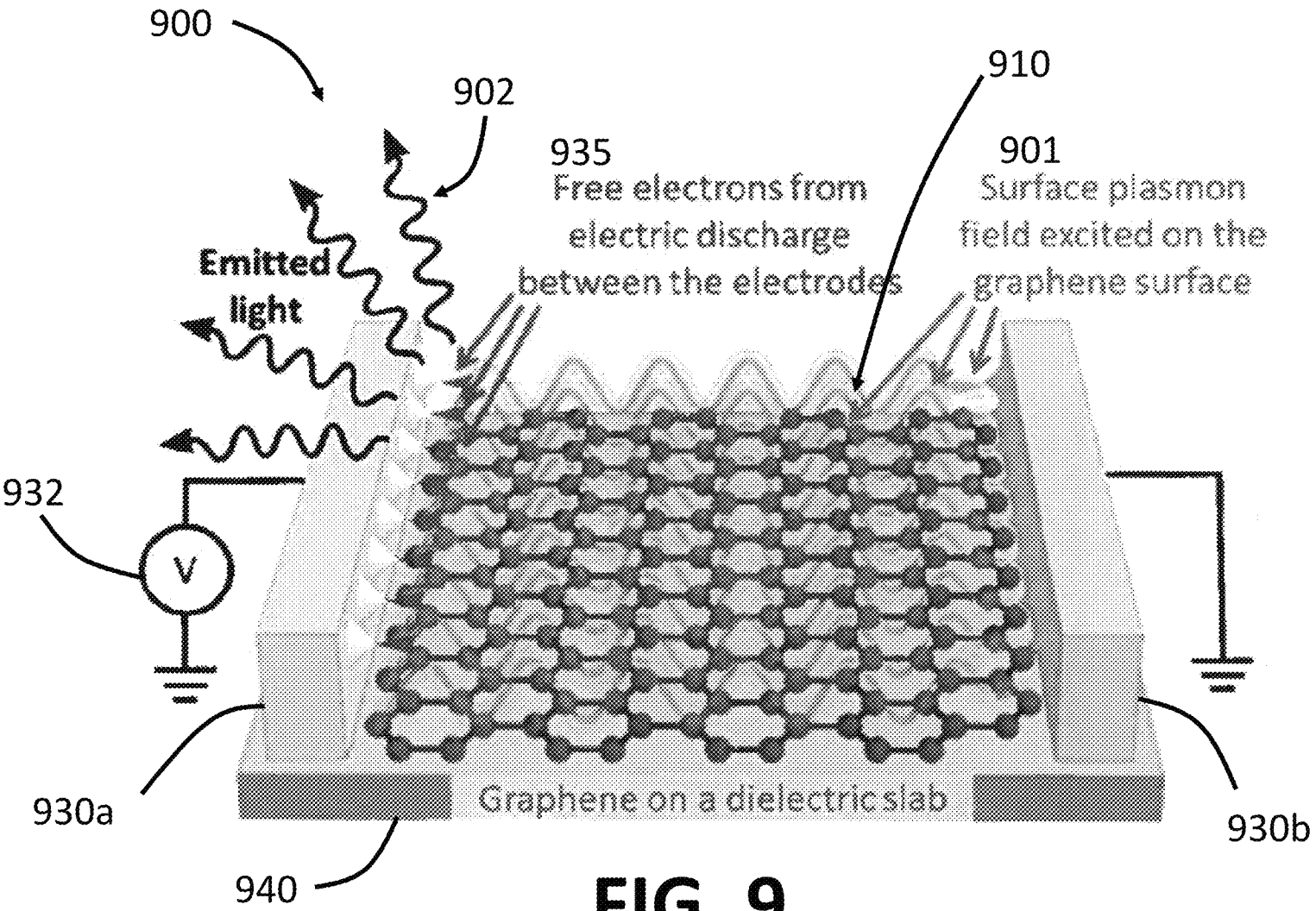
FIG. 9 shows a schematic of a graphene-plasmon-based radiation source using direct voltage discharge as the electron source.

FIG. 9 shows a schematic of a GP-based radiation source using discharge as the electron source. The radiation source 900 includes a graphene layer 910 disposed on a substrate 940. A pair of electrodes 930*a* and 930*b* (collectively referred to as electrodes 930) is disposed on the two ends of the graphene layer 910 and is further connected to a voltage source 932. By applying a voltage across the electrodes 930, electrons 935 can be generated via discharge (e.g., at the surface of the electrodes 930). These electrons 935 propagate in and interact with a SPP field 901 near the surface of the graphene layer 910 and/or within the graphene layer 910 so as to generate output emission 920. Depending on the voltage applied across the electrodes 930, the wavelength of the output emission 920 can span from infrared to ultraviolet (UV). The approach illustrated in FIG. 9 is CMOS compatible, thereby allowing large-scale fabrication and widespread use.

Generally, the voltage applied across the electrodes 930 is on the order to tens of volt. Therefore, the electros 935 are non-relativistic. In this case, the following equation for the up conversion from the incoming photon frequency (used to excite the graphene SPP) to the emitted radiation frequency applies:

$$E_{out}=E_{in}(1+n\beta)/(1-n\beta) \tag{2}$$

where n is the graphene SPP "squeezing factor" as above, and β is the normalized electron velocity, which is the velocity divided by the speed of light. Equation (2) reduces to Equation (1) when $\beta \rightarrow 1$, which is the relativistic limit. Although Equation (2) only describes the frequency relation along the axis of the electron beam, a more general equation can be derived in the exact same way.

Figure 10:
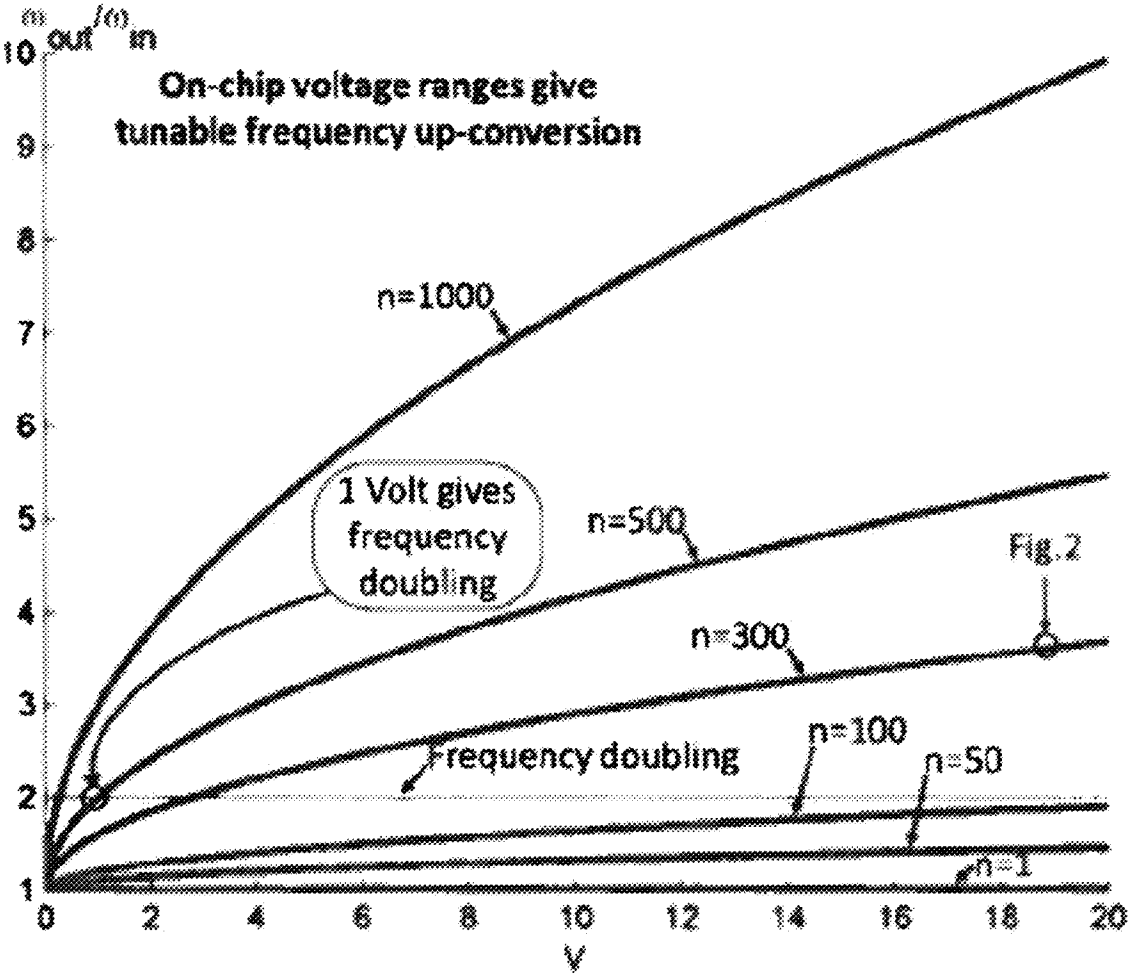
FIG. 10 shows output frequencies as a function of discharge voltage in the system shown in FIG. 9.

The output frequency of the radiation source 900 can be tunable by changing the voltage and accordingly the electron energy, i.e., β in Equation (2). FIG. 10 shows regimes of frequency up-conversion using low voltage electrons that can be applied in an on-chip configuration (e.g., the system 900 shown in FIG. 9). Several values of the squeezing factor n, including 50, 100, 300, 500, 1000, and also n=1 for comparison, are used to show possible frequency conversion. Specific examples show that frequency doubling is already reachable with a few volts (e.g., with n of 500). A couple of tens of volts can allow a much higher up-conversion, which can convert an IR plasmon to the UV range.

The approach illustrated in FIG. 9 is different from conventional methods of radiation generation using graphene. Conventional methods use graphene as a photonic crystal which interacts directly with electrons to generate radiation, for example, in THz ranges. The approaches described herein uses graphene to generate the SPP field that modulates the electrons to generate radiation. In other words, the electrons generally do not interact with the graphene itself. This difference can be further illustrated by looking into the fundamental physical processes governing the interactions: conventional methods are based on the Cerenkov Effect while approaches described herein are based on the Compton Effect.

This difference can induce implications in several aspects. In one aspect, the emission from the radiation source shown in FIG. 9 can be much more tunable, compared to conventional methods, since external control over the electron beam energy and the SPP frequency can be readily available. The Cerenkov-based ideas normally only have control over the electron beam energy, while a change of the photonic modes frequency requires replacing the entire structure.

In another aspect, the frequency conversion efficiency of approaches described herein can depend on the strength of the SPP field, which can be controlled externally and can be brought to a high level (e.g., 1 GV/m or even higher for short pulses). The efficiency of the Cerenkov-based approaches depends on the structure interaction with the electron beam, which is much weaker and cannot be externally control.

In yet another aspect, the emission of light 902 in approaches described herein is created by the electrons and is radiating out of the structure right away, i.e., there may be no structure-based losses involved. The radiation in the Cerenkov-based approaches is from the structure electromagnetic modes. Therefore, structure losses can reduce the intensity of the radiation. Furthermore, much of the emission power might be lost in conventional methods unless perfect coupling of this power to the outside is achieved.

In yet another aspect, the emission 902 in the system 900 can be substantially monochromatic because the SPP can be controlled to be monochromatic via optical excitation using laser beams. On the other hand, Cerenkov-based ideas are usually broadband. Even though a specially designed structure can partly improve the monochromatic quality of the emission, the performance can still be far away from substantially monochromatic.

In yet another aspect, the approaches shown in FIG. 9 can reach a broader range of radiation frequencies (although at each frequency the emission can be substantially monochromatic), including ultraviolet. Currently the alternative methods cannot reach UV at all. Cerenkov-based graphene ideas usually only reach IR, and the photonic crystal methods can reach visible light but then require much higher voltages on the order to tens of KeV, which can be impractical for on-chip operations.

The electron source 130 shown in FIGS. 1A-1C can also use laser-based acceleration for providing the electron beam 135. Configurations of laser-based electron acceleration include, but are not limited to, grating accelerator, Bragg and omni-guide accelerator, 2D photonic band-gap (PBG) accelerator, and 3D PBG woodpile accelerator, among others. More information of laser-based electron sources can be found in Joel England, et al., Dielectric Laser Accelerators, *Reviews of Modern Physics,* 86, 1337 (2014), which is incorporated herein in its entirety.

GP-Based Radiation Sources Using Multiple Graphene Layers

Figure 11A:
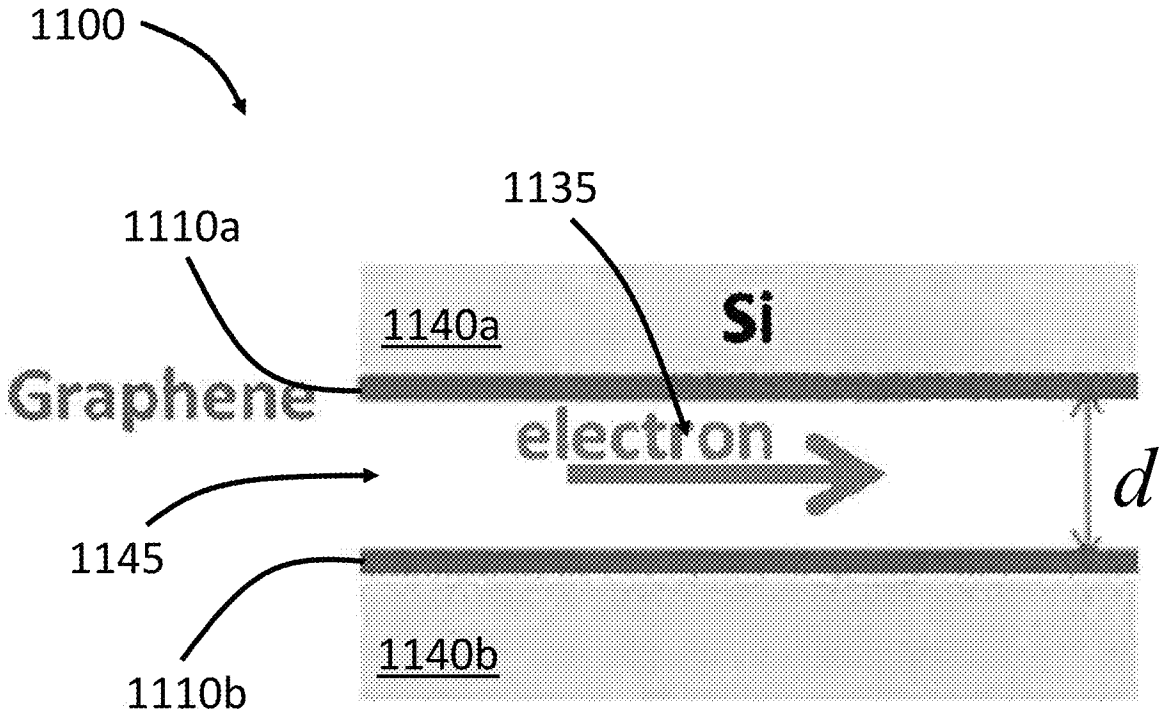
FIG. 11A shows the schematic of a radiation source using two graphene layers disposed on a dielectric substrate.

FIG. 11A shows a radiation source 1100 that uses two graphene layers 1110*a* and 1110*b* (collectively referred to as graphene layers 1110), each of which is disposed on a respective dielectric substrate 1140*a* and 1140*b*. The graphene layers 1110 are disposed against each other to create a cavity 1145, in which SPP fields created from the graphene layers 110 can interact with an electron beam 1135. In one example, the cavity 1145 is filled with solid dielectric materials (e.g., silicon, silicon oxide, silicon nitride, tantalum oxide, niobium oxide, diamond, hafnium oxide, titanium oxide, aluminum oxide, or boron nitride). In another example, the cavity 1145 is simply filled with air. In yet another example, the cavity 1145 is vacuum. The distance d between the two graphene layers 110 can be less than 100 nm (e.g., less than 90 nm, less than 50 nm, less than 20 nm, less than 10 nm, or less than 5 nm) so as to allow strong interaction between the SPP fields and the electron beam 1135. Since two graphene layers 1110*a* and 1110*b* are used, the electron beam 1135 can interact with two SPP fields. Therefore, the configuration shown in FIG. 11A can increase the output energy of the resulting radiation.

Dielectric material in the cavity 1145 would not prevent operation of the radiation source 1100 because the electron beam 1135 can generally penetrate through a few tens of microns of dielectric with almost no energy loss (and even much more if the electron beam is more energetic). Several microns of propagation can be sufficient to generate an X-ray that is substantially monochromatic (spectral width on the order of a few eV).

Figure 11B:
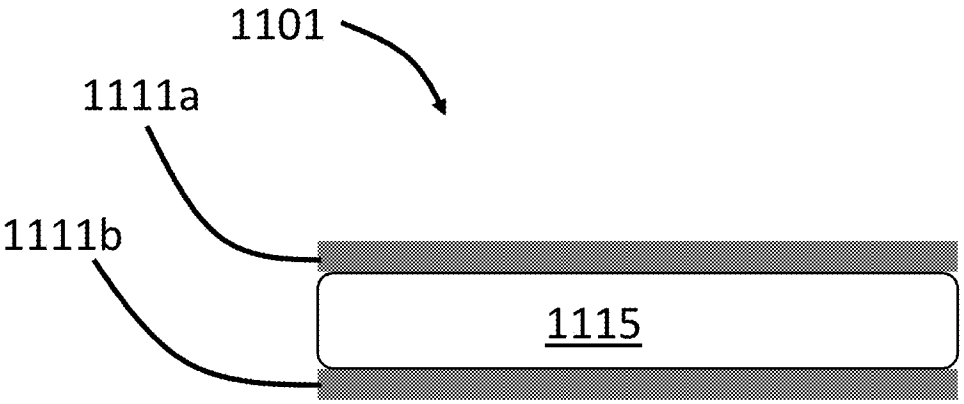
FIG. 11B shows the schematic of a radiation source using two graphene layers disposed on two dielectric substrates.

FIG. 11B shows a radiation source 1101, which uses two graphene layers in a sandwich configuration. The radiation source includes a dielectric layer 1115 sandwiched by two graphene layers 1111*a* and 1111*b*. Alternatively, the dielectric layer 1115 can be replaced by air or vacuum. The advantage of this sandwich structure includes that the effective index n of the SPPs will then grow by a factor of almost 2, due to the high index of the dielectric layer 1115. In practice, the radiation source 1101 can be grown on a layer-by-layer basis. In addition, a multi-layered structure can also be constructed. The multi-layered structure can include alternating layers of graphene and dielectric material, i.e. dielectric-graphene-dielectric-graphene-dielectric.

Figure 11C:
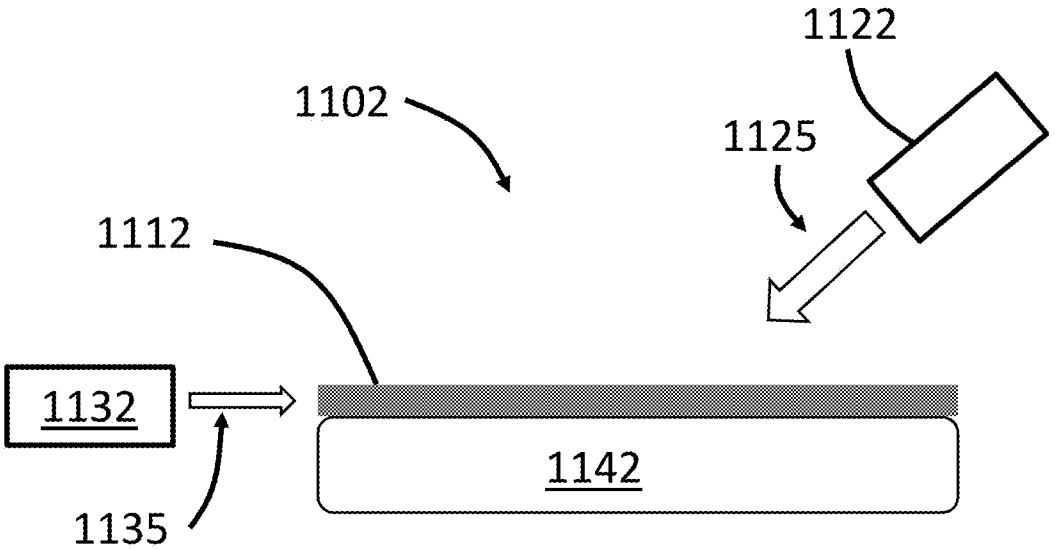
FIG. 11C shows the schematic of a radiation source when electrons are propagating within a graphene layer.

FIG. 11C shows a radiation source 1102 in which a graphene layer 1112 is disposed on a dielectric substrate 1142. An electron beam 1135 is delivered by an electron source 1132 into the graphene layer 1112 so as to interact with any SPP field within the graphene layer 1112. An electromagnetic wave (EM) source 1122 is configured to couple an EM wave 1125 into the graphene layer 1112 to excite the SPP field. This approach can be helpful in constructing on-chip devices, at least because the electrons are moving inside the graphene layer 1112 and electron beam control can be simpler (e.g., without vacuum chamber).

Figure 12:
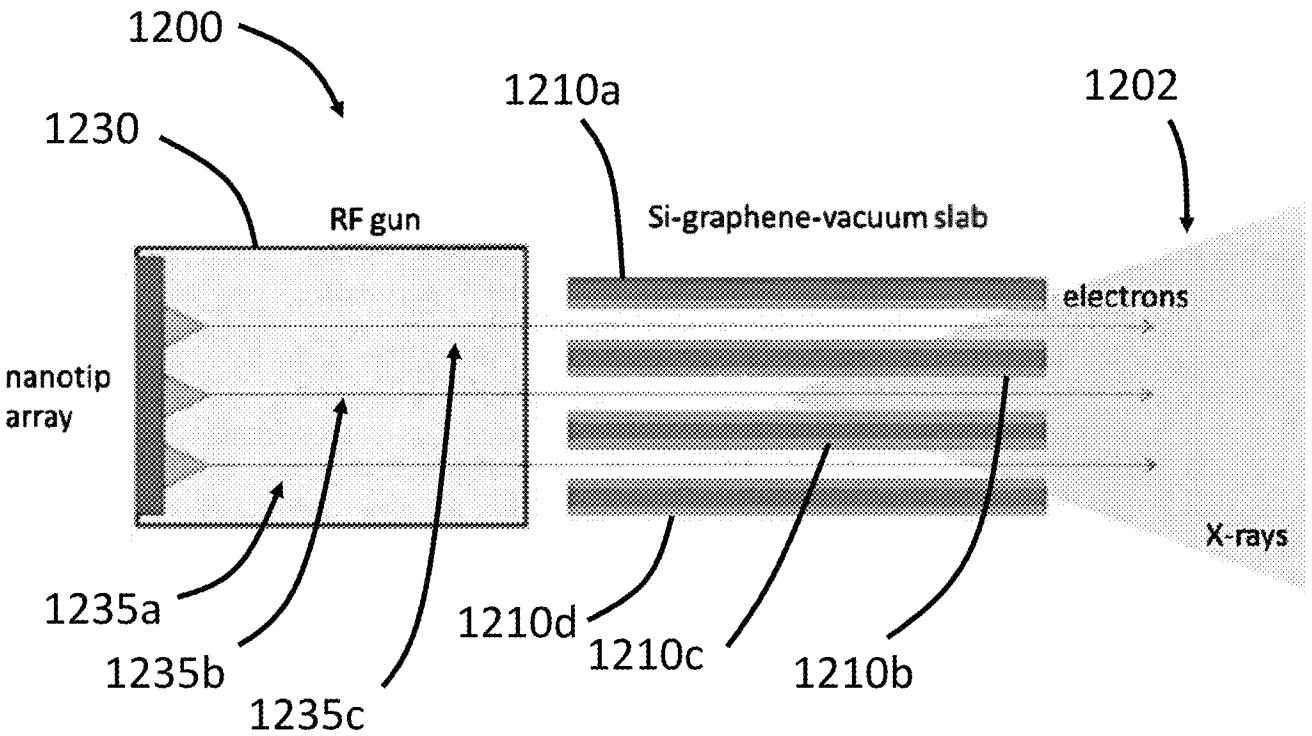
FIG. 12 shows a schematic of a radiation source using multiple electrons beams and multiple graphene layers.

FIG. 12 shows a schematic of a radiation source using multiple electron beams and multiple graphene layers. More specifically, the radiation source 1200 includes a plurality of graphene-substrate assemblies 1210*a*, 1210*b*, 1210*c*, and 1210*d*, collectively referred to as graphene-substrate assemblies 1210. Each of the two edge assemblies 1210*a* and 1210*d* includes a graphene layer disposed on the respective substrate, while each of the two central assemblies 1210*b* and 1210*c* includes two graphene layers disposed on both sides of the respective substrate. The space defined by each pair of graphene-substrate assembly allows the passage of electron beams provided by an electron source 1230. The electron source 1230 is configured to deliver three electron beams 1235*a*, 1235*b*, and 1235*c*, which are aligned with the space defined by the graphene-substrate assemblies 1210. This configuration can increase the total amount of electrons that can interact with SPP fields and therefore increase the total output energy of the emission 1202.

Figure 13:
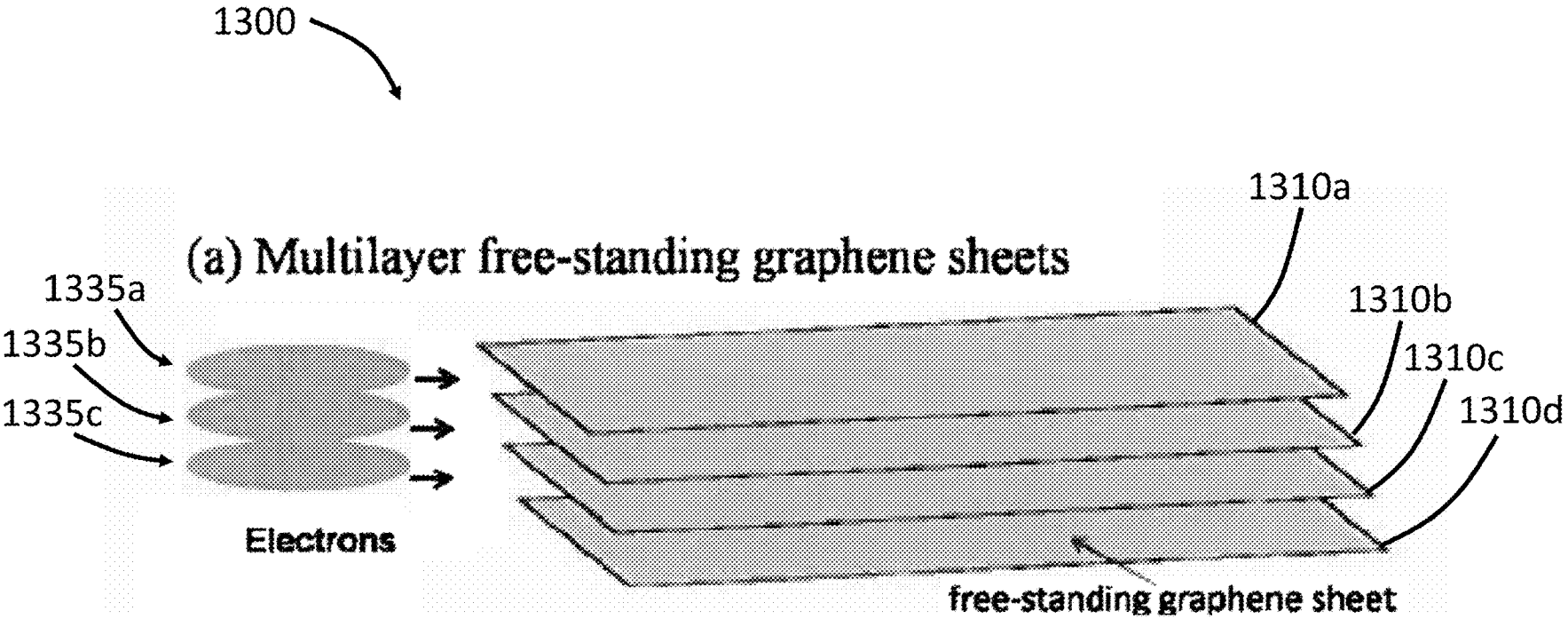
FIG. 13 shows a schematic of a radiation source using parallel free-standing graphene layers.

FIG. 13 shows a schematic of a radiation source using multiple free-standing graphene layers. The radiation source 1300 includes multiple graphene layers 1310*a*, 1310*b*, 1310*c*, and 1310*d* separated by air or vacuum. Due to the high mechanical strength of graphene, free standing layers of graphene can be constructed as shown in FIG. 13. Three electron beams 1335*a*, 1335*b*, and 1335*c* propagate in the space defined by the multiple graphene layers 1310*a* to 1310*d* and interact with SPP fields in the space to create output radiation.

Figure 14:
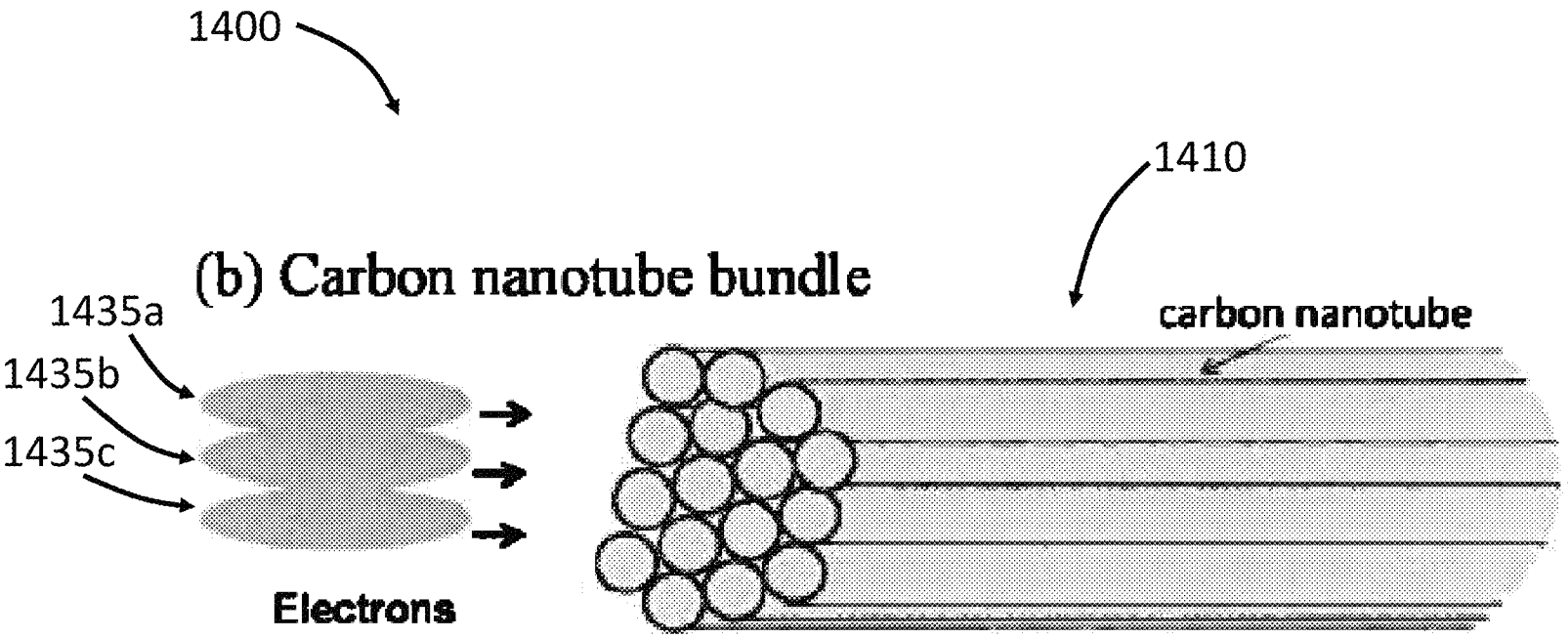
FIG. 14 shows a schematic of a radiation source using a bundle of graphene nanotubes.

FIG. 14 shows a schematic of a radiation source using a bundle of graphene nanotubes. The radiation source includes a nanotube bundle 1410. Each nanotube in the nanotube bundle 1410 can be made by rolling a planar graphene layer. A plurality of electron beams 1435*a*, 1435*b*, and 1435*c* are sent to the nanotube bundle 1410 for interacting with SPP fields within the nanotubes. In one example, the diameter of the electron beams 1435*a* to 1435*c* can be greater than that of the nanotubes in the nanotube bundle 1410. In this case, each electron beam can propagate in more than one nanotube and precise alignment may not be necessary. In another example, each electron beam can have a diameter smaller than that of the nanotubes. In this case, each electron beam can be aligned to propagate through a respect nanotube in the nanotube bundle 1410 so as to increase the interaction efficiency.

The two schemes shown in FIGS. 13-14 can have the advantage that the ratio of graphene (being a single-layer structure) to vacuum in the transverse cross-section is very small. Therefore, practically all of the electrons can propagate in vacuum (instead of colliding with a non-vacuum structure).

In one example, the systems shown in FIGS. 11-14 use graphene of single-atom thickness. In another example, bilayer or multi-layered graphene can also be used. It is worth noting that multi-layer graphene is different from the structure discussed in the previous paragraphs with reference to FIGS. 11-13. Multiple layers of graphene sheets (e.g., shown in FIG. 11B) with dielectric separations of at least a couple of nanometers are physically coupled by the dielectric material between individual layers of graphene. Multi-layer graphene referred to in this paragraph have the quantum properties of the bound electrons directly coupled via, for example, molecular forces.

The substrate material or the dielectric material separating multiple graphene layers can also affect the performance of the resulting radiation sources. Silica and silicon can be used in all examples shown in FIGS. 11-14, but the radiations sources herein can use any dielectric, including oxides such as silica but also metal-oxides (some of them have higher n, such as tantala and niobia). Also, boron-nitride (commonly used as a graphene substrate to get very-flat, high-purity samples) can also work. Some of these substrates can make the "squeezing factor" much larger due to their high refractive index.

Analytical and Numerical Analysis of GP-Based Radiation

This section describes analytical and numerical analysis that can explain the underlying physics behind the radiation generation presented above. The analysis can offer an excellent description of both the frequency and the intensity of the radiation. The interaction between an electron and a GP can be analytically studied from a first-principles calculation of conservation laws, solving for the elastic collision of an electron of rest mass m and velocity v (normalized velocity $\beta=v/c$, Lorentz factor $\gamma=(1-\beta^2)^{-1/2}$) and a plasmon of energy $\hbar\omega_0$ and momentum $n\hbar\omega_0/c$. Their relative angle of interaction is $\theta_i$, measured from the direction of the electron velocity. The output photon departing at angle $\theta_f$ has energy $\hbar\omega_{ph}$ and momentum $\hbar\omega_{ph}/c$, where $\omega_{ph}$ is given by:

$$\omega_{ph} = \omega_0 \frac{1 - n\beta\cos\theta_1 - \frac{\hbar\omega_0}{\gamma mc^2}\frac{(n^2-1)}{2}}{1 - \beta\cos\theta_f + \frac{\hbar\omega_0}{\gamma mc^2}[1 - n\cos(\theta_f - \theta_1)]} \approx \omega_0 \frac{1 - n\beta\cos\theta_1}{1 - \beta\cos\theta_f} \tag{3}$$

The approximate equality, which neglects the effects of quantum recoil, can hold whenever $\gamma mc^2 \gg n\hbar\omega_0$. In the case of n=1, Equation (3) can reduce to the formula for Thomson/Compton scattering, involving the relativistic Doppler shift of the radiation due to the interaction of an electron with a photon in free space.

A separate derivation based on classical electrodynamics corroborates the results of the above treatment. The detailed analysis is presented below.

Properties of Graphene Plasmons

This section describes analytical expressions for the dispersion relations and the fields of electromagnetic modes sustained by a layer of graphene sandwiched between two layers of dielectric (one of them being free space in the main text). Consider a three-layer system in which Layer 1 extends from $x=-\infty$ to $x=0$, Layer 2 from $x=0$ to $x=d$ and Layer 3 from $x=d$ to $x=+\infty$, with $\varepsilon_1$, $\varepsilon_2$, and $\varepsilon_3$ being the respective permittivities of each layer. By solving Maxwell's equations and matching boundary conditions in the standard fashion, the transverse-magnetic (TM) dispersion relation can be written as:

$$\tan(K_2 d) = -i\frac{\frac{\varepsilon_1}{K_1} + \frac{\varepsilon_3}{K_3}}{\frac{\varepsilon_2}{K_2} + \frac{\varepsilon_1 K_2 \varepsilon_3}{K_1 \varepsilon_2 K_3}} \tag{4}$$

where $K_j=(q^2-\omega^2\varepsilon_j\mu_0)^{1/2}$, j=1, 2, 3, $\omega$ is the angular frequency, $q=n\omega/c$ the complex propagation constant, and $\mu_0$ is the permeability of free space, which can also be taken as the permeability of the materials. Layer 2 is also used to model a monoatomic graphene layer of surface conductivity $\sigma_s$ with Layer 2, by setting $\varepsilon_2=i\sigma_s/(\omega d)$ and taking $d\to 0$, to obtain the dispersion relation:

$$1 = i\frac{\omega}{\sigma_s}\left(\frac{\varepsilon_1}{K_1} + \frac{\varepsilon_3}{K_3}\right) \tag{5}$$

which, in general, can be solved numerically for q, since $\sigma_s$ can have a complicated dependence on both the frequency and the wave-vector.

The surface conductivity $\sigma_s$ can be obtained within the random phase approximation (RPA). When the wave-vector is small enough that plasmon damping due to electron-hole excitations is not significant, a semi-classical approach that generalizes the Drude model can be used. Taking into consideration inter-band transitions derived from the Fermi golden rule, the conductivity can be written as:

$$\sigma_s = \frac{e^2}{\hbar^2\pi}\left\{\frac{iE_f}{\omega + i\tau^{-1}} + \frac{\hbar\pi}{4}\left[\theta(\hbar\omega - 2E_f) - \frac{i}{\pi}\ln\left|\frac{2E_f + \hbar\omega}{2E_f - \hbar\omega}\right|\right]\right\} \tag{6}$$

where the low-temperature/high-doping limit (i.e., $E_f \gg kT$) is assumed. The first term in the above expression is the Drude conductivity, the most commonly used model for graphene conductivity to describe GPs at low frequencies. The second term captures the contribution of inter-band transitions. In the above expression, e is the electron charge, $E_f$ is the Fermi energy, $n_s$ is the surface carrier density, $v_f$ is the Fermi velocity, and $\tau$ is the relaxation time that takes into account mechanisms like photon scattering and electron-electron scattering. The spatial confinement factor, defined as $n=cRe(q)/\omega$ represents the degree of spatial confinement that results from the plasmon-polariton coupling.

In the limit of a large confinement factor (i.e., $q^2 \gg \omega^2 \varepsilon_j \mu_0$), the dispersion relation Equation (5) can be well approximated by:

$$q \approx i\frac{\omega(\varepsilon_1+\varepsilon_3)}{\sigma_s} \tag{7}$$

which shows that the propagation constant, and hence the confinement factor, can be enhanced by the presence of a dielectric layer above or below the graphene. In the electrostatic limit, inter-band transitions may be ignored.

An analytical expression for the plasmon group velocity may be derived from Equation (5) by first differentiating the propagation constant to obtain:

$$\left(\frac{\partial q}{\partial \omega}\right)^{-1} = \frac{q\left(\frac{\varepsilon_1}{K_1^3}+\frac{\varepsilon_3}{K_3^3}\right)}{\frac{i\sigma_s}{\omega}\left(\frac{1}{\sigma_s}\frac{\partial \sigma_s}{\partial \omega}-\frac{1}{\omega}\right)+\omega\mu_0\left(\frac{\varepsilon_1^2}{K_1^3}+\frac{\varepsilon_3^2}{K_3^3}\right)+\left(\frac{1}{K_1}\frac{\partial \varepsilon_1}{\partial \omega}+\frac{1}{K_3}\frac{\partial \varepsilon_3}{\partial \omega}\right)} \tag{8}$$

and then evaluating the above equation at $\omega=\omega_0$, where $\omega_0$ is the plasmon frequency. When the confinement factor is large, and losses are negligible so that surface conductivity $\sigma_s = i\sigma_{si}$, the group velocity of a GP may be approximated by the analytical expression:

$$v_g \approx \frac{c}{\left(1-\frac{\omega_0}{\sigma_{si}}\frac{\partial \sigma_{si}}{\partial \omega}\right)\frac{c(\varepsilon_1+\varepsilon_3)}{\sigma_{si}}+\frac{\sigma_{si}}{\varepsilon_0 c}\frac{\varepsilon_1^2+\varepsilon_3^2}{(\varepsilon_1+\varepsilon_3)^2}+\frac{\omega_0 c}{\sigma_{si}}\left(\frac{\partial \varepsilon_1}{\partial \omega}+\frac{\partial \varepsilon_3}{\partial \omega}\right)} \tag{9}$$

where all variables are evaluated at $\omega=\omega_0$. The contribution of the substrate's material dispersion—captured by the third term in the denominator—can be ignored when:

$$\omega_0\left(\frac{\partial \varepsilon_1}{\partial \omega}+\frac{\partial \varepsilon_3}{\partial \omega}\right) \ll \varepsilon_1+\varepsilon_3 \tag{10}$$

This is a condition that can be obtained by comparing the first and third terms in the denominator of Equation (9). In one example, the graphene can have $SiO_2$ as a substrate and free space on the other side, and the a free space wavelength of 1.5 μm can be used. $SiO_2$ has a chromatic dispersion $d(\varepsilon/\varepsilon_0)^{1/2}/d\lambda = -0.011783\ \mu m^{-1}$. The equation may be rearranged to give $\omega_0 d\varepsilon/d\omega = 0.051\varepsilon_0 \ll \varepsilon_{1,2}$, which satisfies Equation (10).

Equation (9) may be simplified even further in the case of large confinement factors, for which one usually has $\sigma_{si} \ll \varepsilon_0 c \sim 1/120\pi$, allowing the second term in the denominator of Equation (10) to be dropped without affecting the accuracy of Equation (10) significantly. In one examples, $E_f = 0.66$ eV and $\varepsilon_{Si} = 1.4446$, giving a confinement factor of n=180 at free space wavelength 1.5 μm. For these parameters, the surface conductivity is found to be $\sigma_s = 8.18\times10^{-9} + i4.56\times10^{-5}$ S, according to the RPA approach.

To summarize, in the limit of large confinement factors and negligible material dispersion of the substrate, the group and phase velocities of a GP may be approximated by the analytical expressions:

$$v_{ph} \approx \frac{\sigma_{si}}{(\varepsilon_1+\varepsilon_3)},\ v_g \approx \left(1-\frac{\omega_0}{\sigma_{si}}\frac{\partial \sigma_{si}}{\partial \omega}\right)^{-1}\frac{\sigma_{si}}{(\varepsilon_1+\varepsilon_3)} \tag{11}$$

where all variables are evaluated at $\omega=\omega_0$. Since the electrostatic limit for the surface conductivity (i.e., the Drude model conductivity) is not assumed, the above expressions also hold for larger plasmon energies.

Electromagnetic Fields of Graphene Plasmons

An electromagnetic solution of the system is in general polychromatic and involves an integral over multiple frequencies subject to the RPA dispersion relation $q=q(\omega)$ obtained above. For a pair of counter-propagating, pulsed TM modes, the electric and magnetic fields in the free space portion x>0 are:

$$\begin{aligned}
E_x &= \mathrm{Re}\Big(\int d\omega \frac{F(\omega)q(\omega)}{iK(\omega)}\exp[-K(\omega)x]\cdot \\
&\qquad \{\exp[i(q(\omega)(z+z_1)-\omega t)]+\exp[i(q(\omega)(z-z_1)+\omega t)]\}\Big) \\
E_z &= -\mathrm{Re}\Big(\int d\omega F(\omega)\exp[-K(\omega)x]\cdot \\
&\qquad \{\exp[i(q(\omega)(z+z_1)-\omega t)]-\exp[i(q(\omega)(z-z_1)+\omega t)]\}\Big) \\
H_y &= \mathrm{Re}\Big(\int d\omega \frac{F(\omega)\omega\varepsilon_0}{iK(\omega)}\exp[-K(\omega)x]\cdot \\
&\qquad \{\exp[i(q(\omega)(z+z_1)-\omega t)]-\exp[i(q(\omega)(z-z_1)+\omega t)]\}\Big)
\end{aligned} \tag{12}$$

where $F(\omega)$ is the complex spectral distribution, $\varepsilon_0$ is the permittivity of free space, $z_i>0$ is the initial pulse position of the backward-propagating pulse, and the frequency dependence of each component is explicitly shown. Subscripts denoting layer have been omitted for convenience. A large confinement factor normally implies a very small group velocity $v_g$ (e.g., $vg=2\times10^5$ m/s for confinement factor n=300 and a substrate of $SiO_2$ of refractive index 1.4446 at free space wavelength 1.5 μm), which can be negligible compared to the speed of free electrons from standard electron microscopes and DC electron guns. Hence, the counter-propagating pulses practically approximate a stationary, standing wave grating.

When the GP pulse duration is large, a simplified form for Equation (12) can be:

$$\begin{aligned}
E_x &= \frac{E_{0s}}{2} \\
&\qquad [\exp(\xi_- - K_{0r}x)\cos(\psi_- - K_{0s}x)+\exp(\xi_+ - K_{0s}x)\cos(\psi_+ - K_{0i}x)] \\
E_z &= -\frac{E_{0s}}{2|q_0|^2}\{\exp(\xi_- - K_{0r}x)\cdot[(-q_{0s}K_{0i}+q_{0i}K_{0r})\cos(\psi_- - K_{0s}x)- \\
&\qquad (q_{0r}K_{0r}+q_{0s}K_{0i})\sin(\psi_- - K_{0i}x)]- \\
&\qquad \exp(\xi_+ - K_{0s}x)\cdot[(q_{0r}K_{0i}+q_{0i}K_{0r})\cos(\psi_+ - K_{0i}x)- \\
&\qquad (q_{0r}K_{0r}+q_{0i}K_{0i})\sin(\psi_+ - K_{0i}x)]\} \\
H_y &= \frac{\omega_0\varepsilon_0 E_{0s}}{2|q_0|^2}\{\exp(\xi_- - K_{0r}x)[q_{0r}\cos(\psi_- - K_{0i}x)+ \\
&\qquad q_{0i}\sin(\psi_- - K_{0i}x)]-\exp(\xi_+ - K_{0r}x) \\
&\qquad [q_{0r}\cos(\psi_+ - K_{0r}x)+q_{0i}\sin(\psi_+ - K_{0i}x)]\}
\end{aligned} \tag{13}$$

where the subscript "0" in K and q denotes the wave-vector at the central frequency $\omega_0$ and $\xi_\pm = -((z\mp z_i)/v_g \pm t)^2/2T_0^2$, $\psi_{\pm}=q_{0k}(z\mp z_i)\pm\omega_0 t+\psi_{0\pm}$, $q_0=q(\omega_0)$, $K_0=K(\omega_0)$ and $E_{0s}$ is the peak electric field amplitude on the graphene sheet. The additional subscripts "r" and "i" on $q_0$ and $K_0$ refer to the associated variable's real and imaginary parts respectively.

The physical meaning of $q_0$ may be understood by considering its real and imaginary parts separately: The real part $q_{0r}$ is related to the plasmon phase velocity through the confinement factor n, giving $v_{ph}=c/n$. The imaginary part $q_{0i}$ is related to the plasmon attenuation. $T_0$ is the pulse duration associated with the number of spatial cycles $N_z$ and temporal cycles $N_t$ in the intensity full-width-half-maximum (FWHM) of the plasmon Gaussian pulse as:

$$T_0 = \frac{N_t}{\omega_0}\frac{\pi}{\sqrt{\ln 2}} = \frac{N_z}{\omega_0}\frac{\pi}{\sqrt{\ln 2}}\frac{v_{ph}}{v_g} \tag{14}$$

Note that $T_0$ can also be related to the spatial extent L by $T_0=L/nv_g$.

Electrodynamics in Graphene Plasmons

This section describes analytical expressions approximating the dynamics of a charged particle (e.g., an electron) interacting with a GP, based on the results from the previous section. The motion of an electron in an electromagnetic field is governed by the Newton-Lorentz equation of motion:

$$\frac{d\overline{p}}{dt} = Q(\overline{E} + \overline{v}\times\overline{B}) \tag{15}$$

where $\vec{p}$ is the momentum of the electron, m is its rest mass, Q=−e is its charge, $\vec{v}$ is its velocity and $\gamma=(1-(v/c)^2)^{-1/2}$ is the Lorentz factor. For the fields described in Equation (12), Equation (15) becomes:

$$\begin{aligned}\frac{d\gamma\beta_x}{dt} &= \frac{Q}{mc}(E_x - v_z B_y)\\ \frac{d\gamma B_y}{dt} &= 0\\ \frac{d\gamma\beta_z}{dt} &= \frac{Q}{mc}(E_z + v_x B_y)\end{aligned} \tag{16}$$

For the purposes of simplifying Equation (16), it can be assumed that: a) transverse velocity modulations are small enough so $\gamma\sim(1-(v_z/c)^2)^{-1/2}$ and $x\sim x_0$ throughout the interaction; b) longitudinal velocity modulations are negligible so $z\sim z_0+v_{z0}t$ and γ is approximately constant throughout the interaction, and c) $q_0=q_{0r}$, which can be made possible by pumping the plasmon along the entire range of interaction; along z (e.g., via a grating). The subscript "0" refers to the respective variables at initial time.

Then Equation (16) may be analytically evaluated to give:

$$\beta_x \approx \frac{QE_0}{mc\omega_0\gamma_0}\left[\frac{1-\beta_{ph}\beta_{z0}}{\beta_{z0}/\beta_{ph}-1}\exp(\xi_{0-})\sin(\omega_t+\psi'_{0-}) + \frac{1+\beta_{ph}\beta_{z0}}{\beta_{z0}/\beta_{ph}+1}\exp(\xi_{0+})\sin(\omega_+ t+\psi'_{0+})\right] \tag{17}$$

$$\beta_z \approx \frac{QE_0}{mc\omega_0\gamma_0^3}\frac{h_{0i}}{q_{0r}}\left[-\frac{\exp(\xi_{0-})}{\beta_{z0}/\beta_{ph}-1}\cos(\omega_t+\psi'_{0-}) + \frac{\exp(\xi_{0+})}{\beta_{z0}/\beta_{ph}-1}\cos(\omega_+ t+\psi'_{0+})\right] + \beta_{z0}$$

-continued $$\omega_{\pm} = \omega_0(1\pm\beta_{z0}/\beta_{ph})$$

$$E_0 = E_{0s}\exp(-K_{0r}x_0)/2$$

$$\xi_{0\pm} = -[(\beta_{z0}/\beta_g \pm 1)t + (z_0\mp z_i)/v_g]^2/2T_0^2$$

$\beta_g=v_g/c$, and $\beta_{ph}=v_{ph}/c$. Note that in the case of a large confinement factor n, the last expression gives $\beta_{ph}=v_{ph}/c\sim 1/n$, resulting in $\omega_{\pm}=\omega_0(1\pm n\,\beta_{z0})$. $\Psi'_{0\pm}$ is used to abstract away the phase constants that do not contribute in our case to the resulting radiation.

The resulting oscillations in x and z are:

$$\delta x \approx \frac{-QE_0}{m\omega_0^2\gamma_0}\left[\frac{1-\beta_{ph}\beta_{z0}}{(\beta_{z0}/\beta_{ph}-1)^2}\exp(\xi_{0-})\cos(\omega_t+\psi'_{0-}) + \frac{1+\beta_{ph}\beta_{z0}}{(\beta_{z0}/\beta_{ph}+1)^2}\exp(\xi_{0+})\cos(\omega_+ t+\psi'_{0+})\right] \tag{18}$$

$$\delta z \approx \frac{QE_0}{m\omega_0^2\gamma_0^3}\frac{h_{0i}}{q_{0r}}\left[-\frac{\exp(\xi_{0-})}{(\beta_{z0}/\beta_{ph}+1)^2}\sin(\omega_t+\psi'_{0-}) + \frac{\exp(\xi_{0+})}{(\beta_{z0}/\beta_{ph}+1)^2}\sin(\omega_+ t+\psi'_{0+})\right]$$

Here δx and δz are the oscillating components of the electron displacements in x and z respectively.

In the above treatment, the assumption of a relatively narrow-band GP allows the neglecting of chromatic changes in group and phase velocity in going from Equations (12) to Equation (13). Propagation losses can also be neglected from Equation (16) to Equation (17). Such approximations are justified when the confinement factor is large, in which case the group velocity tends to be negligible compared to the free electron velocity, so the GP propagates negligibly during the GP-electron interaction and both loss and pulse-broadening can be ignored.

Radiation from GP-Electron Interaction

This section describes analytical expressions approximating the spectral intensity as a function of output photon frequency, polar angle, and azimuthal angle, when an electron interacts with a GP. Although the radiation spectrum for a free electron wiggled by electromagnetic fields in free space was studied before, the analysis here of electron-plasmon scattering generalizes the electron-photon scattering to regimes of n>1 and arbitrary dispersion relations, including those describing surface plasmon polaritons. This approach allows for the study of the previously unexplored regime of extreme electromagnetic field confinement (n>>1). Such high levels of field confinement affect the physics of the problem significantly through implications such as a very high plasmon momentum, a phase and group velocity far below the speed of light, and a ratio of magnetic to electric field that is much smaller than in typical waveguide systems and in vacuum. In addition, the graphene plasmons—contrary to traditional Thomson scattering configurations—have electric fields whose z-components ($E_z$) can be comparable to the x-components ($E_x$) in the vicinity of the electron beam. These factors motivate a new formulation of the scattering problem that in fact applies to physical systems beyond plasmons in graphene, including other surface plasmon polaritons such as those in silver and gold, layered systems of metal-dielectric containing plasmon modes.

The single-sided spectral intensity of the radiation emitted by a charged particle bunch, based on a Fourier transform of radiation fields obtained via the Lienard-Wiechert potentials:

$$\frac{d^2I}{d\omega d\Omega} = \frac{\omega^2}{16\pi^3\varepsilon_0 c}\left|\int_{-\infty}^{\infty}\hat{n}\times\sum_{j=1}^{N}Q_j\bar{\beta}_j\exp[i\omega(t-\hat{n}\cdot\bar{r}_j/c)]dt\right|^2 \tag{19}$$

where $\hat{n}=\hat{x}\cos\phi+\hat{y}\sin\phi+\hat{z}\cos\theta$ is the unit vector pointing in the direction of observation, $\varepsilon_0$ is the permittivity of free space, N is the number of particles in the bunch, and $\vec{r}_j$ is the position of each of the charged particles. A Taylor expansion of the exponential factor gives:

$$\exp[i\omega(t-\hat{n}\cdot\bar{r}_j/c)] \approx \left(1-i\frac{\omega n_x\delta x_j}{c}\right)\left(1-i\frac{\omega n_z\delta z_j}{c}\right)\exp[i\omega(1-\beta_{z0j}n_x)t+\ldots] \tag{20}$$

where the ellipsis in the argument of the exponential abstracts away constant phase terms.

After substituting Equation (18), (17) and (20) into (19) and further simplification, for a single charged particle:

$$\frac{d^2I}{d\omega d\Omega} \approx \frac{Q^4\omega^2E_0^2T_0^2}{32\pi^2\varepsilon_0c^3m^2\omega_0^2\gamma_0^2}[U_+\exp(\varsigma_+)+U_-\exp(\varsigma_-)] \tag{21}$$

$$U_\pm = \left(\frac{\omega_0}{\omega_\pm}\right)^2\left(\frac{\beta_{z0}}{\beta_g}\pm1\right)^{-2}\left\{\left(\frac{\omega^2}{\omega_\pm^2}\beta_{z0}^2\sin^2\theta\cos^2\phi+1\right)\left(1\pm\frac{\beta_{z0}}{n}\right)^2+\left[\frac{h_{0i}^2}{q_{0r}^2\gamma_0^4}-\cos^2\phi\left(1\pm\frac{\beta_{z0}}{n}\right)^2\right]\left(1+\frac{\omega}{\omega_\pm}\beta_{z0}\cos\theta\right)^2\sin^2\theta\right\} \tag{22}$$

$$\varsigma_\pm = -\frac{T_0^2[-\omega_\pm+\omega(1-\beta_{z0}\cos\theta)]^2}{(\beta_{z0}/\beta_g\pm1)^2} \tag{23}$$

Equations (21) to (23) hold when losses are negligible, but make no assumption about the size of the confinement factor besides $n\geq1$. Equations (21)-(23) apply to the interaction between any charged particle and a surface plasmon of arbitrary group and phase velocity, where the transverse velocity oscillations of the particle are small compared to the charged particle's longitudinal velocity component. These results thus apply to physical systems beyond plasmons in graphene, including other surface plasmons such as those in silver and gold, and layered systems of metal-dielectric containing plasmon modes. In addition, although electrons are used as an example, the above results apply to any charged particle when the corresponding values for charge and rest mass are used in Q and m respectively.

For a group of N charged particles of the same species having a distribution W(x,y), a replacement can be made in Equation (21), where it is assumed that the particles radiate in a completely incoherent fashion.

$$E_0^2 \rightarrow NE_{0s}^2\int_0^\infty W(x,y)\exp(-2K_{0r}x)dx \tag{24}$$

Note that the exponential factor in the integrand arises from the exponential decay of the GP fields away from the surface, highlighting the importance of working with flat, low-emittance electron beams traveling as close as possible to the graphene surface. This can be especially important when n is large.

If a uniform random distribution of N charged particles (of the same species) is considered extending from $x=x_1$ to $x=x_2$ ($0<x_1<x_2$), the replacement becomes:

$$E_0^2 \rightarrow \frac{N}{\Delta x}\frac{E_{0s}^2}{4K_{0r}}\frac{\exp(-2K_{0r}x_1)-\exp(-2K_{0r}x_2)}{2} \tag{25}$$

where $\Delta x=x_1-x_2$.

Figures 15D, 15E, 15F:
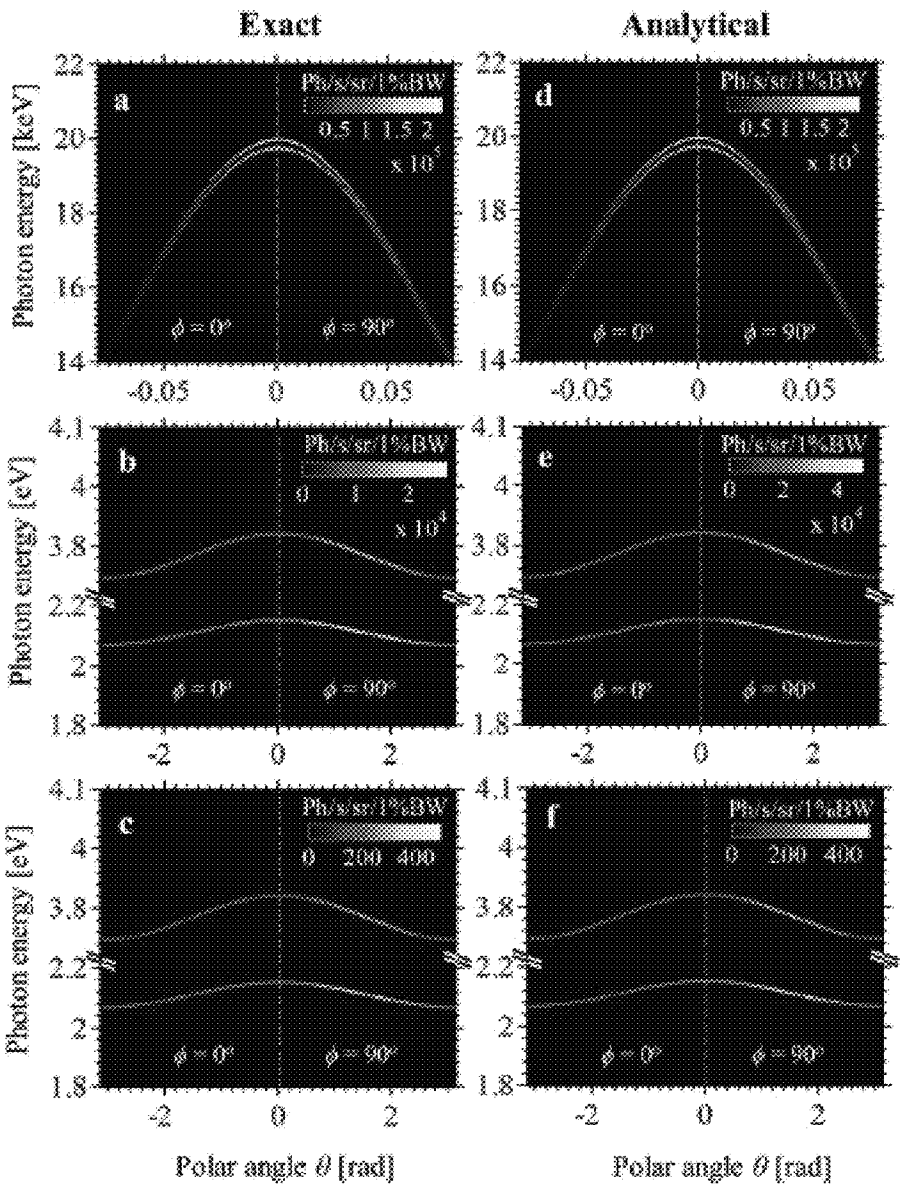

FIGS. 15A-15F compares the results of analytical theory with that of the exact numerical simulation over a range of output angles. More specifically, FIGS. 15A-15C show results from exact numerical simulations, while FIGS. 15D-15F show results of analytical theory. Excellent agreement are achieved in the case of 3.7 MeV (FIGS. 15A and 15D) and in the case of 100 eV (FIGS. 15C and 15F). In these cases, the electromagnetic field intensity is low enough that the electron is not deflected away from the GP by radiation pressure. The interaction in FIG. 15B is prematurely terminated due to electron deflection by the GP radiation pressure, explaining the lower output intensity in FIG. 15B compared to that in FIG. 15E. The spectral shape and bandwidth of the output radiation are not adversely affected by the ponderomotive deflection.

Owing to the high field enhancement of the GPs, fields on the order of several GV/m can be achievable from conventional continuous-wave (CW) lasers of several Watts, or pulsed lasers in the pJ-nJ range. Ultra-short laser pulses may allow access to even larger electric field strengths, thereby further enhancing output intensity. The use of pulses can benefit from synchronizing the arrival of the photon pulse with that of the electron pulse.

Assuming that the incident radiation excites a standing wave comprising counter-propagating GP modes—one of which co-propagates with the electrons—the output peak frequency as a function of device parameters and output angle θ is:

$$\omega_{ph_\pm} = \frac{\omega_\pm}{1-\beta\cos\theta} \tag{26}$$

where $\omega_\pm=\omega_0(1\pm n\beta)$ and $\omega_0$ is the central angular frequency of the driving laser. In Equation (26), $\omega_{ph+}$ is due to electron interaction with the counter-propagating GP, whereas $\omega_{ph-}$ is due to interaction with the co-propagating GP. Note that the rightmost expression in Equation (1) reduces to $\omega_{ph+}$ ($\omega_{ph-}$) when $\theta_i=\pi$ ($\theta_i=0$).

The spectrum of the emitted radiation as a function of its frequency ω, azimuthal angle φ and polar angle θ, making the assumption of high confinement factors n>>1 to achieve a completely analytical result:

$$\frac{d^2I}{d\omega d\Omega} \approx \int dxdyW(x,y)\frac{Q^4E_{0s}^2\exp(-2Kx)L^2}{32\pi^2\varepsilon_0c^5m^2n^2}\left(\frac{\omega}{\omega_0\gamma}\right)^2\times[U_+\exp(\varsigma_+)+U_-\exp(\varsigma_-)] \tag{27}$$

Where $$U_\pm = \left\{1+\sin^2\theta\times\left[\frac{\omega^2}{\omega_\pm^2}\beta^2\cos^2\phi+\left(\frac{1}{\gamma^4}-\cos^2\phi\right)\left(1+\frac{\omega}{\omega_\pm}\beta\cos\theta\right)^2\right]\right\}\left(\frac{\omega_0}{\omega_\pm}\right)^2(\beta\pm\beta_g)^{-2} \tag{28}$$

And $$\varsigma_\pm = -\frac{L^2[-\omega_\pm+\omega(1-\beta\cos\theta)]^2}{c^2n^2(\beta\pm\beta_g)^2} \tag{29}$$

where $\varepsilon_0$ is the permittivity of free space, L is the spatial extent (intensity FWHM) of the GP, $E_{0s}$ is the peak electric field amplitude on the graphene, $\beta_g$ is the GP group velocity normalized to c, $K \approx n\omega_0/c$ is the GP out-of-plane wavevector, Q is the electron charge (although the theory holds for any charged particle), and W(x,y) is the electron distribution in the beam (x is the distance from the graphene, as in FIG. 1B).

Figure 16B:
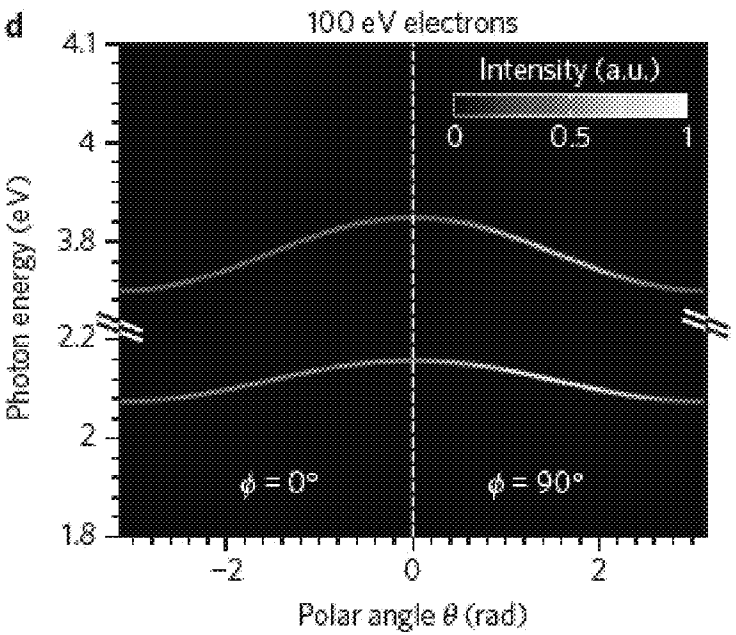
FIGS. 16A-16B show calculated emission intensity as a function of the polar angle of the outgoing radiation (horizontal) and its energy (vertical) when electrons having energies of 3.7 MeV and 100 eV, respectively, are used in graphene-based-radiation sources.
Figure 16A:
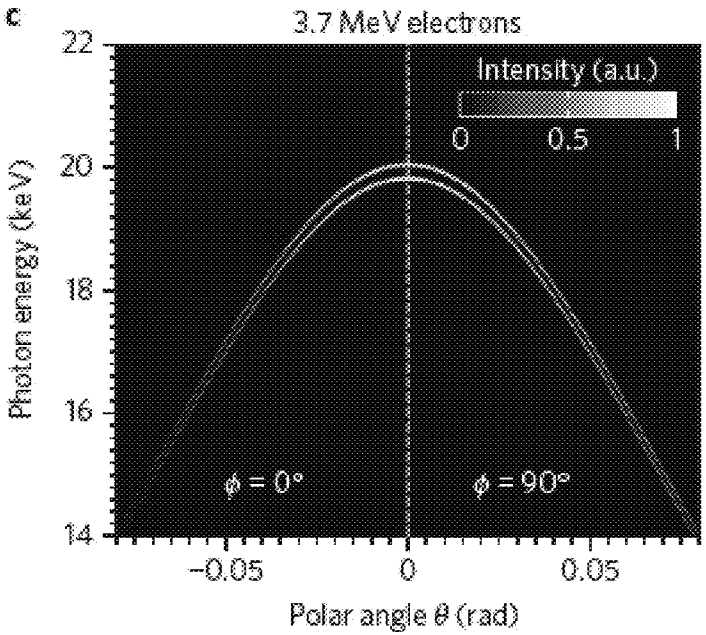

The first and second terms between the square brackets of Equation (27) correspond to spectral peaks associated with the counter-propagating ($\omega_{ph+}$) and co-propagating ($\omega_{ph-}$) parts of the standing wave, respectively. FIGS. 16A-16B show the emission intensity as a function of the polar angle of the outgoing radiation (horizontal) and its energy (vertical) when electrons having energy of 3.7 MeV and 100 eV, respectively, are used. The double-peak phenomenon described in this paragraph is also captured in the figures. In FIGS. 16A-16B, the GP has a temporal frequency of $\omega_0/2\pi=2\times10^{14}$ Hz ($\lambda_{air}$=1.5 μm), in a graphene sheet that is electrostatically gated, or chemically doped, to have a carrier density of $n_s=3.2\times10^{13}$ $cm^{-2}$ (Fermi level of $E_F$=0.66 eV). This gives a GP spatial period of 8.33 nm, corresponding to a spatial confinement factor n (the ratio of the free-space wavelength to the GP wavelength) of 180. The graphene sheet is several micrometers in length, the interaction length being determined by the spatial size of the laser exciting the GP, which is 1.5 μm long (FWHM).

More specifically, FIG. 16A shows highly directional hard X-ray (20 keV) generation from 3.7 MeV electrons, which may be obtained readily from a compact RF electron gun. This level of electron energy requirement obviates the need for further electron acceleration, for which huge facilities (for example, synchrotrons) are necessary. In addition, this scheme does not require the bulky and heavy neutron shielding (which would add to the cost and complexity of the equipment and installation) that is necessary when electron energies above 10 MeV are used, as is often the case when X-rays are produced from free electrons in a Thomson or Compton scattering process.

FIG. 16B illustrates a different regime of operation, but based on the same physical mechanism, in which electrons with a kinetic energy of only 100 eV (a non-relativistic kinetic energy that can even be produced with an on-chip electron source) generate visible and ultraviolet photons at on-axis peak energies of 2.16 eV (0.32% spread) and 3.85 eV (0.2% spread). The lack of radiative directionality can be due to the lack of relativistic angular confinement when non-relativistic electrons are used.

Figures 17A, 17B:
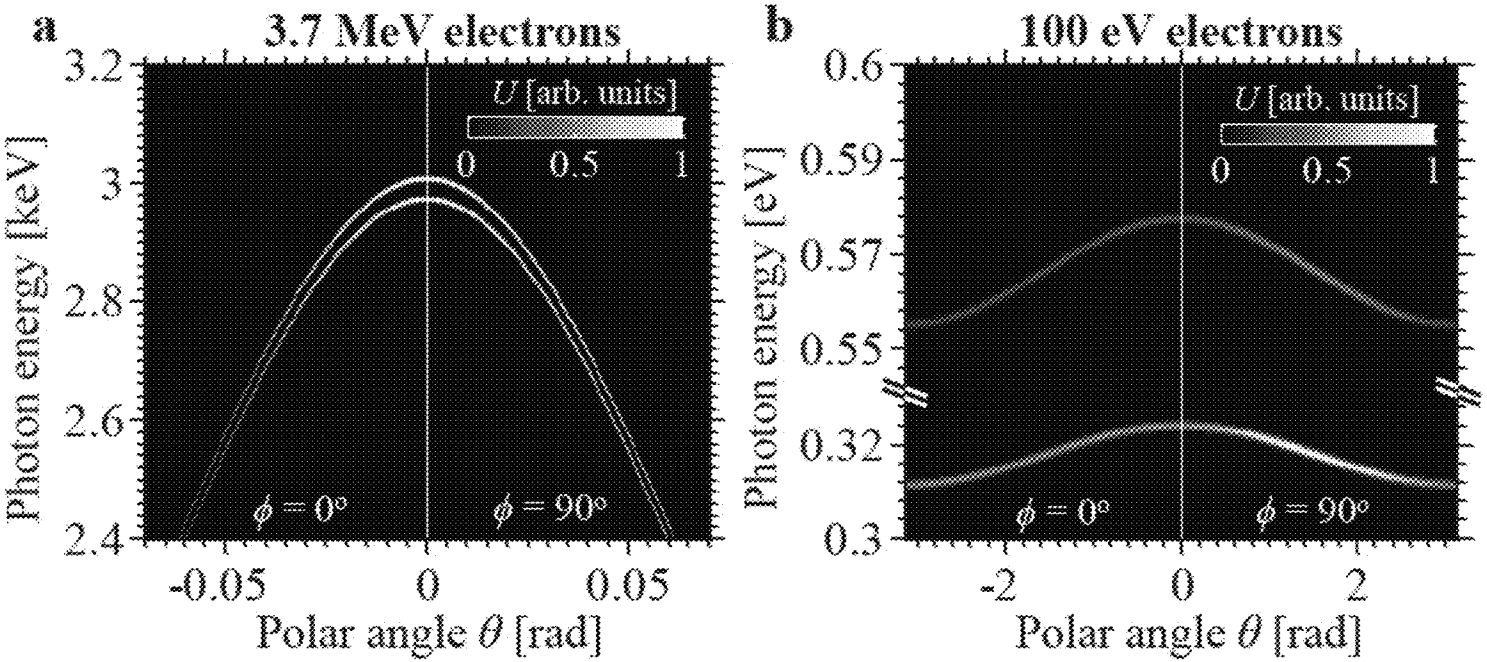
FIGS. 17A-17B show calculated emission intensity when electrons having energies of 3.7 MeV and 100 eV, respectively, are used and when the SPP has a free space wavelength of 10 μm.

FIGS. 17A-17B show the emission intensity when electrons having energy of 3.7 MeV and 100 eV, respectively, are used and when the SPP has a free space wavelength of 10 μm. The main difference in radiation output—compared to the λ=1.5 μm case for the same confinement factor—lies in the output photon energy, which is smaller for a given electron energy due to the larger spatial period of the surface plasmons. More specifically, in FIG. 17A, it can be seen that highly-directional, monoenergetic (0.23% FWHM energy spread), few-keV X-rays are generated by 3.7 MeV electrons, which may be obtained readily from a compact RF electron gun. In FIG. 17B, 100 eV electrons now generate near/mid-infrared photons at on-axis peak energies of 0.58 eV (0.2% energy spread) and 0.32 eV (0.3% energy spread). As before, the lack of radiative directionality in the 100 eV case is an inevitable result of the lack of relativistic angular confinement when non-relativistic electrons are used.

The resulting 20 keV photons in FIG. 16A are highly directional and monoenergetic, with an on-axis full-width at half-maximum (FWHM) energy spread of 0.25% and an angular spread of less than 10 mrad. The effect of electron beam divergence is discussed below.

Space Charge and Electron Beam Divergence

This section examines the effect of space charge, i.e., inter-electron repulsion, and electron beam divergence on the output of the GP radiation source. To this end, regular circular beams and electron beams with elliptical cross-sections are used. These elliptical, or "flat", charged-particle beams are of general scientific interest as they can transport large amounts of beam currents at reduced intrinsic space-charge forces and energies compared to their cylindrical counterparts. Elliptical electron beams can also couple efficiently to the highly-confined graphene plasmons, which occupy a relatively large area in the y-z plane, but can decay rapidly in the x-dimension.

Figures 18A, 18B:
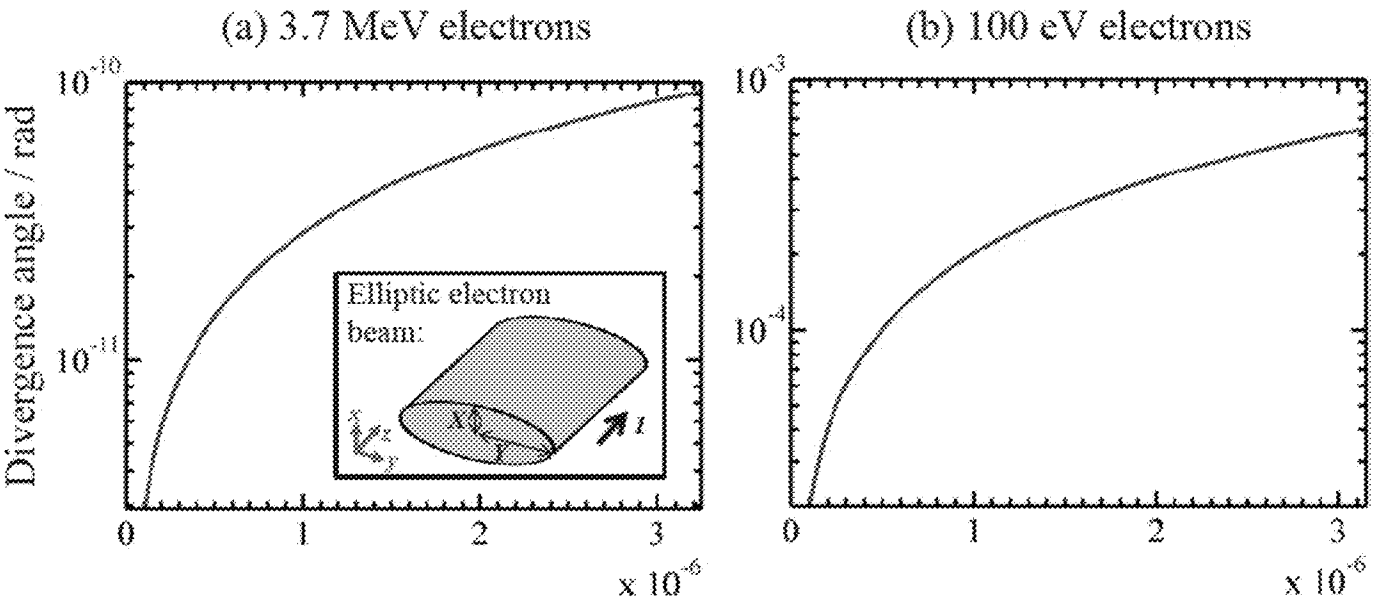
FIGS. 18A-18B show divergence of electron beams as a function of propagation distance within surface plasmon polaritons (SPP) fields.
Figures 19A, 19B, 19C, 19D, 19E, 19F:
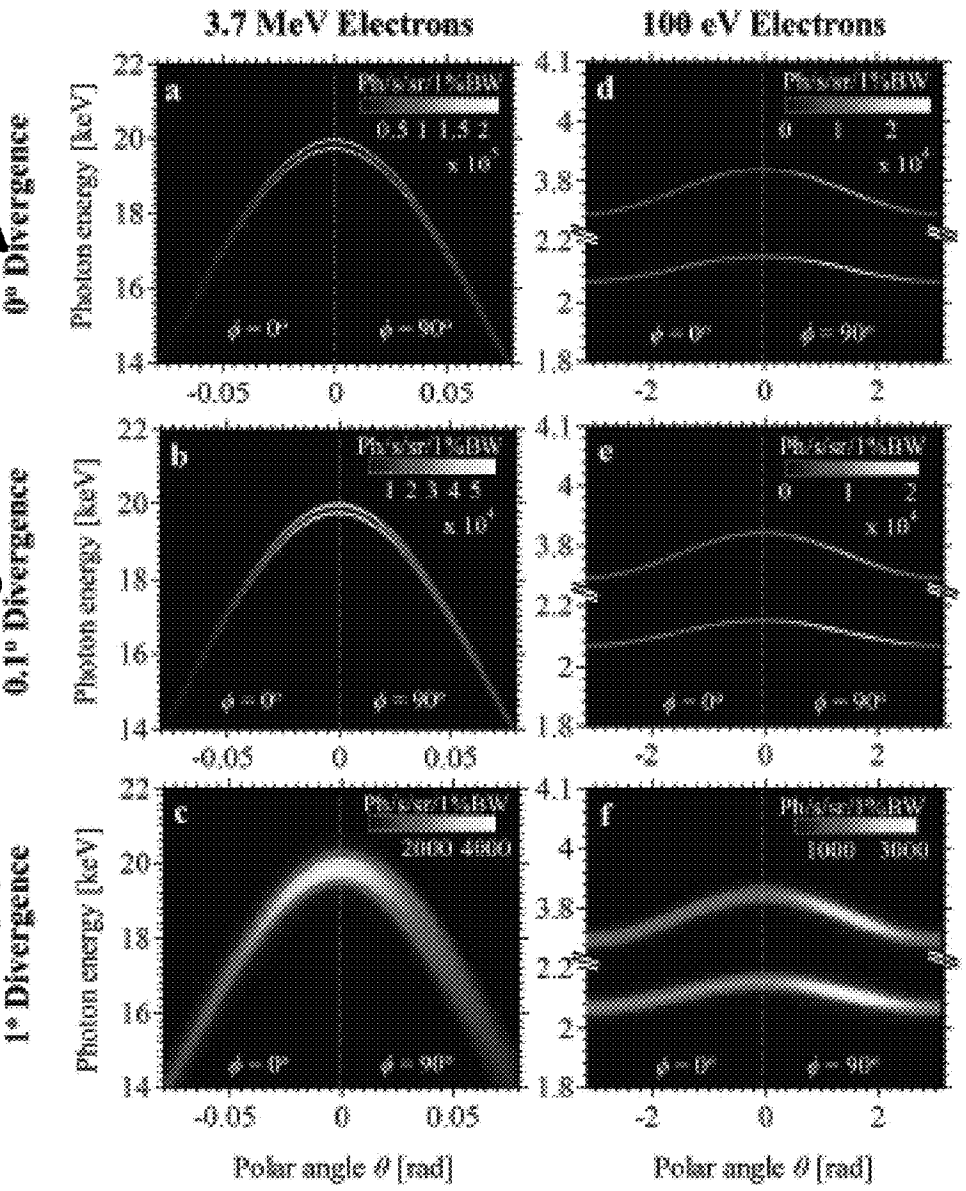
FIGS. 19A-19F show effects of electron beam divergence on the output radiation from graphene-plasmon-based radiation sources.

The elliptical charged-particle beam has semi-axes X in the x-dimension and Y in the y-dimension and travels in the z-direction with the beam axis oriented along the z-axis (see inset of FIG. 18A). Assuming a uniform distribution, the electrostatic potential of such a charged-particle beam in its rest frame is given by:

$$\Phi' = \frac{-\rho'}{2\varepsilon_0}\left(\frac{x^2X + y^2Y}{X+Y}\right) \tag{30}$$

where ρ' is the charge density in the rest frame (primes are used to denote rest frame variables throughout this section). A beam current of I in the lab frame gives a lab frame charge density of $\rho=I/(\pi XYv)$, where v is the speed of the charged particles in the z-direction, and a corresponding rest frame charge density of $\rho'=\rho/\gamma$, where γ is the relativistic Lorentz factor. According to the Newton-Lorentz equation, the resulting electromagnetic force in the lab frame gives the second-order differential equation for the evolution of the beam semi-axes:

$$\frac{d^2X}{dz^2} = \frac{d^2Y}{dz^2} = \frac{2C}{X+Y} \tag{31}$$

where $C=QI/(2\pi m\varepsilon_0\gamma^3v^3)$, Q and m are the charge and rest mass respectively of each particle, and z is the position along the beam in the z-direction, z=0 being the point of zero beam divergence (i.e. the focal plane of the charged particle beam), where $X=X_0$, $Y=Y_0$, and dX/dz=dY/dz=0. Note that the factor of $\gamma^3$ in the denominator of C implies that the effect of space charge diminishes rapidly as the charged particles become more and more relativistic.

Equation (31) is accurate as long as the transverse velocity is small compared to the longitudinal velocity, and the transverse beam distribution remains approximately uniform. Equation (31) can be solved to get:

$$z = \frac{X_0+Y_0}{\sqrt{2C}}\int_0^{\sqrt{\ln(2X-X_0+Y_0)-\ln(X_0+Y_0)}} e^{t^2}\,dt \tag{32}$$

which is an implicit expression for X as a function of z. The beam divergence angle is:

$$\theta_d = \arctan\left(\frac{dX}{dz}\right) = \arctan\left(\sqrt{2C\ln\left(\frac{2X-X_0+Y_0}{X_0+Y_0}\right)}\right) \tag{33}$$

The corresponding value of Y is given by: $Y=X-X_0+Y_0$.

Varying the parameter X in Equation (32) and then inverting z=z(X) to X=X(z) can get the solutions for X(z), which also gives Y(z) and $\theta_d(z)$ from Equation (33). In this way, the divergence angle and the semi-axes as a function of z along the charged-particle beam can be plotted, as shown in FIGS. 18A-18B, for electron beams of kinetic energies 3.7 MeV (panel a) and 100 eV (panel b).

As can be seen from the FIGS. 18A-18B, the large Lorentz factor of the relativistic 3.7 MeV electrons permits an even larger current to be used without causing the beam to diverge significantly over the interaction distance. The divergence angle of the 100 eV electron beam remains reasonably small over the interaction region, but additional beam-focusing stages may probably be needed for larger currents or longer interaction distances.

When $X-X_0 \ll (X_0+Y_0)/2$, as is the case in the plots of FIGS. 18A-18B, Equations (32) and (33) can be simplified via Taylor expansions to obtain analytical expressions of X, Y and $\theta_d$ as functions of z:

$$X \approx \frac{C}{X_0+Y_0} z^2 + X_0, \quad Y \approx \frac{C}{X_0+Y_0} z^2 + Y_0, \text{ and } \quad \theta_d \approx \frac{2Cz}{X_0+Y_0} \tag{34}$$

Equation (34) holds for $\theta_d \ll 1$. The appearance of $Y_0$ in the denominator of terms in Equation (34) shows that, for a given $X_0$, a more elliptical charged-particle beam profile can ameliorate the beam expansion and divergence due to space charge. The approximations in Equation (34) are useful analytical expressions for modeling the propagation of elliptical charged-particle beams.

The divergence of the electron beam (e.g., due to space charge and energy spread of the source) can be accounted for by performing multi-particle numerical simulations for beams with angular divergences of 0.1° and 1° relative to the z axis as shown in FIGS. 19A-19F. The angular divergences can be modeled by introducing a corresponding Gaussian spread for the momenta of each particle in the x, y and z directions. $10^4$ macro-particles are used in each simulation. The electrons interact with one another through the electromagnetic fields they produce, with Coulomb repulsion being the most significant contributor to the interaction. The results show variations of peak intensity within an order of magnitude, but no significant change to bandwidth or peak frequency: Comparing the case with 0.1° divergence (FIG. 19B) to the ideal case (FIG. 19A) for the 3.7 MeV electron beam, a decrease in peak photon intensity of ~60% is observed. Still, the energy spread remains small (increasing from 0.25% to 0.4%) and the shift in peak frequency is negligible.

For the 100 eV electron beam, a 0.1° divergence (FIG. 19E) can cause the peak photon intensity to decrease by ~20%, whereas the energy spread is practically unaffected. This shows that, for either regime of parameters, the scheme is still viable when a small but non-negligible energy spread exists in the electron beam. However, as observed from FIG. 19C and FIG. 19F, increasing the beam divergence to 1° may cause the radiation output to deteriorate for both relativistic and non-relativistic cases, demonstrating the importance of controlling the electron beam divergence for the efficient operation of the scheme.

Ponderomotive Deflection of Electrons

In deriving Equation (27), it is assumed, first, that transverse and longitudinal electron velocity modulations are small enough that γ is approximately constant throughout the interaction and, second, that the beam centroid is displaced negligibly in the transverse direction, both of which are very good approximations in most cases of interest. Details of the derivation are already provided above, where the general problem of radiation scattered by electrons interacting with GP modes of arbitrary n (not just n>>1) is addressed. In addition, an expression is also derived below for the threshold beyond which our approximations break down due to ponderomotive deflection.

An advantage of a GP's large confinement factor in our scheme is to generate photons of relatively high energy with electrons of relatively low energy. When the relativistic mass of an electron is very small, however, the electron may be readily deflected away from the graphene surface by radiation pressure: the time-averaged ponderomotive force that pushes charged particles from regions of higher intensity to regions of lower intensity. This deflection potentially shortens the GP-electron interaction, resulting in lower output power than if the electron experienced an undeflected trajectory.

Figures 20A, 20B:
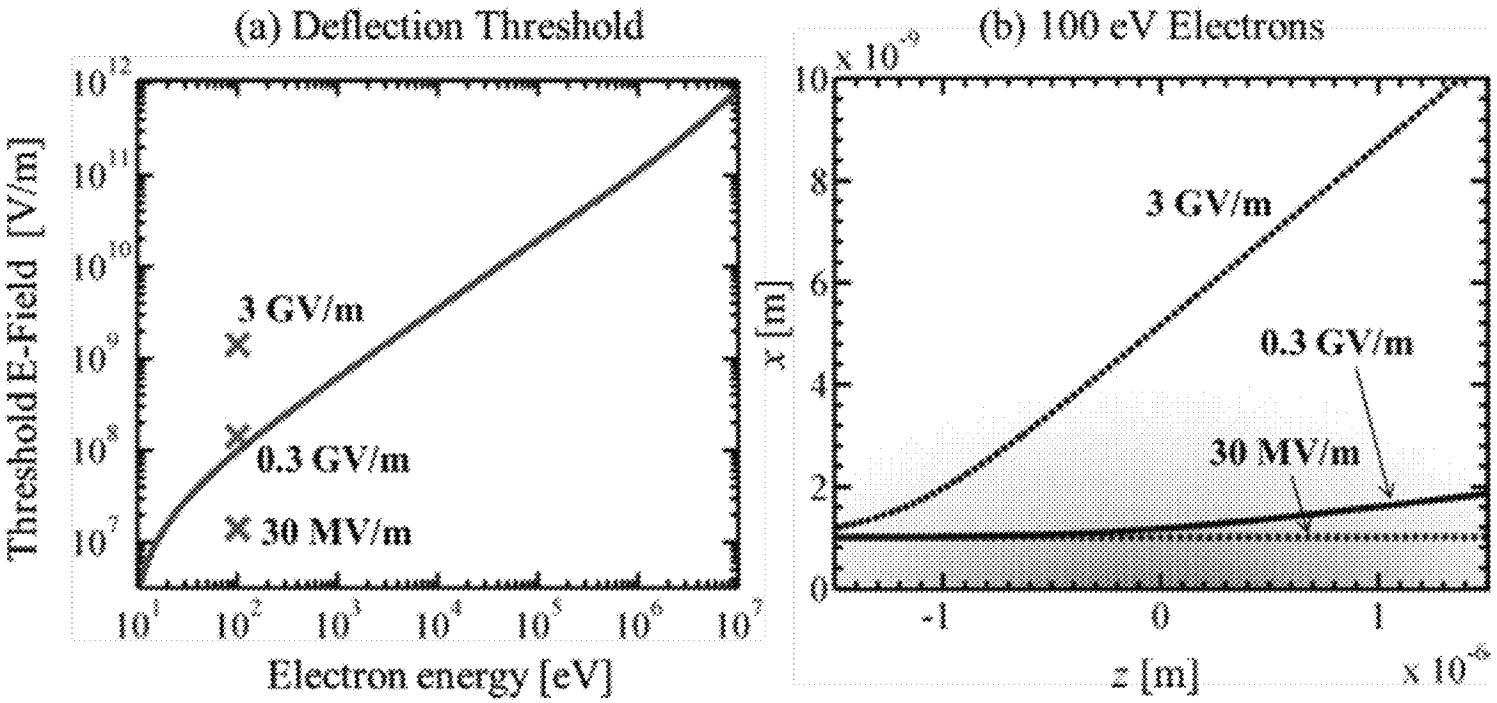
FIGS. 20A-20B show ponderomotive deflection of electrons.

FIGS. 20A-20B show ponderomotive deflection of electrons, pushing them away from the graphene surface. FIG. 20A shows the electric field threshold for significant ponderomotive deflection as a function of electron energy. Each red cross corresponds to a line in FIG. 20B, where the trajectory of a 100 eV electron 1 nm away from the graphene surface (n=180) is plotted for different values of peak electric field amplitude at the graphene surface $E_{0s}$ (the value in the labels). For reference, the GP field is displayed in the background.

An important implication of the results in FIGS. 20A-20B is that for strong electric fields the distance of interaction is limited by the ponderomotive force, in addition to limitations imposed by the graphene size and the electron beam divergence. For small electron beam energies (less than a few hundred eVs), the ponderomotive force becomes the dominant factor limiting the interaction length. This practically limits the amplitudes of useful GPs in cases of low-energy electron beams. Nevertheless, the onset of significant radiation pressure for electron energies around 50 keV is already 20 GV/m, which is about the graphene breakdown field strength. This implies that the constraints imposed by the ponderomotive force are already negligible at the upper end of scanning electron microscope energies, and become even more negligible at higher electron energies (e.g., on the scale of transmission electron microscope and radiofrequency gun energies).

In the interest of maximizing output spectral intensity, it is desirable to have as large an $E_0$ as possible. However, too large an $E_0$ may cause the electron to significantly deviate from its intended trajectory, resulting in a smaller effective interaction duration. One way to overcome the problem of ponderomotive deflection without having to decrease the GP intensity can use a symmetric configuration of graphene-coated dielectric slabs (i.e., a slab waveguide configuration), in which the electrons are confined to the minimum of an intensity well formed by surface plasmon-polaritons above and below the electron bunch. Recent advances in creating graphene heterostructures might make this configuration desirable for a GP-base radiation source device.

Figure 21A:
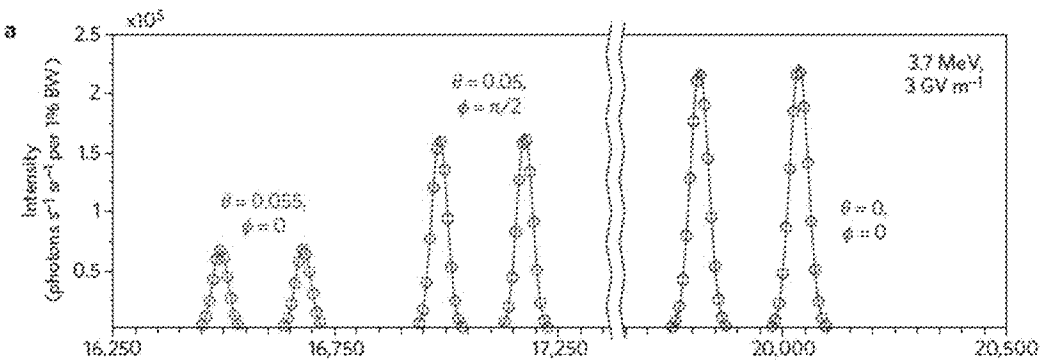
FIGS. 21A-21C show numerical and analytical results of the radiation spectrum when a 1.5 μm SPP is used.
Figure 21B:
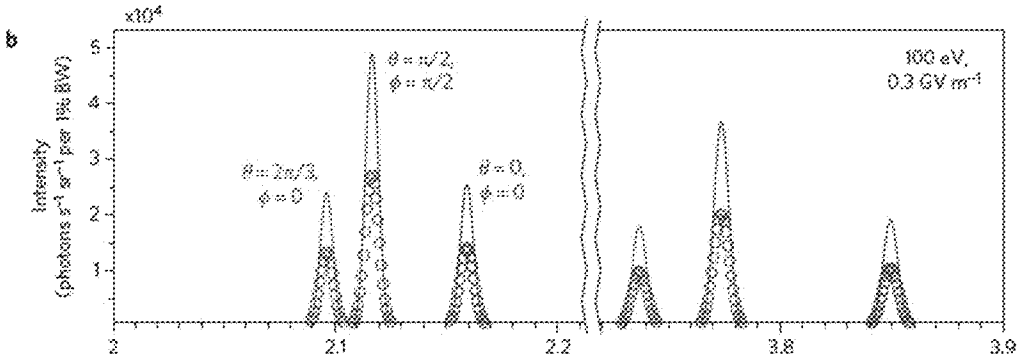
Figure 21C:
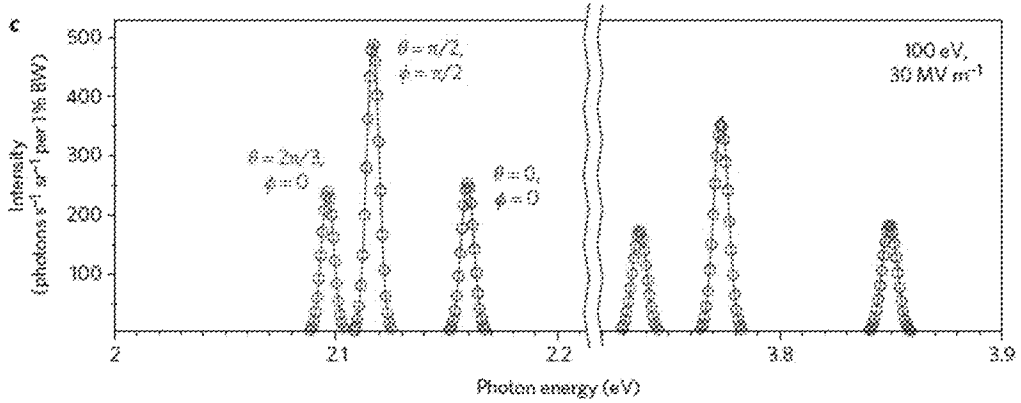

FIGS. 21A-21C show numerical and analytical results of the radiation spectrum. FIG. 21A shows numerically (circles) and analytically (solid lines) computed radiation intensities in units of photons per second per steradian per 1% bandwidth (BW) for 3.7 MeV electrons with a peak electric field amplitude of $E_{0s}$=3 $GVm^{-1}$ on the graphene surface. FIG. 21B shows the radiation spectrum when 100 eV electrons with $E_{0s}$=0.3 $GVm^{-1}$ are used. FIG. 21C shows the radiation spectrum when 100 eV electrons with $E_{0s}$=30 $MVm^{-1}$ are used. The radiation spectra correspond to an average current of 100 μA. The electron beam is centered 5 nm from the graphene sheet and has a transverse distribution of standard deviation 10 nm. All GP parameters are the same as in FIGS. 16A-16B. The different colors represent measurements from different angles.

Figures 22A, 22B, 22C:
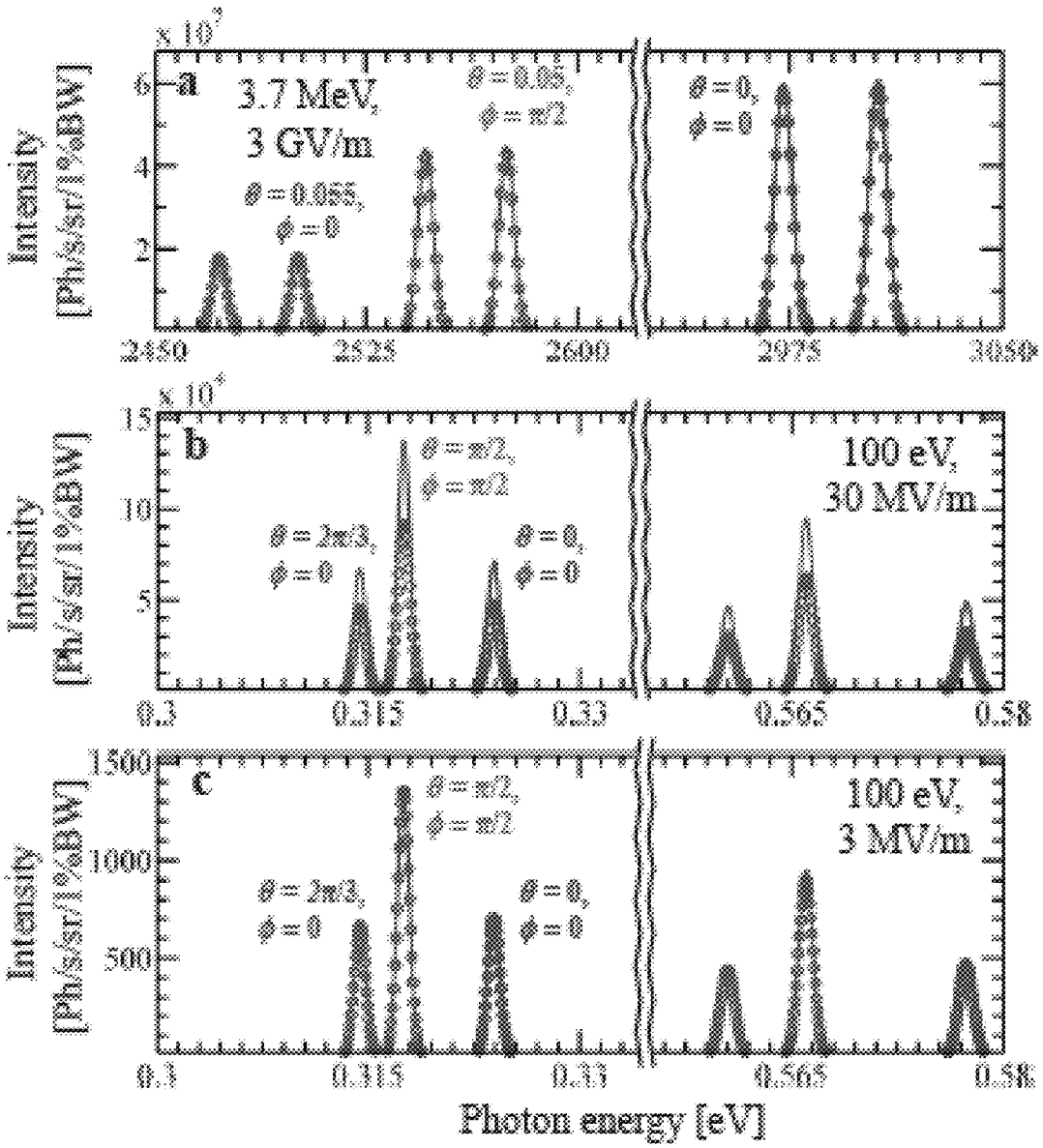
FIGS. 22A-22C show numerical and analytical results of the radiation spectrum when a 10 μm SPP is used.

FIGS. 22A-22C show results corresponding to those in FIGS. 21A-21C, but with a GP free space wavelength of λ=10 μm since most GP experiments so far have been performed at this wavelength. FIGS. 22A-22C show an excellent agreement between numerically and analytically computed radiation intensities in the regime for which ponderomotive scattering is negligible. The effect of ponderomotive scattering—which decreases the effective interaction length—is responsible for the discrepancy between analytical and numerical results in FIG. 21B and FIG. 22B. Throughout this section, the graphene parameters correspond to a confinement factor of n=180 (obtained for $E_f$=0.1 eV), a plasmon group velocity of 0.00184 c, and a surface conductivity of $\sigma_s=2.25\times10^{-8}+i4.55\times10^{-5}$ S, as obtained within the RPA.

Full Electromagnetic Simulation

This section describes full electromagnetic simulations that also include the electrons dynamics. The presented results are for two particular set of parameters that both lead to hard X-ray radiation. Both options are simulated for an electron beam going parallel to the side of a graphene sheet placed on a silicon substrate.

Figures 23A, 23B:
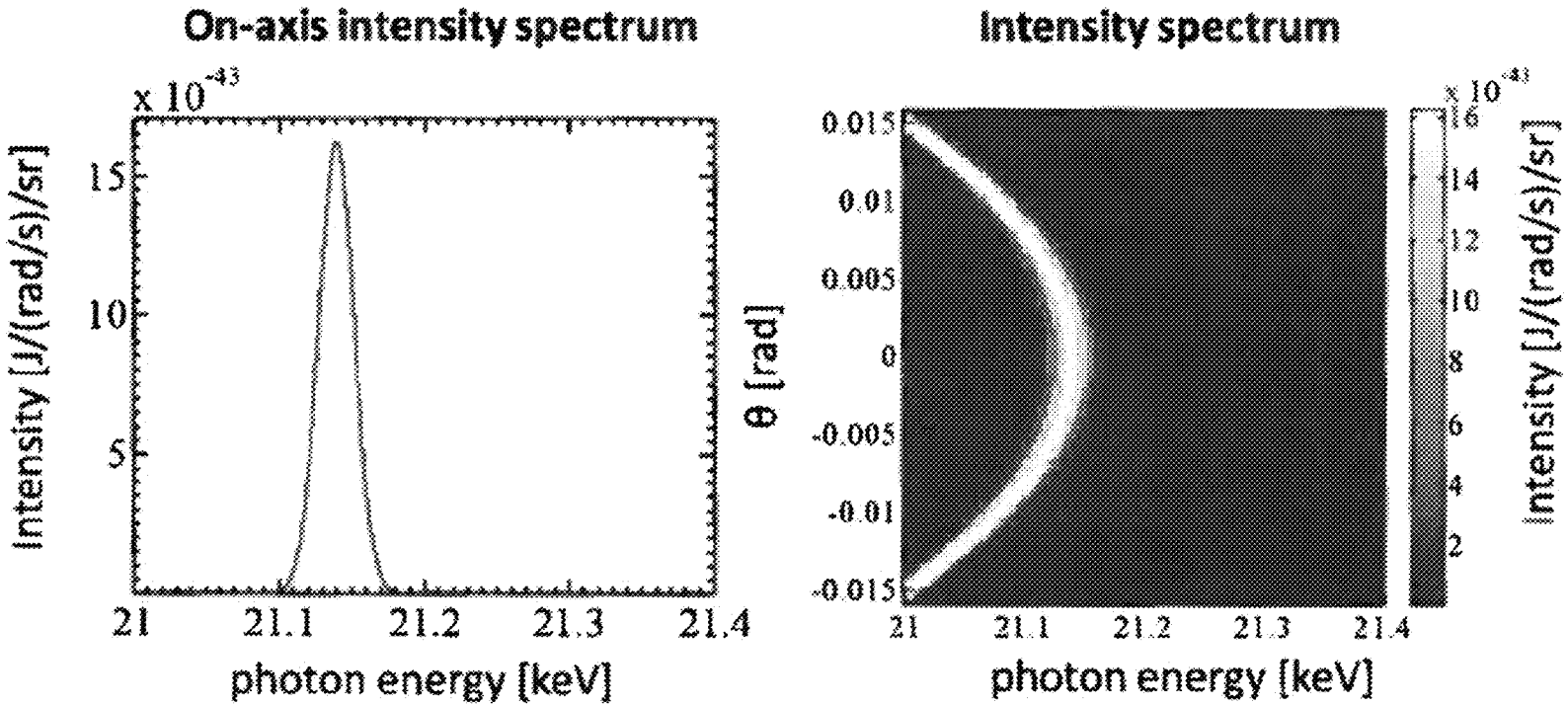
FIGS. 23A-23B show full electromagnetic simulation results of output radiation when 2.3 MeV electron beams are used.

FIGS. 23A-23B show radiation spectrum when electron energy at 2.3 MeV, $\lambda_{air}$=2 μm, squeezing factor n=580, and doping of 0.6 eV are used. FIG. 23A shows a cross section plot that can emphasize the narrowness of the peak, indicating that the output emission from GP-based radiation sources is highly monochromatic. FIG. 23B shows that the spectrum peak is centered at 21 KeV then gradually shifts for larger angles.

Figure 24B:
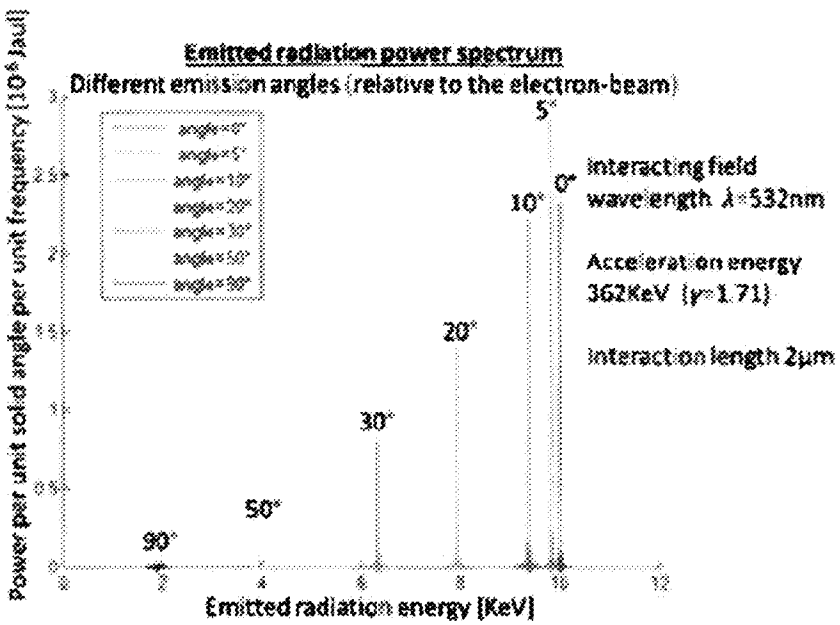
FIGS. 24A-24B shows a comparison of X-ray source from a single electron interacting with a graphene SPP versus a conventional scheme.
Figure 24A:
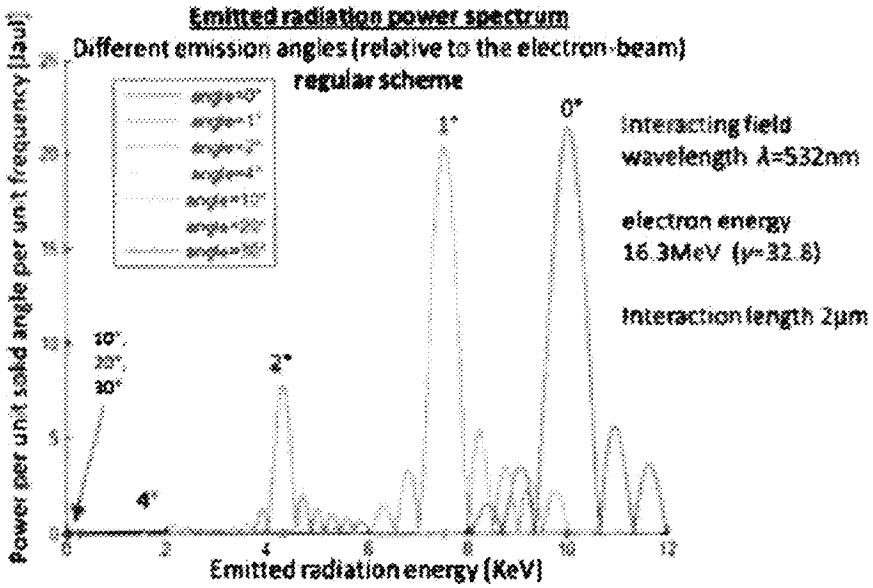

FIGS. 24A-24B shows a comparison of X-ray source from a single electron interacting with a graphene SPP versus a conventional scheme. The conventional scheme includes a field of the same frequency and the same peak amplitude, interacting over the same distance. In order to achieve X-ray energy of 10 KeV in both cases, it is assumed that the electrons in the conventional scheme have somehow been accelerated to 16.7 MeV. Surprisingly, even without accounting for the acceleration stage, there are additional inherent advantages of GP-based scheme. First, GP-based scheme can have lower energy consumption. The SPP is a surface wave hence a field of the same amplitude is confined to smaller regime, resulting in less total energy. Also, the electrons energy is lower since γ is smaller. Second, the output radiation in the GP-based scheme is monochromatic with the spectral width of the generated X-ray being smaller. Third, the output radiation from the GP-based scheme is also coherent because the SPP confinement might lead to self-amplified stimulated emission due to the feedback from the X-rays causing self-synchronization of the electrons. Fourth, the output radiation from the GP-based scheme has a wider angular spread. A well-known technical limit of the conventional scheme is that the X-ray emission is parallel to the electron-beam. The intensity and energy of the X-ray drop quickly at larger angles. The graphene SPP scheme creates radiation in larger angles, and even perpendicular to the electron-beam. This can considerably simplifies technical considerations in separating the X-ray beam from the electron beam.

Figure 25A:
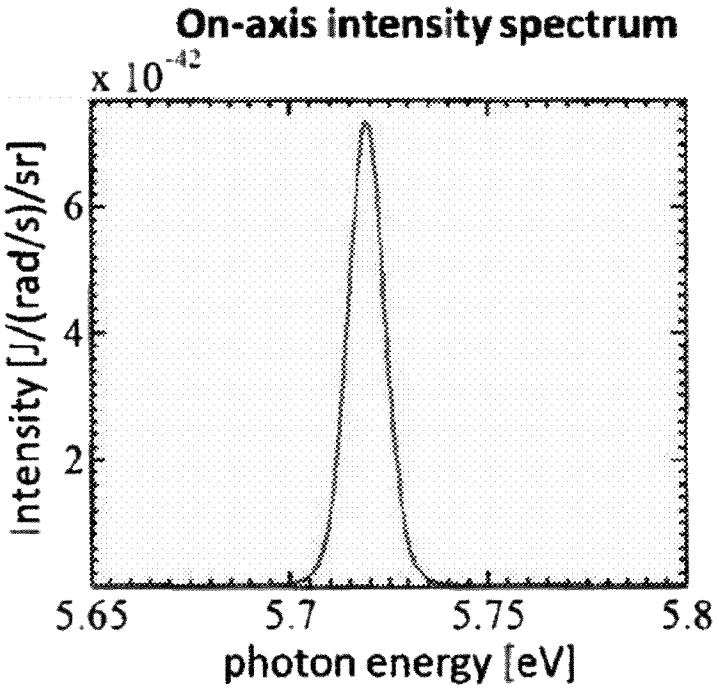
FIGS. 25A-25B show full electromagnetic simulation results of output radiation when 50 eV electron beams are used.
Figure 25B:
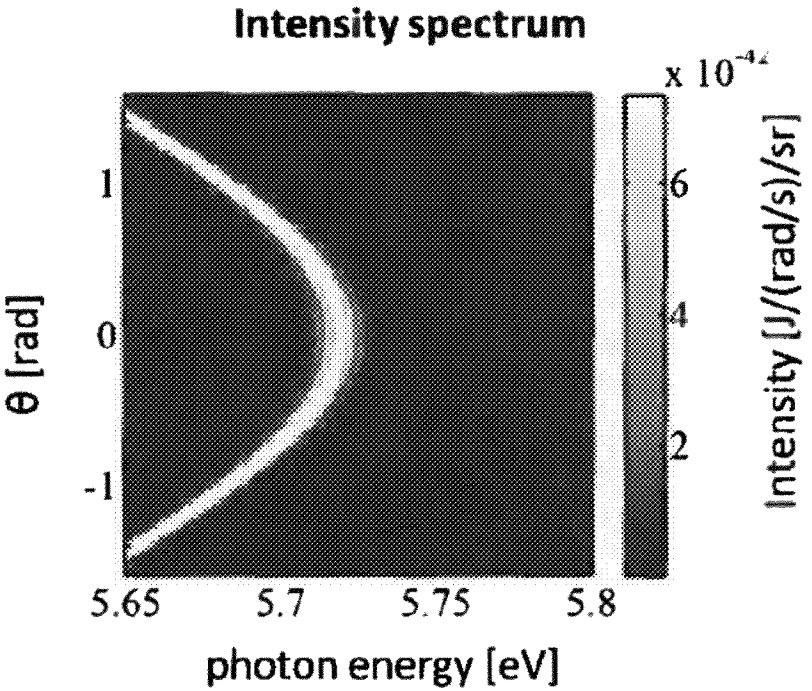

FIGS. 25A-25B show radiation spectrum when electron energy at 50 eV, $\lambda_{air}$=2 μm, squeezing factor n=580, and doping of 0.6 eV are used. FIG. 25A shows a cross section plot that can emphasize the narrowness of the peak, indicating that the output emission from GP-based radiation sources is highly monochromatic. FIG. 25B shows that the spectrum peak is centered at 5.7 eV then gradually shifts for larger angles.

Frequency Down-Conversion and THz Generation

This section describes a frequency down-conversion scheme to generate compact, coherent, and tunable terahertz light. Demand for terahertz sources is being driven by their usefulness in many areas of science and technology, ranging from material characterization to biological analyses and imaging applications. Free-electron methods of terahertz generation are typically implemented in large accelerator installations, making compact alternatives desirable.

Approaches described in this section use a configuration in which light co-propagates with the electron. The phase velocity of the light can be slower than the speed of light in vacuum, which may be achieved with the cladding mode of a dielectric waveguide (e.g., cylindrical, rectangular, planar etc.) or using a surface plasmon polariton with a squeezing factor n>1 (phase velocity of the SPP is then c/n). The field in the waveguide may be oscillating at optical or infrared frequencies (technically, any frequency is possible).

Figure 26:
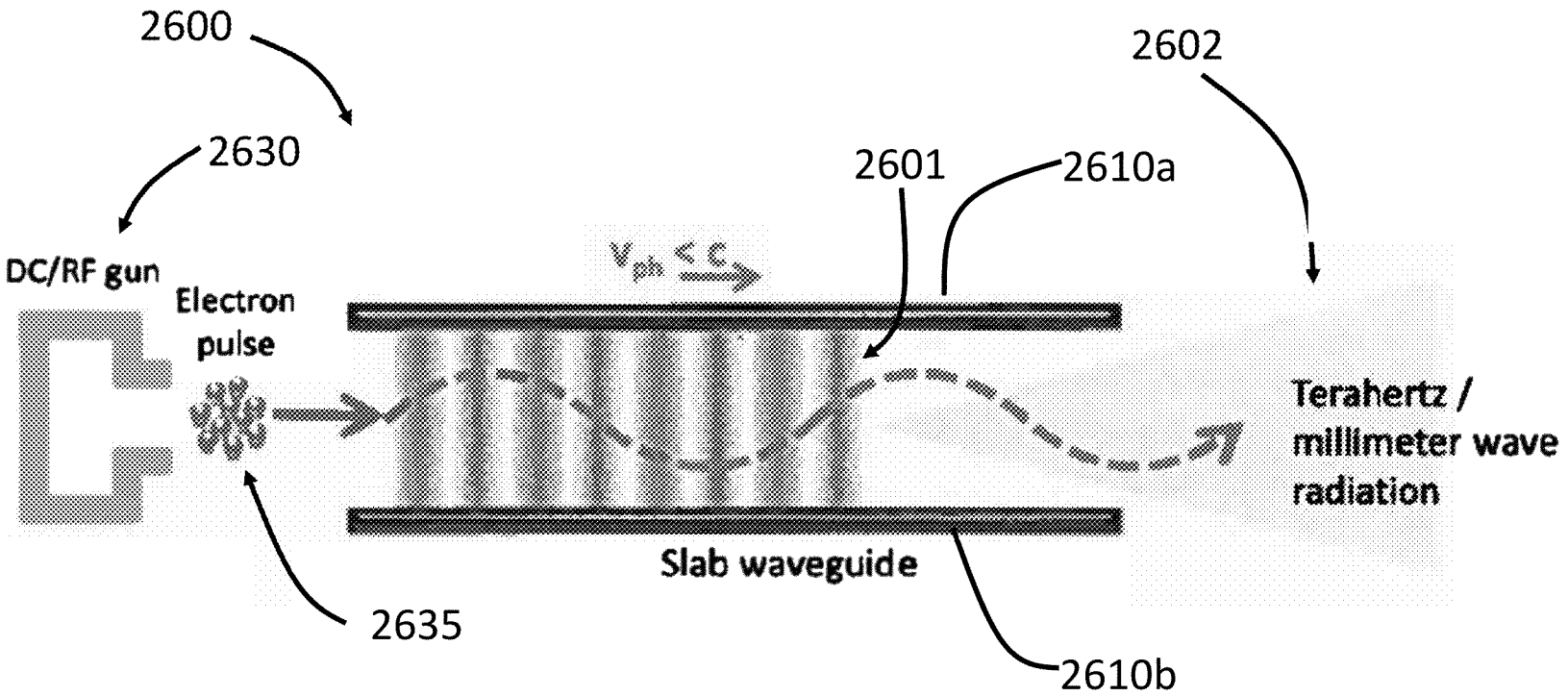
FIG. 26 shows a schematic of a system for frequency down-conversion using graphene plasmons.

FIG. 26 shows a schematic of a system for frequency down-conversion using graphene SPP fields. The system 2600 includes a pair of graphene layers 2610*a* and 2610*b*, each of which is disposed on a respective substrate. The two graphene layers are disposed against each other such that a SPP field 2601 exists within the space between the two graphene layers 2610*a* and 2610*b*. An electron source (e.g., a DC or RF electron gun) delivers an electron beam 2635 into the SPP field 2601 to co-propagate with the SPP field. Since the squeezing factor of the SPP field can significantly reduce the phase velocity of light in the space between the two graphene layers 2610*a* and 2610*b*, the electron beam 2635 can therefore propagate at a speed comparable to the phase velocity of light in the same space, thereby achieving velocity matching. The interaction between the electron beam 2635 and the SPP field 2601 generates the output emission 2602, which can have a longer wavelength compared to the optical beam (not shown in FIG. 26) that excites the SPP field 2601.

The output frequency may be tuned by adjusting the energy of the input electron pulse. Down-converted radiation is collected in the forward direction. The on-axis output frequency v is given by:

$$v=v_0(1-n\beta_0)/(1-\beta_0) \tag{35}$$

where $v_0$ is the frequency of the electromagnetic wave that excites the SPP field and $\beta_0$ is the initial speed of the electron in the +z direction.

Figure 27:
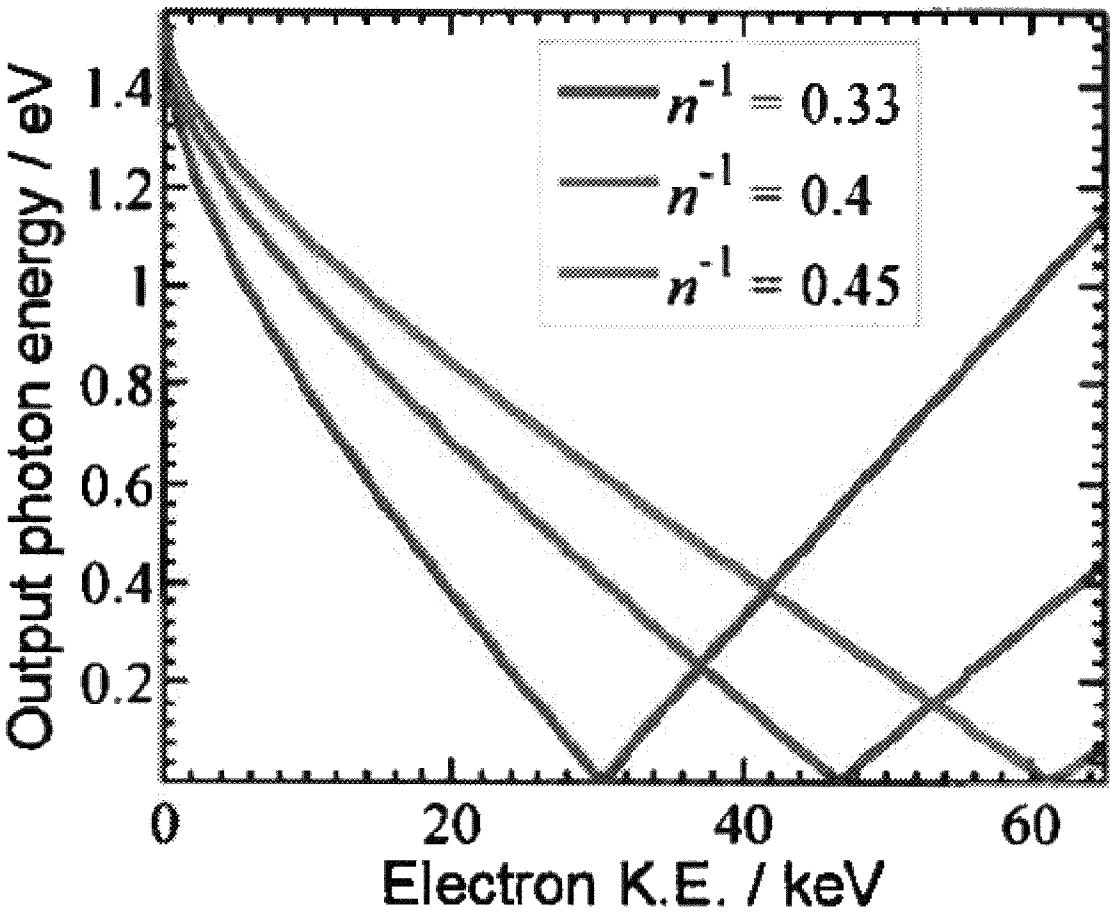
FIG. 27 show output frequencies that can be achieved using the system shown in FIG. 26.

FIG. 27 shows the output photon energy as a function of electron kinetic energy for the co-propagating configuration, for various values of n. Initial photon energy is 1.55 eV (corresponding to a wavelength of 0.8 μm). Clearly, down-conversion is possible when the initial electron velocity closely matches the phase velocity of the co-propagating electromagnetic wave. The input electron pulse may be relativistic or non-relativistic, depending on the phase velocity of the chosen mode (i.e. it is possible to design the structure to use either relativistic or non-relativistic electrons). To achieve coherence, the electron pulse may be pre-bunched such that each bunch is of a length much smaller than the emission wavelength. Techniques that enhance emission output for the frequency up-conversion scheme in previous sections, such the using of a stack structure, may also be applied here.

Electrons Beam Oblique to 2D Systems

In previous sections, electrons are generally propagating substantially parallel to graphene layers. In contrast, this section describes the situations in which electrons are propagating at an oblique angle with respect to the graphene layers or photonic crystals.

The interaction of electron beams launched perpendicularly (or with some angle) onto a layered structure can have several promising applications for the creation of new sources of radiation. This type of radiation is generally referred to as transition radiation. Transition radiation is a form of electromagnetic radiation emitted when a charged particle passes through inhomogeneous media, such as a boundary between two different media. This is in contrast to Cerenkov radiation. The emitted radiation is the homogeneous difference between the two inhomogeneous solutions of Maxwell's equations of the electric and magnetic fields of the moving particle in each medium separately. In other words, since the electric field of the particle is different in each medium, the particle has to "shake off" the difference of energy when it crosses the boundary.

The total energy loss of a charged particle on the transition depends on its Lorentz factor $\gamma=E/mc^2$ and is mostly directed forward, peaking at an angle of the order of $1/\gamma$ relative to the particle's path. The intensity of the emitted radiation is roughly proportional to the particle's energy E. The characteristics of transition radiation make it suitable for particle discrimination, particularly of electrons and hadrons in the momentum range between 1 GeV/c and 100 GeV/c. The transition radiation photons produced by electrons have wavelengths in the X-ray range, with energies typically in the range from 5 to 15 keV.

Conventional transition radiation systems are normally based on bulky and expensive systems, thereby limiting the usefulness and widespread adoption. However, with new materials, new fabrication methods, and new theoretical techniques from nano-photonics, there are a lot of new possibilities to make revolutionary applications. One such application can be a table-top x-ray source based on the principle of transition radiation that can be made possible Coherent Light Generation and Light-Matter Interaction in IR-Visible-UV Regime Using Resonant Transition Radiation In this regime strong effects on the emitted photons can emerge from the theory of photonic crystals. A variety of different multilayer structures (isotropic photonic crystal, anisotropic photonic crystal, or metamaterials, etc.) can be used. Creating a resonance in the emitted spectrum can produce monochromatic radiation, and can create a new way to generate coherent light. In one example, using one dimensional photonic crystal angular selective behavior can be achieved. With this property, beam steering of created IR-visible-UV light can be achieved. In another example, a laser can be created from the multilayer structure, where there is no need for a gain material—the electron beam can be used instead of or in addition to gain.

Resonant Transition Radiation Near Plasma Frequency Regime

In this regime, the effective dielectric constant of materials can drop below 1 to zero, and even to negative values. This opens up many possibilities—usually considered unique to metamaterials—that can now be realized here. For example, metamaterials with refractive index less than 1 (or negative) can be used to make very thin absorbers, electrically small resonators, phase compensators, and improved electrically small antennas. These might be used for an enhanced slowing down of the electron, for controlling its velocity, energy spread, or even its wave function. Since the transition radiation spectrum is broadband, the light generated in that frequency regime can see a system that is very different from visible light in photonic crystals. This can lead to a new state of matter and many new applications, including slow light, light trapping, nanoscale resonators and possibly light cloaking.

X-Ray and Soft-X-Ray Generation

The transition radiation from a stack of very thin layers (several nanometers to several tens of nanometers) can cause an electron beam to emit x-ray. This does not require a highly relativistic electron beam. Moderately relativistic electron beams (several hundreds of KeVs to several MeVs), even with slower electrons over several tens of KeVs) can still produce x-ray in this way. Significant improvements in fabrication methods in recent years now allow for the fabrication of such stacked structures. Structures in higher dimensions (2D and 3D photonic crystals, and metallic photonic crystal) can be even more suitable for x-ray generation. The resulting radiation can be emitted at a wavelength that is close to the layer thickness divided by $\gamma$—the effect of $\gamma$ may not be significant here, because it is close to 1. Still, the radiation is in the x-ray thanks to the layers being very thin.

In the past, the limitations on fabrication methods allowed only for thick layers, in turn requiring very energetic electron beams to achieve radiation in the x-ray regime. The possibility of making very thin layers allows X-ray generation without high energy electron beams. It is worth noting that previously, very large scale (and expensive) electron acceleration systems were needed in order to accelerate electrons to MeV or GeV energies and produce X-ray radiation. However, if electron energy can be reduced to tens or hundreds of KeVs, it would be much easier and cheaper to generate such electrons. Consequently, the system size cost for an x-ray source would be significantly reduced.

Multiple 2DEG Layers

By Placing a Graphene Sheet (or Several Sheets) in Between Each of the Layers, or by placing other metallic layers that support surface plasmons, one can increase the efficiency of the transition radiation. The result is producing higher intensity radiation. For most materials the transition radiation becomes smaller when the layer thickness is smaller than the formation length. This limit can disappear when the surface of the layer supports surface plasmons. These surface plasmons can enhance the transition radiation, so that even very thin layers (thinner than the formation length) can still cause significant transition radiation to be emitted. This can potentially reduce the size and cost of an x-ray source even more.

This approach can also operate with 2DEG systems on the interface between different materials other than graphene layers. There are several other scenarios where the physics of 2DEG is found. For example, the interface between $BaTiO_3$ and $LaAlO_3$, or the interface between lanthanum aluminate ($LaAlO_3$) and strontium titanate ($SrTiO_3$) can be used as 2DEG systems. In another example, layers of ferromagnetic materials can also be used to construct 2DEG.

The multiple 2DEG layer structure can include a couple of tens of dielectric (or metallic) layers. A higher number of layers can generally improve the result such as increasing the output intensity and/or improving the monochromatic quality.

The multiple 2DEG layer structure can be further improved by adding small holes within the stack of layers. If the holes are smaller than the wavelength, they normally do not affect the emission of radiation, while the electrons can pass through them. In this way, the electrons can propagate through a longer distance in the stack structure before they slow down and stop emitting radiation. A longer penetration depth (also a longer mean free path) can allow more layers to take part in the radiation emission.

Cerenkov-Like Effect

This section describes graphene-based devices that emits radiation through a Cerenkov-like effect, induced from current flowing through the graphene sheet (suspended on dielectric or not). This approach does not require any external source of electromagnetic radiation, and is therefore highly attractive for on-chip CMOS compatible applications.

This approach can achieve direct coupling between electric current and SPPs in graphene. These SPP can be coupled to radiation modes in several ways, including creating defects on graphene, making a grating (1D or 2D) on graphene, making a grating (2D or 2D) from graphene (by patterning the graphene sheet), modulating the voltage applied on graphene to create a periodic refractive index that can allow tunable control of the radiation, fabricating almost any photonic crystal (any periodic dielectric structure) as the substrate of the graphene, specially designed photonic crystal that has high density of states at a particular frequency above the light cone, which can be achieved by employing one or more unique band structure properties such as van-Hove singularities, flat bands around Dirac points, or super-collimation contours.

To improve the efficiency of the effect, the electric current can be configured to include electrons that have the smaller velocity spread (i.e., more uniform velocity distribution). This is possible to graphene due to its Dirac cone band structure. In addition, the graphene can be doped to have high enough mobility so that the phase velocity of the graphene SPP can be lower than the velocity of the electrons. This can be seen by comparing the "squeezing factor" n from above, which has to be larger than the ratio between the speed of light and the electron velocity. A proper design of the electron current can create electrons moving at the Fermi velocity, which can be 300 times slower than the speed of light. This means that n>300 can already create the desired effect. Such values of n are achievable as shown in above sections.

The radiation can be emitted in four possible regimes, each requiring a different kind of structure. For example, Terahertz radiation can be created without doping the graphene. Infrared radiation can be achieved by doping the graphene. Visible light can be created by high doing of graphene, while UV light can be created based on additional plasmonic range in the UV region.

The phenomenon of a Cerenkov-like coupling between electron current and SPPs in graphene can be the first occurrence of Cerenkov radiation from bounded electrons in nature. This is bound to lead to more attractive applications based on the same phenomenon, since it bridges the gap between photonics and electronics.

A related effect exists in existing methods, in which a periodic structure interacts with flowing electrons. The difference between this existing idea and the approach described herein is that the existing idea is based on a Smith-Purcell radiation, and does not use the SPP modes of the system, which can be important for an efficient process.

The electron beam can be sent in the air/vacuum near the graphene sample. It can be beneficial for the free electron beam to pass very close to the sample (on the order of nanometers—similar to the wavelength of the graphene SPP). The advantage of this technique is that the velocity of the electron beam can be fully controlled and does not depend on graphene properties.

Since the Cerenkov-like effect can directly couple DC current to light (in the form of plasmons), it can have several other applications, including measurement the distribution of velocities in the graphene, measurement the conductivity, integrating optics with electronics for on-chip photonic capabilities, feedback effects where external light (coupled to plasmons) changes the properties of the plasmon excitations to influence the current (inverse Cerenkov) that can accelerate the electrons and also change the resistivity.

The same approach can be implemented in other 2DEG systems or even in other plasmonic systems. Notice that even in regular plasmonic systems, the Cerenkov-like generation of plasmons was never studied nor used to any of the applications we proposed here.

Quantum Čerenkov Effect from Hot Carriers in Graphene

Achieving ultrafast conversion of electrical to optical signals at the nanoscale using plasmonics can be a long-standing goal, due to its potential to revolutionize electronics and allow ultrafast communication and signal processing. Plasmonic systems can combine the benefits of high frequencies ($10^{14}$–$10^{15}$ Hz) with those of small spatial scales, thus avoiding the limitation of conventional photonic systems, by using the strong field confinement of plasmons. However, the realization of plasmonic sources that are electrically pumped, power efficient, and compatible with current device fabrication processes (e.g. CMOS), can be challenging.

This section describes that under proper conditions charge carriers propagating within graphene can efficiently excite GPs, through a 2D Čerenkov emission process. Graphene can provide a platform, on which the flow of charge alone can be sufficient for Čerenkov radiation, thereby eliminating the need for accelerated charge particles in vacuum chambers and opening up a new platform for the study of ČE and its applications, especially as a novel plasmonic source. Unlike other types of plasmon excitations, the 2D ČE can manifest as a plasmonic shock wave, analogous to the conventional ČE that creates shockwaves in a 3D medium. On a quantum mechanical level, this shockwave can be reflected in the wavefunction of a single graphene plasmon emitted from a single hot carrier.

The mechanism of 2D ČE can benefit from two characteristics of graphene. On the one hand, hot charge carriers moving with high velocities $$\left(\text{up to the Fermi velocity } v_f \approx 10^6 \frac{\text{m}}{\text{s}}\right)$$

are considered possible, even in relatively large sheets of graphene (10 μm and more). On the other hand, plasmons in graphene can have an exceptionally slow phase velocity, down to a few hundred times slower than the speed of light. Consequently, velocity matching between charge carriers and plasmons can be possible, allowing the emission of GPs from electrical excitations (hot carriers) at very high rates. This can pave the way to new devices utilizing the ČE on the nanoscale, a prospect made even more attractive by the dynamic tunability of the Fermi level of graphene. For a wide range of parameters, the emission rate of GPs can be significantly higher than the rates previously found for photons or phonons, suggesting that taking advantage of the ČE allows near-perfect energy conversion from electrical energy to plasmons.

In addition, contrary to expectations, plasmons can be created at energies above $2E_f$—thus exceeding energies attainable by photon emission—resulting in a plasmon spectrum that can extend from terahertz to near infrared frequencies and possibly into the visible range.

Furthermore, tuning the Fermi energy by external voltage can control the parameters (direction and frequency) of enhanced emission. This tunability also reveals regimes of backward GP emission, and regimes of forward GP emission with low angular spread; emphasizing the uniqueness of ČE from hot carriers flowing in graphene.

GP emission can also result from intraband transitions that are made possible by plasmonic losses. These kinds of transitions can become significant, and might help explain several phenomena observed in graphene devices, such as current saturation, high frequency radiation spectrum from graphene, and the black body radiation spectrum that seems to relate to extraordinary high electron temperatures.

Conventional studies, which generally focus on cases of classical free charge particles moving outside graphene, have revealed strong Čerenkov-related GP emission resulting from the charge particle-plasmon coupling. In contrast, this work focuses on the study of charge carriers inside graphene, as illustrated in FIGS. 28A-28B.

A quantum theory of ČE in graphene is developed. Analysis of this system gives rise to a variety of novel Čerenkov-induced plasmonic phenomena. The conventional threshold of the ČE in either 2D or 3D ($v>v_p$) may seem unattainable for charge carriers in graphene, because they are limited by the Fermi velocity $v\leq v_f$, which is smaller than the GP phase velocity $v_f<v_p$, as shown by the random phase approximation calculations. However, quantum effects can come into play to enable these charge carriers to surpass the actual ČE threshold. Specifically, the actual ČE threshold for free electrons can be shifted from its classically-predicted value by the quantum recoil of electrons upon photon emission. Because of this shift, the actual ČE velocity threshold can in fact lie below the velocity of charge carriers in graphene, contrary to the conventional predictions. At the core of the modification of the quantum ČE is the linearity of the charge carrier energy-momentum relation (Dirac cone). Consequently, a careful choice of parameters (e.g. Fermi energy, hot carrier energy) allows the ČE threshold to be attained—resulting in significant enhancements and high efficiencies of energy conversion from electrical to plasmonic excitation.

The quantum ČE can be described as a spontaneous emission process of a charge carrier emitting into GPs, calculated by Fermi's golden rule. The matrix elements can be obtained from the light-matter interaction term in the graphene Hamiltonian, illustrated by a diagram like FIG. 1B. To model the GPs, the random phase approximation can be used to combine with a frequency-dependent phenomenological lifetime to account for additional loss mechanisms such as optical phonons and scattering from impurities in the sample (assuming graphene mobility of $\mu=2000$ $cm^2/Vsec$). This approach can give good agreement with experimental results.

Figure 28B:
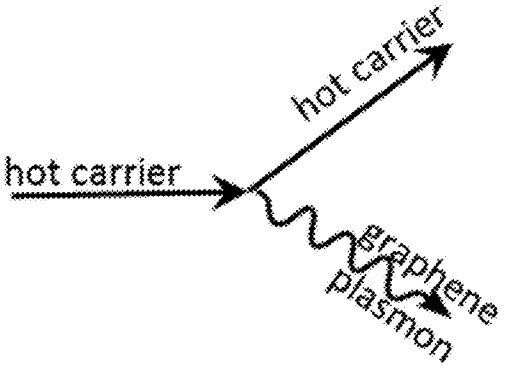
FIGS. 28A-28B show schematics of a system to generate Cerenkov-like effect in graphene via hot carriers.
Figure 28A:
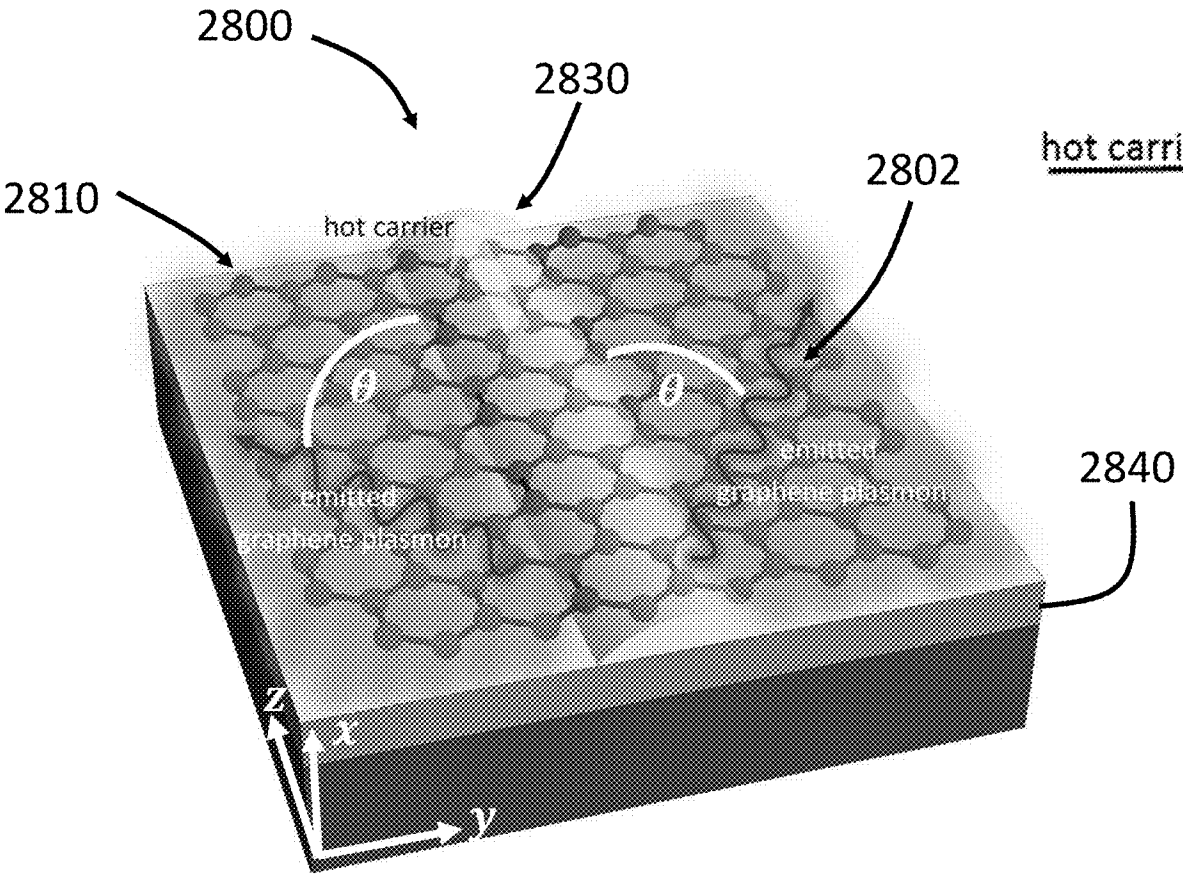

FIGS. 28A-28B show a system 2800 including a graphene layer 2810 disposed on a substrate 2840. The graphene layer 2810 includes hot carriers 2830 flowing within the graphene material. The graphene layer 2810 is in the yz plane, and the charge carrier 2830 is moving in the z direction.

For the case of low-loss GPs, the calculation reduces to the following integral:

$$\Gamma = \frac{2\pi}{\hbar}\int_{-\infty}^{\infty}\left|M_{k_i\to k_f+q}\right|^2\delta\left(E_{k_i}-\hbar\omega(q)-E_{k_f}\right)\frac{d^2q}{(2\pi)^2/A}\frac{d^2k_f}{(2\pi)^2/A} \tag{36}$$

$$M_{k_i\to k_f+q} = q_e(2\pi)^2\delta(q_y+k_{fy})\delta(k_{iz}-q_z-k_{fz})v_f\sqrt{\frac{\hbar q}{\varepsilon_0\tilde{\omega}(q)A^3}}\cdot[SP] \tag{37}$$

Where $M_{k_i\to k_f+q}$ is the matrix element, A is the surface area used for normalization, $q_e$ is the electric charge, $\varepsilon_0$ is the vacuum permittivity, [SP] is the spinor-polarization coupling term, and $\tilde{\omega}(q)$ is the GP dispersion-based energy normalization term ($\tilde{\omega}(q)=\bar{\epsilon}_r\omega\cdot v_p/v_g$, using the group velocity $v_g=\partial\omega/\partial q$).

The GP momentum $q=(q_y, q_z)$ satisfies $\omega^2/v_p^2=q_y^2+q_z^2$, with the phase velocity $v_p=v_p(\omega)$ or $v_p(q)$ obtained from the plasmon dispersion relation as $v_p=\omega/q$. The momenta of the incoming (outgoing) charge carrier $k_i=(k_{iy}, k_{iz})$ ($k_f=(k_{fy}, k_{fz})$) correspond to energies $E_{k_i}$ ($E_{k_f}$) according to the conical momentum-energy relation $E_k^2=\hbar^2v_f^2(k_y^2+k_z^2)$. The charge velocity is $v=E_k/|\hbar k|$, which equals a constant ($v_f$). The only approximation in Equations (36) and (37) comes from the standard assumption of high GP confinement (free space wavelength/GP wavelength>>1). Substituting Equation (36) into (37) obtain (denoting $E_i=E_{k_i}$):

$$\Gamma = \int_{-\infty}^{\infty}\frac{\alpha c\hbar v_g(q)}{\bar{\epsilon}_r v_p^2(q)/v_f^2}\delta(q_y+k_{fy})\delta(k_{iz}-q_z-k_{fz})\delta\left(E_i-\hbar\omega(q)-E_{k_f}\right)|SP|^2d^2qd^2k_f \tag{38}$$

Where $$\alpha\left(\approx\frac{1}{137}\right)$$

is the fine structure constant, c is the speed of light, and $\bar{\epsilon}_r$ is the relative substrate permittivity obtained by averaging the permittivity on both sides of the graphene. Assume $\bar{\epsilon}_r=2.5$ for all the figures. Because material dispersion can be neglected, all spectral features can be uniquely attributed to the GP dispersion and its interaction with charge carriers and not to any frequency dependence of the dielectrics.

It can be further defined that the angle $\varphi$ for the outgoing charge and $\theta$ for the GP, both relative to the z axis, which is the direction of the incoming charge. This notation allows simplification of the spinor-polarization coupling term [SP] for charge carriers inside graphene to $|SP|^2=\cos^2(\theta-\varphi/2)$ or $|SP|^2=\sin^2(\theta-\varphi/2)$ for intraband or interband transitions respectively. The delta functions in Equation (38) can restrict the emission to two angles $\theta=\pm\theta_{\check{C}}$ (a clear signature of the ČE), and so we simplify the rate of emission to:

$$\cos(\theta_{\check{C}}) = \frac{v_p}{v_f}\left[1-\frac{\hbar\omega}{2E_i}\left(1-\frac{v_f^2}{v_p^2}\right)\right] \tag{39a}$$

-continued $$\Gamma_\omega = \frac{2ac}{v_f\bar{\epsilon}_r}\frac{\left|1-\frac{\hbar\omega}{2E_i}\left(1+\frac{v_f}{v_p}\cos(\theta_{\breve{C}})\right)\right|}{\left|\sin(\theta_{\breve{C}})\right|} = \frac{2ac}{v_f\bar{\epsilon}_r}\left|\frac{\sin(\theta_{\breve{C}})}{1-v_p^2/v_f^2}\right| \tag{39b}$$

By setting $\hbar\to 0$ in the above expressions, one can recover the classical 2D ČE, including the Čerenkov angle $\cos(\theta_{\breve{C}})=v_p/v$, that can also be obtained from a purely classical electromagnetic calculation. However, while charge particles outside of graphene satisfy $\hbar\omega \ll E_i$, making the classical approximation almost always exact, the charges flowing inside graphene can have much lower energies because they are massless. Consequently, the introduced $\hbar$ terms in the ČE expression modifies the conventional velocity threshold significantly, allowing ČE to occur for lower charge velocities. e.g., while the conventional ČE requires charge velocity above the GP phase velocity ($v>v_p$), Equation (39a) allows ČE below it, and specifically requires the velocity of charge carriers in graphene ($v=v_f$) to reside between $$v_p > v_f > v_p\left|1-\frac{2E_i}{\hbar\omega}\right|.$$

Physically, the latter case involves interband transitions made possible when graphene is properly doped: when the charge carriers are hot electrons (holes) interband ČE requires negatively (positively) doped graphene.

FIGS. 29A-29D and FIGS. 30A-30D show interband ČE that indeed occurs for charge velocities below the conventional velocity threshold.

Figure 29B:
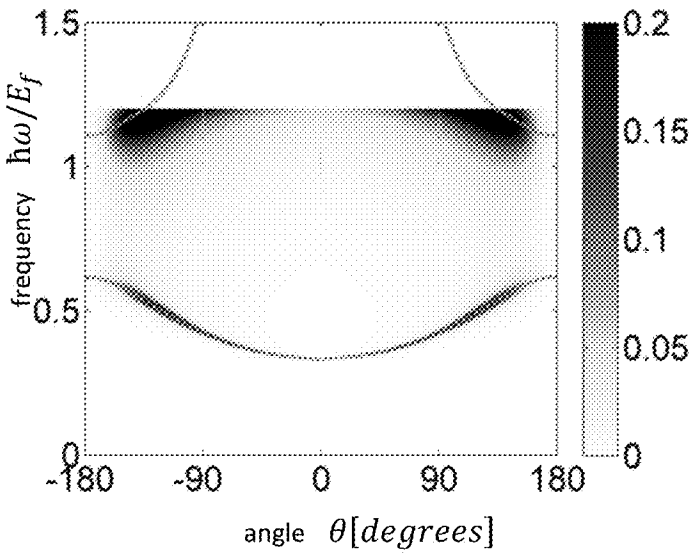
FIGS. 29A-29D, 30A-30D, and 31A-31D show theoretical results of graphene plasmon emission from hot carriers in graphene.
Figure 29A:
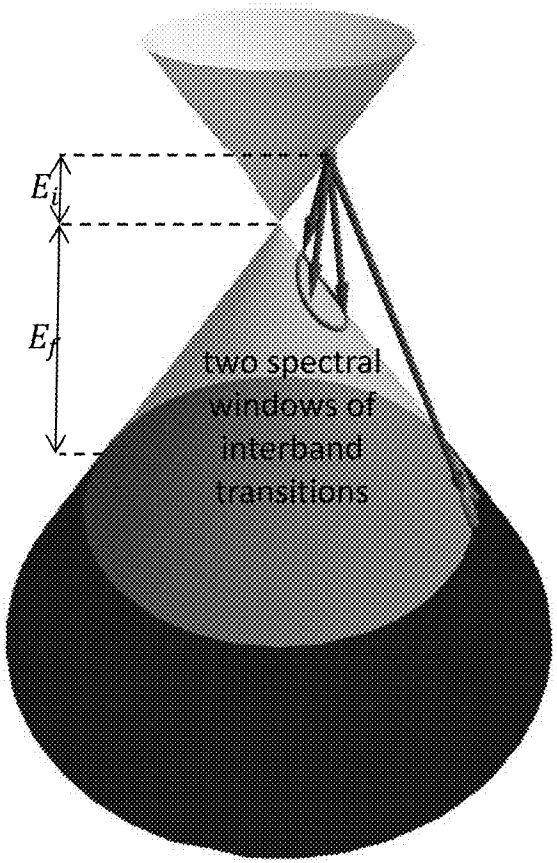
Figure 29C:
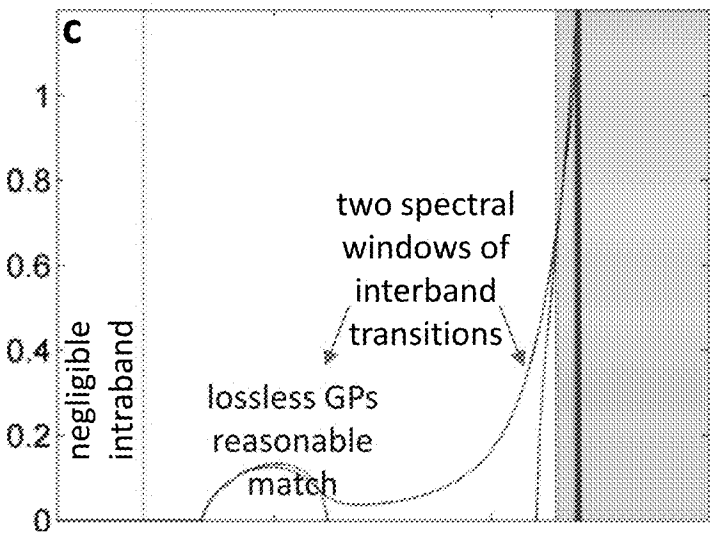
Figure 29D:
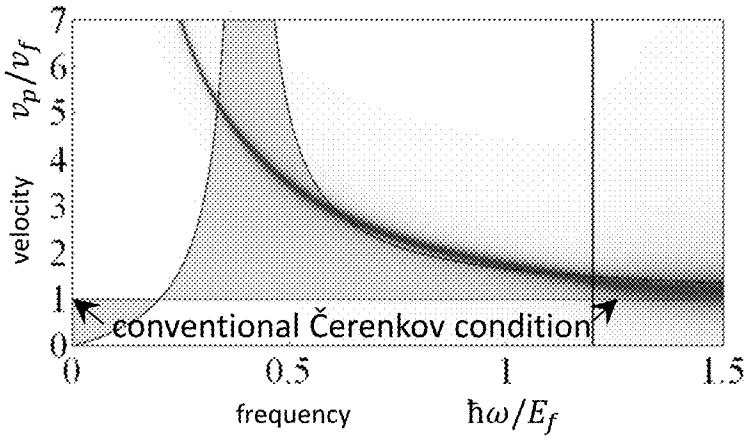

FIG. 29A illustrate possible transitions, including interband transition and intraband transition in graphene energy diagrams. FIG. 29B shows mapping of GP emission rate as a function of frequency and angle. Most of the GP emission around the dashed blue curves that are exactly found by the Čerenkov angle. FIG. 29C shows spectrum of the ČE GP emission process, with the red regime marking the area of high losses, the vertical dotted red line dividing between interband to intraband transitions, and the thick orange line marking the spectral cutoff due to the Fermi sea beyond which all states are occupied. FIG. 29D shows explanations of the GP emission with the quantum ČE. The red curve shows the GP phase velocity, with its thickness illustrating the GP loss. The blue regime shows the range of allowed velocities according to the quantum ČE. Enhanced GP emission occurs in the frequencies for which the red curve crosses the blue regime, either directly or due to the curve thickness. All figures are presented in normalized units except for the angle shown in degrees.

Figure 30B:
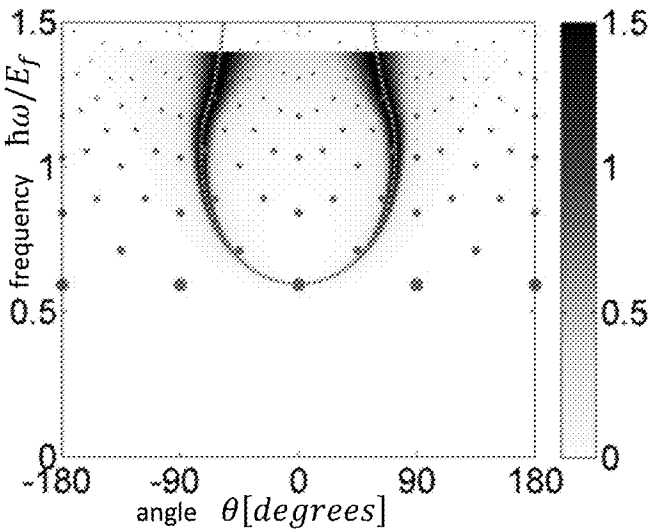
Figure 30A:
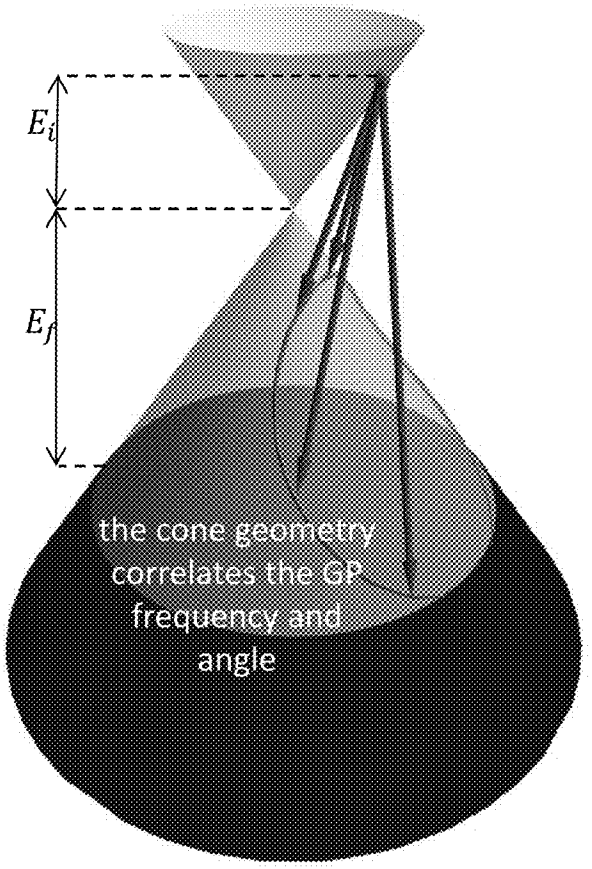

FIGS. 30A-30D also illustrate GP emission from hot carriers. Caption same as FIG. 2. The green dots in FIG. 30B show the GPs can be coupled out, as light, with the size illustrating the strength of the coupling.

FIGS. 31A-31D illustrate GP emission from hot carriers, in which most of the emission occurs in the forward direction with a relatively low angular spread. The green dot shows that GPs a particular frequency can be coupled out as light.

The inequalities can be satisfied in two spectral windows simultaneously for the same charge carrier, due to the frequency dependence of the GP phase velocity (shown by the intersection of the red curve with the blue regime in FIG. 29D). Moreover, part of the radiation (or even most of it, as in FIGS. 29A-29D) can be emitted backward, which is considered impossible for ČE in conventional materials.

Figure 30C:
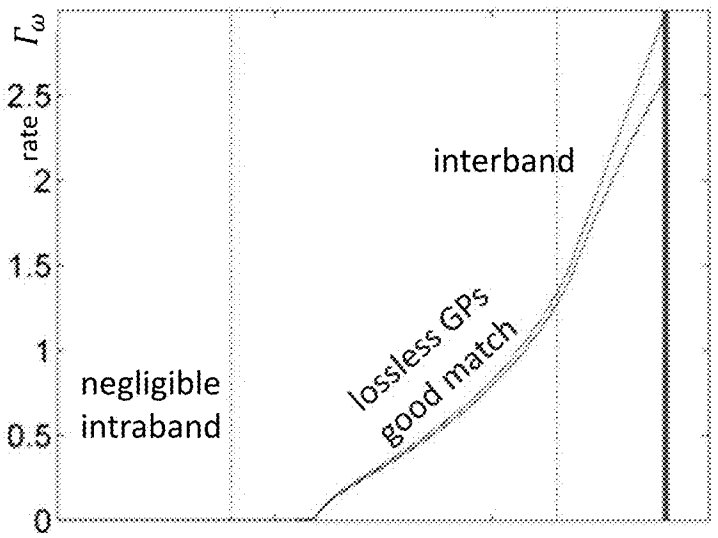
Figure 30D:
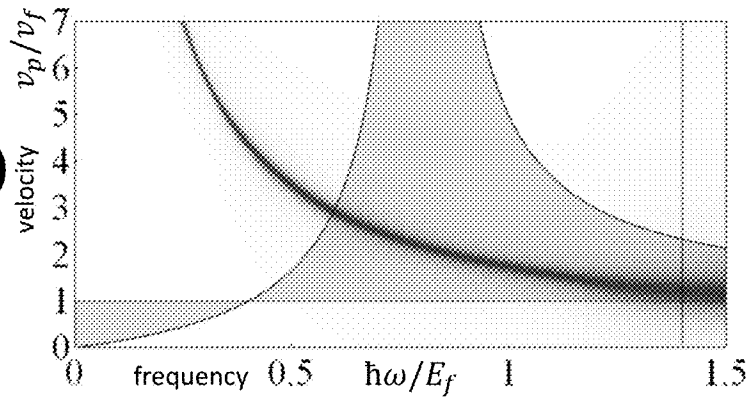
Figure 31A:
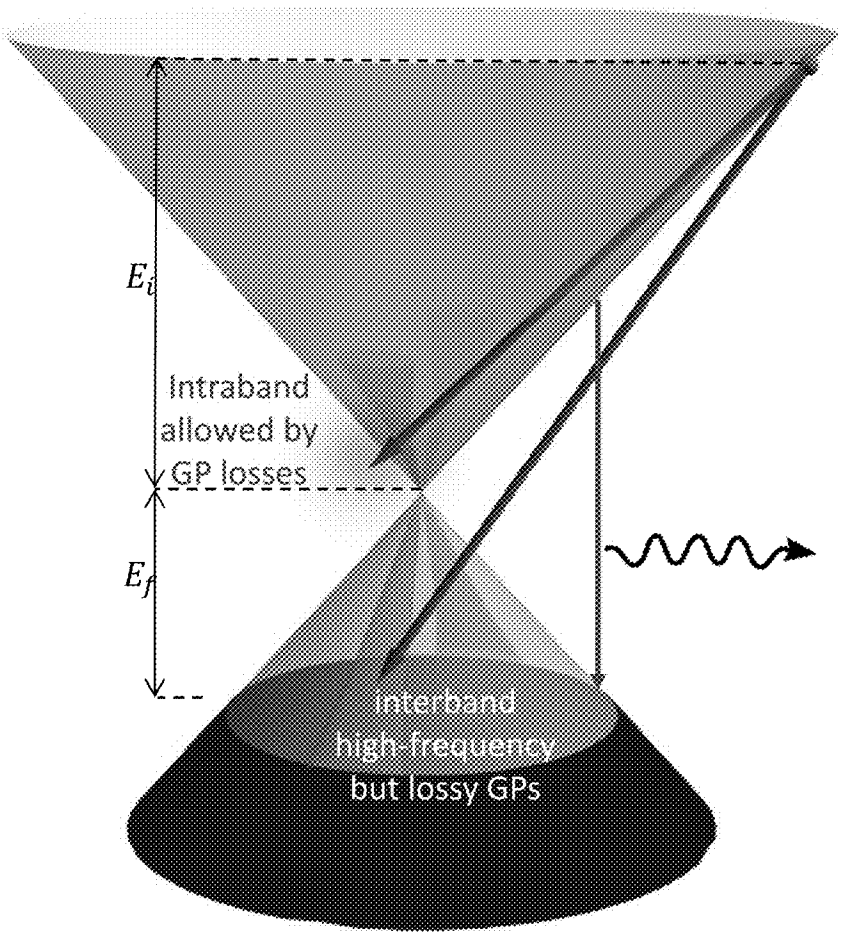
Figure 31B:
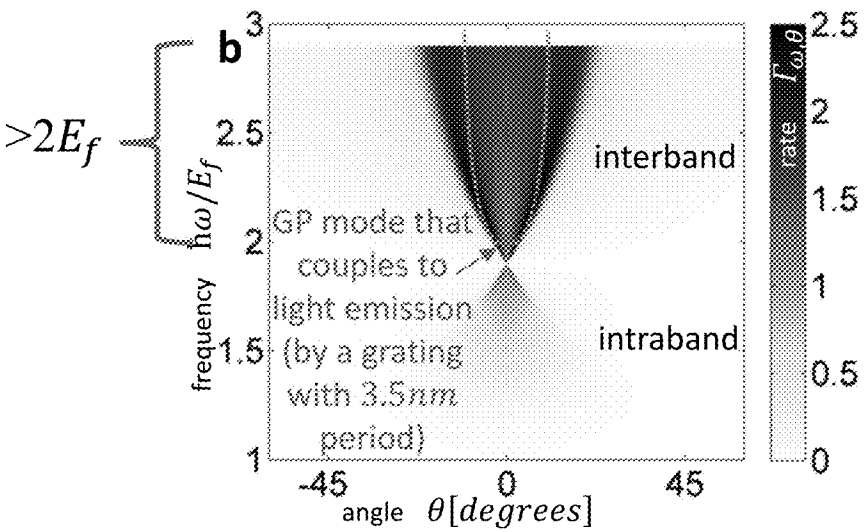
Figures 31C, 31D:
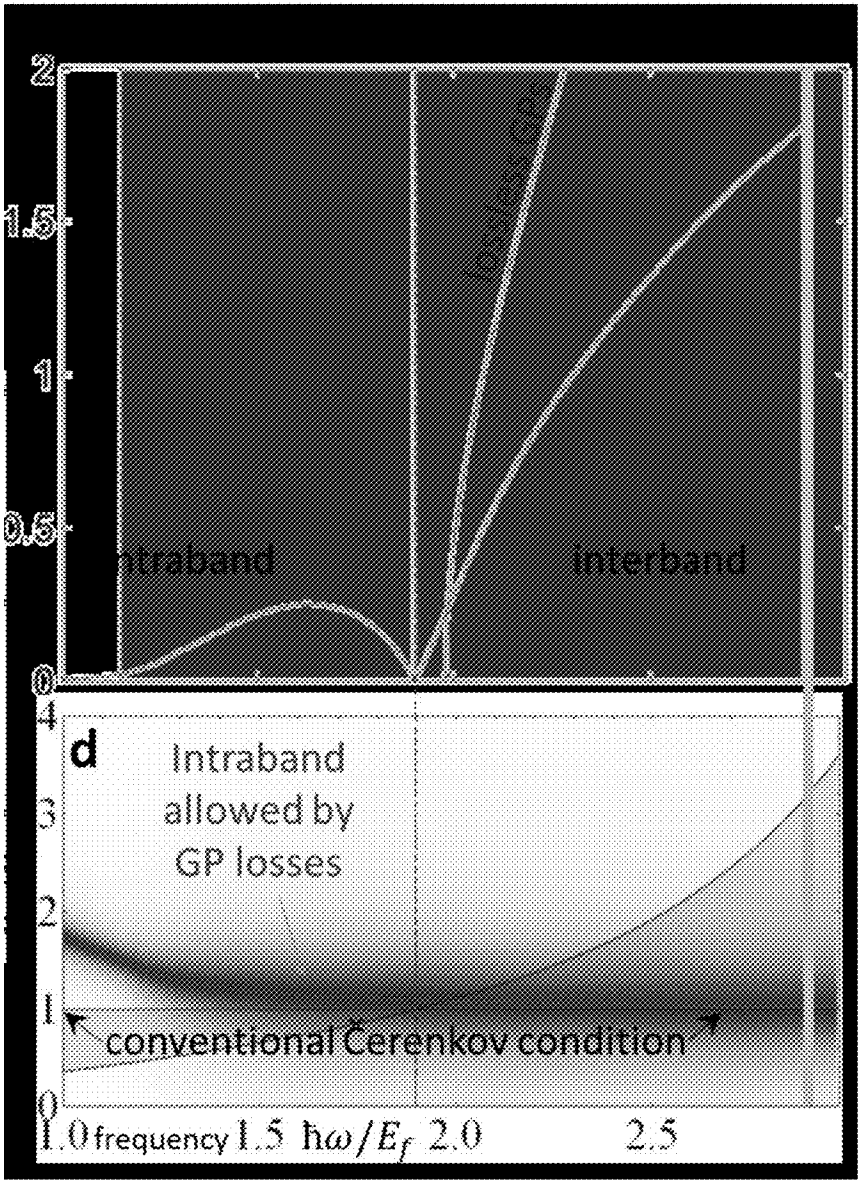

Several spectral cutoffs appear in FIGS. 29C, 30C, and 31C, as seen by the range of non-vanishing blue spectrum. These can be found by substituting $\theta_{\breve{C}}=0$ in Equation (39a), leading to $\hbar\omega_{cutoff}=2E_i/(1\pm v_f/v_p)$, exactly matching the points where the red curve in FIGS. 29D, 30D, and 31D crosses the border of the blue regime. The upper most frequency cutoff marked by the thick orange line in FIGS. 29-31 occurs at $\hbar\omega=E_i+E_f$ due to the interband transition being limited by the Fermi sea of excited states. This implies that GP emission from electrical excitation can be more energetic than photon emission from a similar process (that is limited already by $\hbar\omega\lesssim 2E_f$). Finite temperature will broaden all cutoffs by the expected Fermi-Dirac distribution. However, for most frequencies, the GP losses are a more significant source of broadening.

To incorporate the GP losses (as we do in all the figures), the matrix elements calculation can be modified by including the imaginary part of the GP wavevector $q_I=q_I(\omega)$, derived independently for each point of the GP dispersion curve. This is equivalent to replacing the delta functions in Equation (38) by Lorentzians with $1/\gamma$ width, defining $\gamma(\omega)=q_R(\omega)/q_I(\omega)$. The calculation can be done partly analytically yielding:

$$\Gamma_{\omega,\theta} = \frac{ac}{\pi^2\bar{\epsilon}_r v_p(\omega)}\left|\frac{E_i}{\hbar\omega}-1\right|\int_0^{2\pi} d\varphi \begin{cases}\cos^2(\theta-\varphi/2) & \text{intraband transition}\\ \sin^2(\theta-\varphi/2) & \text{interband transition}\end{cases}\cdot \frac{\left|\frac{\sin(\theta)}{\gamma(\omega)}\right|}{\left(\frac{v_p(\omega)}{v_f}\left|\frac{E_i}{\hbar\omega}-1\right|\sin(\varphi)+\sin(\theta)\right)^2+\left|\frac{\sin(\theta)}{\gamma(\omega)}\right|^2}\cdot \frac{|\cos(\theta)/\gamma(\omega)|}{\left(\frac{v_p(\omega)}{v_f}\left|\frac{E_i}{\hbar\omega}-1\right|\cos(\varphi)+\cos(\theta)-\frac{v_p(\omega)}{v_f}\frac{E_i}{\hbar\omega}\right)^2+|\cos(\theta)/\gamma(\omega)|^2} \tag{40}$$

The immediate effect of the GP losses can be the broadening of the spectral features, as shown in FIGS. 29C, 30C, and 31C. Still, the complete analytic theory of Equations (37) and (38) can matches very well with the exact graphene ČE (e.g., regimes of enhanced emission agree with Equation (39a), as marked in FIGS. 29B, 30B, and 31B by blue dashed curves). The presence of GP loss also opens up a new regime of quasi-ČE that takes place when the charge velocity is very close to the Čerenkov threshold but does not exceed it. The addition of Lorentzian broadening then closes the gap, creating significant non-zero matrix elements that can lead to intraband GP emission (FIGS. 31A-31D). This GP emission occurs even for hot electrons (holes) in positively (negatively) doped graphene, with the only change in FIGS. 31A-31D being that the upper frequency cutoff is instead shifted to $\hbar\omega\le E_i-E_f$ (eliminating all interband transitions). The dip in the spectrum at the boundary between interband and intraband transitions (FIG. 31C) follows from the charge carriers density of states being zero at the tip of the Dirac cone.

The interband ČE in FIGS. 31A-31D shows the possibility of emission of relatively high frequency GPs, even reaching near-infrared and visible frequencies. These are interband transitions as in FIGS. 29-30 thus limited by $\hbar\omega \leq E_i + E_f$. This limit can get to a few eVs because $E_i$ is controlled externally by the mechanism creating the hot carriers (e.g., p-n junction, tunneling current in a heterostructure, STM tip, ballistic transport in graphene with high drain-source voltage, photoexcitation). The existence of GPs can be at near-infrared frequencies. The only fundamental limitation can be the energy at which the graphene dispersion ceases to be conical (~1 eV from the Dirac point). Even then, equations presented here are only modified by changing the dispersion relations of the charge carrier and the GP, and therefore the graphene ČE should appear for $E_i$ as high as ~3 eV. The equations here are still valid since they are written for a general dispersion relation, with $v_p(\omega)$ and $\gamma(\omega)$ as parameters, thus the basic predictions of the equations and the ČE features we describe will continue to hold regardless of the precise plasmon dispersion. For example, an alternative way of calculating GP dispersion, giving larger GP phase velocities at high frequencies—this will lead to more efficient GP emission, as well as another intraband regime that can occur without being mediated by the GP loss.

There exist several possible avenues for the observation of the quantum ČE in GPs, having to do with schemes for exciting hot carriers. For example, apart from photoexcitation, hot carriers have been excited from tunneling current in a heterostructure, and by a biased STM tip, therefore, GPs with the spectral features presented here (FIGS. 29C, 30C, and 31C) should be achievable in all these systems.

In case the hot carriers are directional, measurement of the GP Čerenkov angle (e.g. FIGS. 29B, 30B, and 31B) should also be possible. This might be achieved by strong drain-source voltage applied on a graphene p-n junction, or in other graphene devices showing ballistic transport. Another intriguing approach could be exciting the hot carriers and measuring the generated ČE with the Photon-Induced Near-Field Electron Microscopy, which might allow the visualization of the temporal dynamics of the Čerenkov emission. This approach can be especially exciting since the temporal dynamics of the ČE is expected to appear in the form of a plasmonic shockwave (as the conventional ČE appears as a shockwave of light).

Hot carriers generated from a tunneling current or p-n junction may have a wide energy distribution (instead of a single $E_i$). The ČE spectrum corresponding to an arbitrary hot carrier excitation energy distribution is readily computed by integrating over a weighted distribution of ČE spectra for monoenergetic hot carriers. The conversion efficiency remains high even when the carriers energy distribution is broad, as implied by the high ČE efficiencies for the representative values of $E_i$ studied here (FIGS. 29-31 all show rates on the order of $\Gamma \sim 1$). This high conversion efficiency over a broad range of $E_i$ owes itself to the low phase velocity and high confinement of graphene plasmons over a wide frequency range.

The ČE emission of GPs can be coupled out as free-space photons by creating a grating or nanoribbons—fabricated in the graphene, in the substrate, or in a layer above it—with two arbitrarily-chosen examples marked by the green dots in FIGS. 30B and 31B. Careful design of the coupling mechanism can restrict the emission to pre-defined frequencies and angles, with further optimization needed for efficient coupling. This clearly indicates that the GP emission, although usually considered as merely a virtual process, can be in fact completely real in some regimes, with the very tangible consequences of light emission in terahertz, infrared or possibly visible frequencies. Such novel sources of light could have promising applications due to graphene's dynamic tunability and small footprint (due to the small scale of GPs). Moreover, near perfect conversion efficiency of electrical energy into photonic energy might be achievable due to the ČE emission rate dominating all other scattering processes. In addition, unlike plasmonic materials such as silver and gold, graphene can be CMOS compatible.

The hot carrier lifetime due to GP emission in doped graphene is defined by the inverse of the total rate of GP emission, and can therefore be exceptionally short (down to a few fs). Such short lifetimes are in general agreement with previous research on the subject that have shown electron-electron scattering as the dominant cooling process of hot carriers, unless hot carriers of relatively high energies ($E_i \approx 2E_f$ and above) are involved. In this latter case, one can expect single-particle excitations to prevail over the contribution of the plasmonic resonances. This is also in agreement with the fact that plasmons with high energies and momenta (in the electron-hole continuum, pink areas in FIGS. 29-31) are very lossy. Additional factors that keep the ČE from attaining near-perfect conversion efficiency include other scattering processes like acoustic and optical phonon scattering. Due to the relatively long lifetime from acoustic phonon scattering (hundreds of fs to several ps), however, any deterioration due to this effect is not likely to be significant. Scattering by optical phonons can be more significant for hot carriers above 0.2 eV, but its contribution can be still about an order of magnitude smaller in our regime of interest.

The high rates of GP emission also conform to research of the reverse process—of plasmons enhancing and controlling the emission of hot carriers—that is also found to be particularly strong in graphene. This might reveal new relations between ČE to other novel ideas of graphene-based radiation sources that are based on different physical principles.

It is also worth noting that Čerenkov-like plasmon excitations from hot carriers can be found in other condensed matter systems such as a 2D electron gas at the interface of semiconductors. Long before the discovery of graphene, such systems have demonstrated very high Fermi velocities (even higher than graphene's), while also supporting meV plasmons that can have slow phase velocities, partly due to the higher refractive indices possible in such low frequencies. The ČE coupling, therefore, can also be found in materials other than graphene. In many cases, the coupling of hot carriers to bulk plasmons is even considered as part of the self-energy of the carriers, although the plasmons are then considered as virtual particles in the process. Nonetheless, graphene can offer opportunities where the Čerenkov velocity matching can occur at relatively high frequencies, with plasmons that have relatively low losses. These differences can make the efficiency of the graphene ČE very high.

CONCLUSION

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of designing and making the technology disclosed herein may be implemented using hardware, software or a combination thereof. When implemented in software, the software code can be executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes (outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An apparatus comprising:

at least one conductive layer having a thickness less than 5 nm;

an electromagnetic (EM) wave source, in electromagnetic communication with the at least one conductive layer, to transmit a first EM wave at a first wavelength in the at least one conductive layer so as to generate a surface plasmon polariton (SPP) field near a surface of the at least one conductive layer; and an electron source to propagate an electron beam at least partially in the SPP field so as to generate a second EM wave at a second wavelength different than the first wavelength, wherein the electron beam has an electron energy greater than 3 eV and the second wavelength is less than 1 μm.

2. The apparatus of claim 1, wherein the at least one conductive layer comprises a two-dimensional conductor.

3. The apparatus of claim 1, wherein the at least one conductive layer comprises at least one graphene layer.

4. The apparatus of claim 1, wherein the at least one conductive layer defines a grating pattern to reduce propagation loss of the SPP field.

5. The apparatus of claim 1, further comprising:

a dielectric layer, disposed on the at least one conductive layer, to support the at least one conductive layer.

6. The apparatus of claim 1, wherein the electron source is configured to provide the electron beam as a plurality of electron bunches and the EM wave source is configured to provide a plurality of laser pulses.

7. The apparatus of claim 1, wherein the electron source is configured to provide the electron beam as a sheet electron beam.

8. The apparatus of claim 1, wherein the electron energy is greater than 100 keV and the second wavelength is less than 2.5 nm.

9. The apparatus of claim 1, wherein the electron energy is greater than 5 keV and the second wavelength is less than 100 nm.

10. The apparatus of claim 1, wherein the electron energy is in a range of 0.5 keV to 200 keV and the second wavelength is 10 nm to 100 nm.

11. The apparatus of claim 1, wherein the electron source comprises:

a first electrode disposed at a first end of the at least one conductive layer; and a second electrode, disposed at a second end of the at least one conductive layer, to generate the electron beam via discharge, wherein the electron beam propagates substantially parallel to the surface of the at least one conductive layer.

12. The apparatus of claim 1, wherein the second wavelength is less than the first wavelength.

13. The apparatus of claim 1, wherein the second wavelength is greater than the first wavelength.

14. The apparatus of claim 1, wherein the electron source is a free electron source and the electron beam comprises free electrons.

15. The apparatus of claim 1, wherein the EM wave source is a laser, the first wavelength is an optical wavelength, and the second wavelength is an X-ray or ultraviolet wavelength.

16. The apparatus of claim 1, wherein the SPP field is within 100 nm of the surface of the at least one conductive layer and the electron beam propagates within the SPP field above the surface of the at least one conductive layer.

17. The apparatus of claim 1, wherein the SPP field extends across the surface of the at least one conductive layer.

18. The apparatus of claim 1, wherein the electron source emits the electron beam at an angle with respect to the surface of the at least one conductive layer.

19. The apparatus of claim 3, wherein the at least one graphene layer comprises:

a first graphene layer;

a second graphene layer disposed opposite a dielectric layer from the first graphene layer, the first graphene layer and the second graphene layer defining a cavity to support propagation of the electron beam.

20. The apparatus of claim 3, wherein the at least one graphene layer comprises at least one of a bilayer graphene or a multilayer graphene.

21. The apparatus of claim 19, wherein the cavity has a width of less than 100 nm.

22. A method of generating electromagnetic (EM) radiation, the method comprising:

illuminating a conductive layer, having a thickness less than 5 nm, with a first EM wave at a first wavelength so as to generate a surface plasmon polariton (SPP) field near a surface of the conductive layer; and propagating an electron beam at least partially in the SPP field so as to generate a second EM wave at a second wavelength different from the first wavelength, wherein propagating the electron beam comprises propagating electrons at an electron energy greater than 3 eV and the second wavelength is less than 1 μm.

23. The method of claim 22, wherein electron energy greater than 100 keV and the second wavelength is less than 2.5 nm.

24. The method of claim 22, wherein electron energy greater than 5 keV and the second wavelength is less than 100 nm.

25. The method of claim 22, wherein propagating the electron beam comprises propagating a plurality of electron bunches in the SPP field and wherein the second EM wave comprises coherent EM radiation.

26. The method of claim 22, wherein propagating the electron beam comprises propagating the electron beam as a sheet electron beam at least partially within the SPP field.

27. The method of claim 22, wherein illuminating the conductive layer comprises illuminating a graphene layer, wherein the method further comprises:

adjusting a Fermi level of the graphene layer so as to modulate the second wavelength of the second EM wave.

28. The method of claim 22, wherein the second wavelength is greater than the first wavelength.

29. An apparatus to generate X-ray radiation, the apparatus comprising:

a dielectric layer;

a graphene layer doped with a surface carrier density substantially equal to or greater than $1.5\times10^{13}$ $cm^{-2}$ and disposed on the dielectric layer;

a laser, in optical communication with the graphene layer, to transmit a laser beam, at a first wavelength substantially equal to or greater than 800 nm, in the graphene layer so as to generate a surface polariton field near a surface of the graphene layer; and an electron source to propagate an electron beam, having an electron energy greater than 100 keV, at least partially in the surface polariton field so as to generate the X-ray radiation at a second wavelength less than 5 nm.

30. An apparatus comprising:

at least one conductive layer having a thickness less than 5 nm;

an electromagnetic (EM) wave source, in electromagnetic communication with the at least one conductive layer, to transmit a first EM wave at a first wavelength in the at least one conductive layer so as to generate a surface plasmon polariton (SPP) field in the at least one conductive layer; and an electron source to propagate an electron beam in the at least one conductive layer so as to generate a second EM wave at a second wavelength different from the first wavelength, wherein the electron beam has an electron energy greater than 3 eV and the second wavelength is less than 1 μm.

31. The apparatus of claim 30, wherein the at least one conductive layer comprises a two-dimensional (2D) conductor.

32. The apparatus of claim 30, wherein the at least one conductive layer comprises at least one graphene layer.

33. The apparatus of claim 30, wherein the at least one conductive layer defines a grating pattern so as to reduce propagation loss of the SPP field.

34. The apparatus of claim 30, further comprising:

a dielectric layer, disposed on the at least one conductive layer, to support the at least one conductive layer.

35. The apparatus of claim 30, wherein the electron source is configured to provide the electron beam as a plurality of electron bunches.

36. The apparatus of claim 30, wherein the electron source is configured to provide the electron beam as a sheet electron beam.

37. The apparatus of claim 30, wherein the electron energy is greater than 100 keV and the second wavelength is less than 2.5 nm.

38. The apparatus of claim 30, wherein the electron energy is greater than 5 keV and the second wavelength is less than 100 nm.

39. The apparatus of claim 30, wherein the electron energy is in a range of 0.5 keV to 200 keV and the second wavelength is 10 nm to 100 nm.

40. The apparatus of claim 30, wherein the electron source comprises:

a first electrode disposed at a first end of the at least one conductive layer; and a second electrode, disposed at a second end of the at least one conductive layer, to generate the electron beam via discharge, wherein the electron beam propagates substantially parallel to the surface of the at least one conductive layer.

41. The apparatus of claim 32, wherein the at least one graphene layer comprises at least one of a bilayer graphene or a multilayer graphene.

42. The apparatus of claim 30, wherein the second wavelength is greater than the first wavelength.

* * * * *